US007309564B2

(12) United States Patent
Yoshioka et al.

(10) Patent No.: US 7,309,564 B2
(45) Date of Patent: Dec. 18, 2007

(54) PHOTOTHERMOGRAPHIC MATERIAL AND IMAGE FORMING METHOD

(75) Inventors: Yasuhiro Yoshioka, Kanagawa (JP); Katsutoshi Yamane, Kanagawa (JP); Yasuhiko Goto, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 258 days.

(21) Appl. No.: 11/269,595

(22) Filed: Nov. 9, 2005

(65) Prior Publication Data

US 2006/0078835 A1 Apr. 13, 2006

Related U.S. Application Data

(63) Continuation-in-part of application No. 10/825,102, filed on Apr. 16, 2004, now abandoned, and a continuation-in-part of application No. 10/191,485, filed on Jul. 10, 2002, now Pat. No. 7,060,423.

(30) Foreign Application Priority Data

| | | |
|---|---|---|
| Jul. 12, 2001 | (JP) | 2001-212445 |
| Jul. 27, 2001 | (JP) | 2001-227838 |
| Nov. 14, 2001 | (JP) | 2001-349031 |
| Dec. 11, 2001 | (JP) | 2001-346122 |
| Apr. 24, 2003 | (JP) | 2003-119775 |

(51) Int. Cl.
*G03C 5/16* (2006.01)
*G03C 1/00* (2006.01)

(52) U.S. Cl. ..... 430/348; 430/349; 430/350; 430/351; 430/352; 430/353; 430/354; 430/355; 430/617; 430/618; 430/619; 430/620

(58) Field of Classification Search ..... 430/617–620, 430/348–355
See application file for complete search history.

(56) References Cited

U.S. PATENT DOCUMENTS

| | | | |
|---|---|---|---|
| 4,332,889 | A | 6/1982 | Siga et al. |
| 6,143,488 | A | 11/2000 | Uytterhoeven et al. |
| 6,274,297 | B1 | 8/2001 | Uytterhoeven et al. |
| 6,468,720 | B1 | 10/2002 | Hirabayashi et al. |
| 7,060,423 | B2 * | 6/2006 | Yamane et al. ..... 430/350 |

* cited by examiner

*Primary Examiner*—Geraldina Visconti
(74) *Attorney, Agent, or Firm*—Margaret A. Burke; Sheldon J. Moss

(57) ABSTRACT

A photothermographic material including, on at least one surface of a support, at least a photosensitive silver halide containing a silver iodide at 40 mol % or more, a non-photosensitive organic silver salt, and a reducing agent, wherein the photothermographic material contains two or more kinds of the reducing agent at the mixing ratio to satisfy at least one of a), b), c) and d):

a) a difference between a sensitivity or b) a difference between a maximum density is 0.10 or less, when developed at 120° C. for 10 sec and a sensitivity when developed at 120° C. for 14 sec;

c) a difference between a sensitivity or d) a difference between a maximum density is 0.10 or less, when developed at 117° C. for 12 sec and a sensitivity when developed at 123° C. for 12 sec.

An image forming method using the photothermographic material is also provided.

18 Claims, No Drawings

PHOTOTHERMOGRAPHIC MATERIAL AND IMAGE FORMING METHOD

CROSS-REFERENCE TO RELATED APPLICATION

This application is a continuation-in-part of earlier filed application Ser. No. 10/191,485 filed Jul. 10, 2002 now U.S. Pat. No. 7,060,423, which claims priority under 35 USC 119 from Japanese Patent Application Nos. 2001-212445, 2001-227838, 2001-346122, and 2001-349031, and is a continuation-in-part of earlier filed application Ser. No. 10/825,102 filed Apr. 16, 2004 now abandoned, which claims priority under 35 USC 119 from Japanese Patent Application No. 2003-119775, the disclosure of which is incorporated by reference herein.

BACKGROUND OF THE INVENTION

1. Field of the Invention

The present invention relates to a photothermographic material and a method of forming an image using the photothermographic material. More particularly, the invention relates to an improved photothermographic material, which exhibits stable photographic properties without unevenness in density, and an improved method of forming an image.

2. Description of the Related Art

In recent years, it has been strongly desired in the field of films for medical imaging to reduce the amount of used processing liquid waste in consideration of environmental protection and space saving. For this reason, technology regarding photothermographic materials as films for medical imaging and for photographic applications, which are capable of efficient exposure with a laser image setter or a laser imager and capable of forming a clear black-toned image with high resolution and high sharpness is desired. Such photothermographic materials can eliminate use of liquid processing chemicals and can provide users with a thermal development system which is simpler and does not contaminate the environment.

Although similar requirements also exist in the field of general image forming materials, an image for medical imaging requires a particularly high image quality excellent in sharpness and granularity because a delicate image representation is necessitated. Also an image of blue-black tone is preferred in consideration of easy diagnosis. Currently various hard copy systems utilizing pigments or dyes, such as ink jet printers and electrophotographic systems, are available as general image forming systems, but they are not satisfactory as output systems for medical images.

On the other hand, thermal image forming systems utilizing organic silver salts are described, for example, in U.S. Pat. Nos. 3,152,904 and 3,457,075, as well as in "Thermally Processed Silver Systems", written by D. H. Klosterboer, appearing in "Imaging Processes and Materials", Neblette, 8th edition, edited by J. Sturge, V. Warlworth, and A. Shepp, Chapter 9, pages 279 to 291, 1989. A photothermographic material generally comprises a photosensitive layer in which a catalytically active amount of photocatalyst (for example, a silver halide), a reducing agent, a reducible silver salt (for example, an organic silver salt) and, if necessary, a toner for controlling the tone of a developed silver image are dispersed in a matrix of a binder. The photothermographic material, when heated at high temperature (for example, 80° C. or higher) after image exposure, forms a black-toned silver image by an oxidation/reduction reaction between the silver halide or the reducible silver salt (functioning as an oxidizer) and the reducing agent. The oxidation/reduction reaction is promoted by a catalytic effect of a latent image formed by exposure on silver halide. Thus, a black-toned silver image is formed in an exposed area. Such materials are described in U.S. Pat. No. 2,910,377 and Japanese Patent Application Publication (JP-B) No. 43-4924. Also, Fuji Medical Dry Laser Imager FM-DP L is an example of a practical medical image forming system using a photothermographic material that has been marketed.

In production of a photothermographic material using an organic silver salt, two methods are available: in one method, a solvent coating is adopted, and in the other method, an aqueous coating is adopted. It is known that in the aqueous coating method, a coating solution for an image forming layer containing an aqueous dispersion of polymer fine particles as a main binder is used. In the latter method, since no necessity arises for a process of solvent recovery or the like, a production facility is simple and the method is advantageous for mass production.

In the photothermographic material, all chemicals required for image forming are included in a coating film beforehand, and the chemicals remain as unreacted compounds or reaction products in the film after performing thermal development.

Therefore, when the photothermographic material is exposed to indoor light or the like after image formation or is exposed to high temperatures while being stored, the reductive reaction of silver ions occurs and results in fogging, which has been an intrinsic problem of photothermographic materials. This problem of image stability called "print-out" is specific to the photothermographic materials and improvements are still further required for the photothermographic materials.

JP-A No. 2001-33911 discloses that, for example, a polyhalogen compound which oxidatively decomposes unnecessary fogging silver generated in the processed photothermographic material over time is effective as means for improving image stability. JP-A Nos. 2002-156727 and 2002-318431 disclose a complex-forming agent which forms a complex with a developing agent and restrains undesirable reductive reaction during storage. However, these conventional techniques have limitations with respect to the improvement of print-out, especially in the presence of lighting, and therefore, technology for drastic improvement is desired.

SUMMARY OF THE INVENTION

An object of the present invention is to provide an improved photothermographic material which is excellent in image stability and an improved method of forming an image. Another object of the present invention is to provide an improved photothermographic material which always exhibits stable photographic properties and an improved method of forming an image.

Technology for improving print-out as a problem specific to photothermographic material has been energetically studied from many angles. As a result, it has been found that the problem of the print-out is remarkably improved by using a silver iodide emulsion as a photosensitive silver halide. However, the use of the silver iodide emulsion has caused new problems which must be solved. One problem is that the color tone of developed silver images is unsettled and changes due to a slight variation in the temperature of thermal development. Another problem is that there is a difference in color tone among parts of a developed sheet.

Especially when, the photothermographic material is used as an image recording material for medical diagnosis, the color tone of a developed silver image influences diagnostic ability, and therefore, the problems are serious.

The objects of the invention can be accomplished by the following means.

A first aspect of the invention is to provide a photothermographic material comprising, on at least one surface of a support, at least a photosensitive silver halide, a non-photosensitive organic silver salt, a reducing agent and a binder, wherein the photosensitive silver halide has a silver iodide content of 40 mol % or more, and the photothermographic material contains two or more kinds of the reducing agent at the mixing ratio to satisfy at least one of a) and b): a) a difference between a sensitivity when the photothermographic material has been developed at 120° C. for 10 sec and a sensitivity when the photothermographic material has been developed at 120° C. for 14 seconds is 0.10 or less, wherein these sensitivities are expressed as a logarithm of a reciprocal of an exposure value; b) a difference between a maximum density when the photothermographic material has been developed at 120° C. for 10 sec and a maximum density when the photothermographic material has been developed at 120° C. for 14 sec is 0.10 or less.

A second aspect of the invention is to provide a photothermographic material comprising, on at least one surface of a support, at least a photosensitive silver halide, a non-photosensitive organic silver salt, a reducing agent and a binder, wherein the photosensitive silver halide has a silver iodide content of 40 mol % or more, and the photothermographic material contains two or more kinds of the reducing agent at the mixing ratio to satisfy at least one of c) and d); c) a difference between a sensitivity when the photothermographic material has been developed at 117° C. for 12 sec and a sensitivity when the photothermographic material has been developed at 123° C. for 12 sec is 0.10 or less, wherein these sensitivities are expressed as a logarithm of a reciprocal of an exposure value; d) a difference between a maximum density when the photothermographic material has been developed at 117° C. for 12 sec and a maximum density when the photothermographic material has been developed at 123° C. for 12 sec is 0.10 or less.

A third aspect of the invention is to provide a method of forming an image using the photothermographic material according to the first or the second aspect, wherein the photothermographic material is developed at a temperature selected from a range of 100° C. to 140° C. for 12 sec or less.

DETAILED DESCRIPTION OF THE INVENTION

The present invention will be described in detail.

(Photothermographic Material)

The photothermographic material of the invention has an image forming layer comprising at least a photosensitive silver halide having a silver iodide content of 40 mol % or more, a non-photosensitive organic silver salt, a reducing agent and a binder on at least one surface of a support. The image forming layer may be a single layer or may be constituted by a plurality of layers. Further, the image forming layer may have disposed thereon an intermediate layer or a surface protective layer. A back layer, a back protective layer or the like may be disposed on an opposite surface of the photothermographic material.

It has been found that images having an always constant and desirable developed silver color tone are obtained by using the photothermographic material as described above which satisfies at least one of a), b), c) and d): a) a difference between a sensitivity when the photothermographic material has been developed at 120° C. for 10 sec and a sensitivity when the photothermographic material has been developed at 120° C. for 14 sec is 0.10 or less, wherein these sensitivities are expressed as a logarithm of a reciprocal of an exposure value; b) a difference between a maximum density when the photothermographic material has been developed at 120° C. for 10 sec and a maximum density when the photothermographic material has been developed at 120° C. for 14 sec is 0.10 or less; c) a difference between a sensitivity when the photothermographic material has been developed at 117° C. for 12 sec and a sensitivity when the photothermographic material has been developed at 123° C. for 12 sec is 0.10 or less, wherein these sensitivities are expressed as a logarithm of a reciprocal of an exposure value; d) a difference between a maximum density when the photothermographic material has been developed at 117° C. for 12 sec and a maximum density when the photothermographic material has been developed at 123° C. for 12 sec is 0.10 or less.

The term "stable" as used herein means that no difference in color tone among parts of a developed sheet is perceived, that no difference in color tone between a first and a last sheet is perceived when a lot of sheets are continuously processed, or that no difference in color tone due to a difference in developing time throughout one day is perceived.

The photothermographic material according to the invention preferably comprises a development accelerator, is preferably exposed by a laser beam, especially by a laser beam having a wavelength of 350 nm to 450 nm, whereby high effects of the invention can be obtained. The photothermographic material is preferably developed at a temperature in a range of 100° C. to 140° C. for 12 sec or less, and the photothermographic material is preferably developed at a line speed of 23 mm/sec or higher. As a result, higher effects of the invention can be obtained.

The constitutions and preferable components of the above-mentioned layers will be described in detail below.

(Organic Silver Salt)

1) Composition

The organic silver salt according to the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 962812A1, JP-A Nos. 11-349591, 2000-7683, and 2000-72711, and the like. A silver salt of organic acid, particularly, a silver salt of long chained fatty acid carboxylic acid (having 10 to 30 carbon atoms, preferably, having 15 to 28 carbon atoms) is preferable. Preferred examples of the silver salt of fatty acid can include, for example, silver lignocerate, silver behenate, silver arachidinate, silver stearate, silver oleate, silver laurate, silver capronate, silver myristate, silver palmitate, silver erucate and mixtures thereof. Among the silver salts of fatty acid, it is preferred to use a silver salt of fatty acid with the silver behenate content of 50 mol % or more, more preferably, 85 mol % or more, further preferably, 95 mol % or more. And, it is preferred to use a silver salt of fatty acid with the silver erucate content of 2 mol % or less, more preferably, 1 mol % or less, further preferably, 0.1 mol % or less.

It is preferred that the content of the silver stearate is 1 mol % or less. When the content of the silver stearate is 1 mol % or less, a silver salt of organic acid having low Dmin, high sensitivity and excellent image stability can be obtained. The content of the silver stearate above-mentioned, is preferably 0.5 mol % or less, more preferably, the silver stearate is not substantially contained.

Further, in the case the silver salt of organic acid includes silver arachidinic acid, it is preferred that the content of the silver arachidinic acid is 6 mol % or less in order to obtain a silver salt of organic acid having low Dmin and excellent image stability. The content of the silver arachidinate is more preferably 3 mol % or less.

2) Shape

There is no particular restriction on the shape of the organic silver salt usable in the invention and it may needle-like, bar-like, plate-like or flaky shape.

In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of more than 5. Particularly, a particle with the major axis to minor axis ratio of 3 or less is preferred since it can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)□ 1.5 as an average value x is defined as a flaky shape. The relation is preferably: 30□ x (average)□ 1.5 and, more preferably, 15□ x (average)□ 1.5. By the way, needle-like is expressed as 1□ x (average)<1.5.

In the flaky shaped particle, a can be regarded as a thickness of a plate particle having a main plate with b and c being as the sides. a in average is preferably 0.01 μm to 0.3 μm and, more preferably, 0.1 μm to 0.23 μm. c/b in average preferably 1 to 9, more preferably, 1 to 6 and, further preferably, 1 to 4 and, most preferably, 1 to 3.

By controlling the sphere equivalent diameter to 0.05 μm to 1 μm, it causes less agglomeration in the photosensitive material and image stability is improved. The spherical equivalent diameter is preferably 0.1 μm to 1 μm. In the invention, the sphere equivalent diameter can be measured by a method of photographing a sample directly by using an electron microscope and then image-processing negative images.

In the flaky shaped particle, the sphere equivalent diameter of the particle/a is defined as an aspect ratio. The aspect ratio of the flaky particle is, preferably, 1.1 to 30 and, more preferably, 1.1 to 15 with a viewpoint of causing less agglomeration in the photosensitive material and improving the image stability.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. For determination of such a value, a commercially available laserbeam scattering grain size analyzer can be used.

3) Preparing Method

Methods known in the art may be applied to the method for producing the organic silver salt used in the invention, and to the dispersion method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 200249117, 2002-31870 and 2002-107868.

When a photosensitive silver salt is present together during dispersion of the organic silver salt, fog increases and the sensitivity becomes remarkably lower, so that it is more preferred that the photosensitive silver salt is not substantially contained during dispersion. In the invention, the amount of the photosensitive silver salt to be disposed in the aqueous dispersion, is preferably, 1 mol % or less, more preferably, 0.1 mol % or less per one mol of the organic acid silver salt in the solution and, further preferably, positive addition of the photosensitive silver salt is not conducted.

In the invention, the photosensitive material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, in the range from 1 mol % to 30 mol %, more preferably, 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing are used preferably for controlling the photographic properties.

4) Addition Amount

While an organic silver salt in the invention can be used in a desired coating amount, a total amount of silver including silver halide is preferably in the range from 0.1 $g/m^2$ to 5.0 $g/m^2$ in terms of Ag and more preferably in the range from 0.3 $g/m^2$ to 3.0 $g/m^2$ in terms of Ag. An amount of an organic silver salt is particularly preferably in the range from 0.5 $g/m^2$ to 2.0 $g/m^2$ in terms of Ag. It is preferable that a coating amount of total silver preferably is 1.8 $g/m^2$ or less, more preferably 1.6 $g/m^2$ or less to improve the image stability. It is capable to obtain sufficient image density even with such lower silver coverage with proviso using a reducing agent distinguished in the present invention.

(Reducing Agent)

The photothermographic material of the invention preferably comprises a reducing agent for the organic silver salt.

The reducing agent may be any substance (preferably, organic substance) capable of reducing silver ions into metallic silver. Examples of the reducing agent are described in JP-A No. 11-65021 (column Nos. 0043 to 0045) and EP-A 0803764 A1 (p. 7, line 34 to p. 18, line 12).

In the invention, a so-called hindered phenolic reducing agent or a bisphenol agent having a substituent at the ortho-position to the phenolic hydroxyl group is preferred and the compound represented by the following formula (R) is more preferred.

Formula (R)

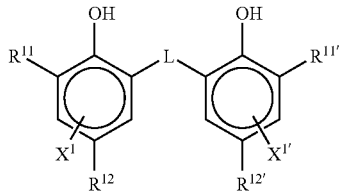

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents a —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Each of the substituents is to be described specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, uredo group, urethane group and halogen atom.

2) $R^{12}$ and $R^{12'}$, $X^1$ and $X^{1'}$ $R^{12}$ and $R^{12'}$ each independently represent a hydrogen atom or a group capable of substituting for a hydorgen atom on a benzene ring. $X^1$ and $X^{1'}$ each independently represent a hydrogen atom or a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

3) L

L represents a —S— group or a —$CHR^{13}$— group. $R^{13}$ represents a hydrogen atom or an alkyl group having 1 to 20 carbon atoms in which the alkyl group may have a substituent. Specific examples of the non-substituted alkyl group for $R^{13}$ can include, for example, methyl group, ethyl group, propyl group, butyl group, heptyl group, undecyl group, isopropyl group, 1-ethylpentyl group, and 2,4,4-trimethylpentyl group. Examples of the substituent for the alkyl group can include, like substituent $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

4) Preferred Substituents $R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represents, more preferably, tertiary alkyl group having 4 to 12 carbon atoms and, among them, t-butyl group, t-amyl group, 1-methylcyclohexyl group are further preferred, t-butyl group being most preferred.

$R^{12}$ and $R^{12'}$ are, preferably, alkyl groups having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are methyl group, ethyl group, propyl group, isopropyl group, and tbutyl group.

$X^1$ and $X^{1'}$ are, preferably, a hydrogen atom, halogen atom, or alkyl group, and more preferably, hydrogen atom.

L is preferably a group —$CHR^{13}$—.

$R^{13}$ is, preferably, a hydrogen atom or an alkyl group having 1 to 15 carbon atoms. The alkyl group is preferably methyl group, ethyl group, propyl group, isopropyl group and 2,4,4-trimethylpentyl group. Particularly preferred $R^{13}$ is a hydrogen atom, methyl group, propyl group or isopropyl group.

In a case where $R^{13}$ is a hydrogen atom, $R^{12}$ and $R^{12'}$ each represent, preferably, an alkyl group having 2 to 5 carbon atoms, ethyl group and propyl group being more preferred and ethyl group being most preferred.

In a case where $R^{13}$ is a primary or secondary alkyl group having 1 to 8 carbon atom, $R^{12}$ and $R^{12'}$ each represent preferably methyl group. As the primary or secondary alkyl group of 1 to 8 carbon atoms for $R^{13}$, methyl group, ethyl group, propyl group and isopropyl group are more preferred, and methyl group, ethyl group, and propyl group are further preferred.

In a case where each of $R^{11}$, $R^{11'}$ and $R^{12}$, $R_{12'}$ is methyl group, $R^{13}$ is preferably a secondary alkyl group. In this case, the secondary alkyl group for $R^{13}$ is preferably isopropyl group, isobutyl group and 1-ethylpentyl group, with isopropyl group being more preferred.

The reducing agent described above shows different thermal developing performances or developed-silver tones or the like depending on the combination of $R^{11}$, $R^{11'}$ and $R^{12}$, $R^{12'}$, as well as $R^{13}$. Since these performances can be controlled by using two or more kinds of reducing agents at various mixing ratios, it is preferred to use two or more kinds of reducing agents in combination depending on the purpose.

Specific examples of the reducing agents of the invention including the compounds represented by formula (R) according to the invention are shown below, but the invention is not restricted to them.

(R-1)

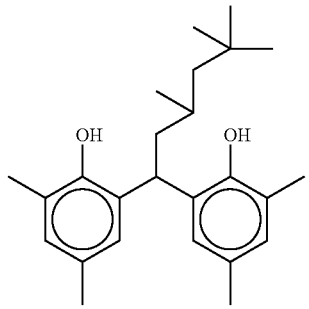

-continued
(R-2)
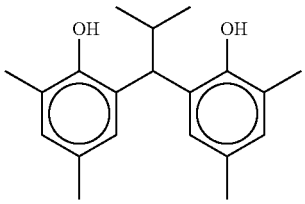
(R-3)
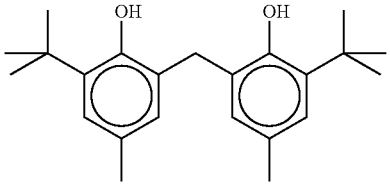
(R-4)
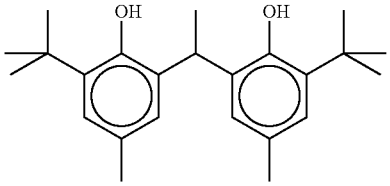
(R-5)
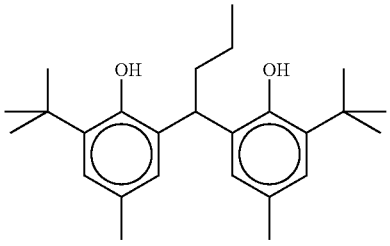
(R-6)
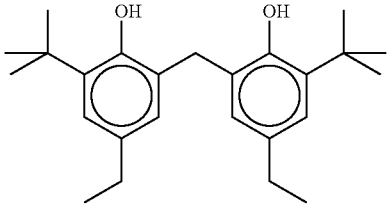
(R-7)
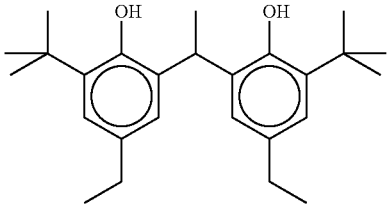
(R-8)
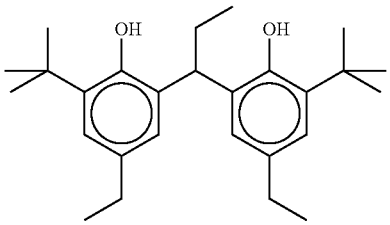
-continued
(R-9)
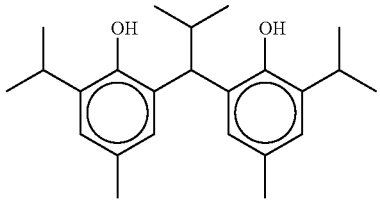
(R-10)
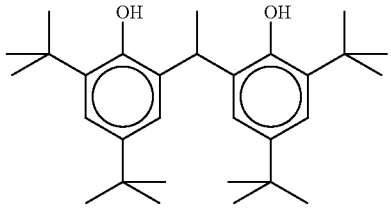
(R-11)
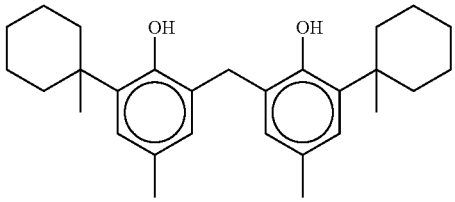
(R-12)
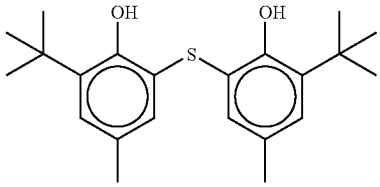
(R-13)
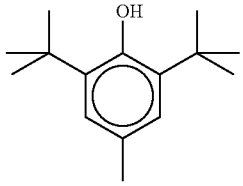
(R-14)
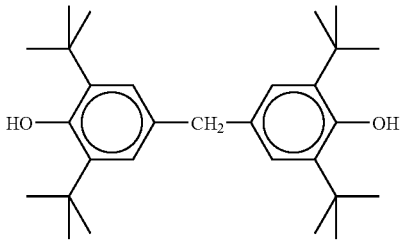
(R-15)
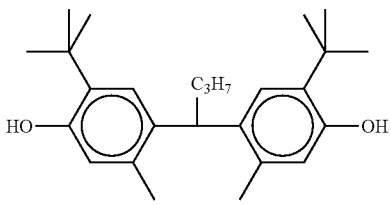

As preferred reducing agents of the invention other than those above, there can be mentioned compounds disclosed in JP-A Nos. 2001-188314, 2001-209145, 2001-350235, and 2002-156727.

In the invention, the addition amount of the reducing agent is, preferably, from 0.1 $g/m^2$ to 3.0 $g/m^2$, more preferably, 0.2 $g/m^2$ to 1.5 $g/m^2$ and, further preferably 0.3 $g/m^2$ to 1.0 $g/m^2$. It is, preferably, contained by 5 mol % to 50 mol %, more preferably, 8 mol % to 30 mol % and, further preferably, 10 mol % to 20 mol % per one mol of silver in the image forming layer. The reducing agent of the invention is preferably contained in the image forming layer.

In the invention, the reducing agent may be incorporated into photosensitive material by being added into the coating solution, such as in the form of a solution, an emulsion dispersion, a solid particle dispersion, and the like.

As a well known emulsion dispersion method, there can be mentioned a method comprising dissolving the reducing agent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range of from 1 ppm to 1000 ppm. It is practically acceptable so long as Zr is incorporated in an amount of 0.5 mg or less per 1 g of silver.

Preferably, a preservative (for instance, sodium benzoisothiazolinone salt) is added in the water dispersion.

In the invention, furthermore, the reducing agent is preferably used as solid dispersion, and is added in the form of fine particles having average particle size from 0.01 μm to 10 μm, and more preferably, from 0.05 μm to 5 μm and, further preferably, from 0.1 μm to 2 μm. In the invention, other solid dispersions are preferably used with this particle size range.

(Development Accelerator)

In the photothermographic material of the invention, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in the range from 0.1 mol % to 20 mol %, preferably, in the range from 0.5 mol % to 10 mol % and, more preferably, in the range from 1 mol % to 5 mol % with respect to the reducing agent. The introduction methods to the photothermographic material can include, the same methods as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use as a development accelerator, hydrazine compounds represented by formula (D) described in the specification of JP-A No. 2002-156727, and phenolic or naphtholic compounds represented by formula (2) described in the specification of JP-A No. 2001-264929.

Particularly preferred development accelerators of the invention are compounds represented by the following formulae (A-1) and (A-2). Formula (A-1)

$$Q_1\text{-NHNH-}Q_2$$

(wherein, $Q_1$ represents an aromatic group or a heterocyclic group coupling at a carbon atom to —NHNH-$Q_2$ and $Q_2$ represents a carbamoyl group, an acyl group, an alkoxycarbonyl group, an aryloxycarbonyl group, a sulfonyl group or a sulfamoyl group).

In formula (A-1), the aromatic group or the heterocyclic group represented by $Q_1$ is, preferably, 5 to 7 membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituents, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q^2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbaoyl, N-3-pyridylcarbamoyl and N-benzylcarbamoyl.

The acyl group represented by $Q_2$ is an acyl group, preferably, having 1 to 50 carbon atoms and, more preferably, 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably having 0 to 50 carbon atoms, more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Then, preferred range for the compounds represented by formula (A-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

Formula (A-2)

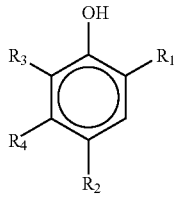

In formula (A-2), $R_1$ represents an alkyl group, an acyl group, an acylamino group, a sulfoneamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group or a carbonate ester group. $R_3$, $R_4$ each represents a group capable of substituting for a hydrpgen atom on a benzene ring which is mentioned as the example of the substituent for formula (A-1). $R_3$ and $R_4$ may bond together to form a condensed ring.

$R_1$ is, preferably, an alkyl group having 1 to 20 carbon atoms (for example, methyl group, ethyl group, isopropyl group, butyl group, tert-octyl group, or cyclohexyl group), an acylamino group (for example, acetylamino group, benzoylamino group, methylureido group, or 4-cyanophenylureido group), a carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group), an acylamino group (including ureido group or urethane group) being more preferred. $R_2$ is, preferably, a halogen atom (more preferably, chlorine atom, bromine atom), an alkoxy group (for example, methoxy group, butoxy group, n-hexyloxy group, n-decyloxy group, cyclohexyloxy group or benzyloxy group), or an aryloxy group (phenoxy group or naphthoxy group).

$R_3$ preferably is a hydrogen atom, a halogen atom or an alkyl group having 1 to 20 carbon atoms, and most preferably a halogen atom. $R_4$ is preferably a hydrogen atom, alkyl group or an acylamino group, and more preferably an alkyl group or an acylamino group. Examples of the preferred substituent thereof are identical with those for $R_1$. In a case where $R_4$ is an acylamino group, $R_4$ may preferably bond with $R_3$ to form a carbostyryl ring.

In a case where $R_3$ and $R_4$ in formula (A-2) bond together to form a condensed ring, a naphthalene ring is particularly preferred as the condensed ring. The same substituent as the example of the substituent referred to for formula (A-1) may bond to the naphthalene ring. In a case where formula (A-2) is a naphtholic compound, $R_1$, is, preferably, a carbamoyl group. Among them, benzoyl group is particularly preferred. $R_2$ is, preferably, an alkoxy group or an aryloxy group and, particularly, preferably an alkoxy group.

Preferred specific examples for the development accelerator of the invention are to be described below. The invention is not restricted to them.

(A-1)

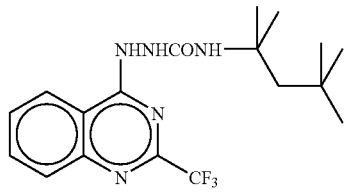

(A-2)

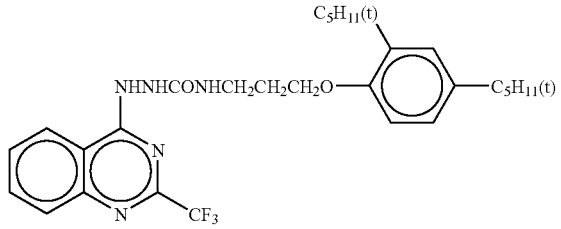

(A-3)

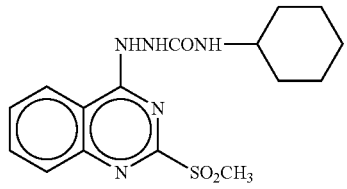

-continued (A-4)

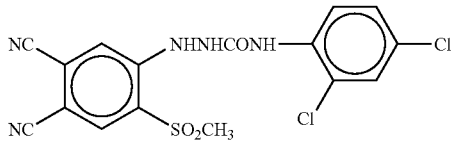

(A-5)

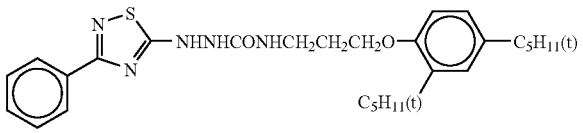

(A-6)

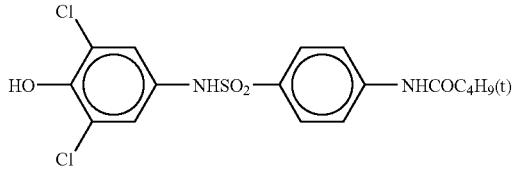

(A-7)

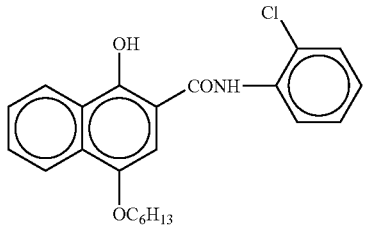

(A-8)

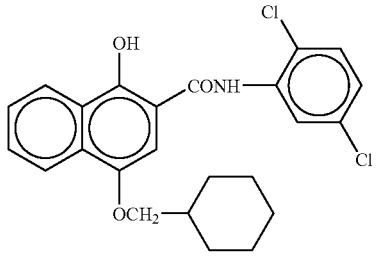

(A-9)

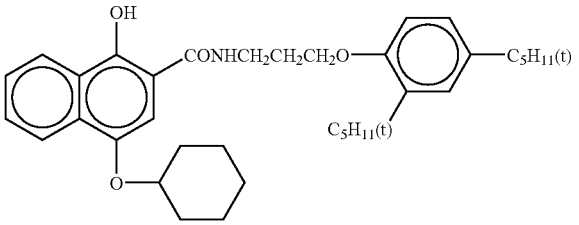

(A-10)

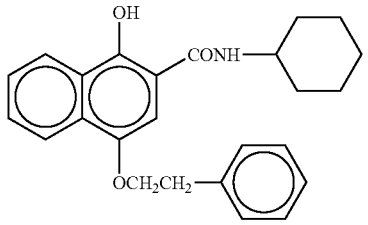

-continued (A-11)

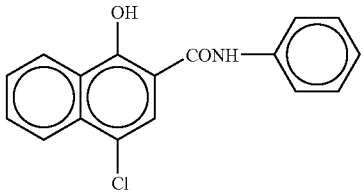

(A-12)

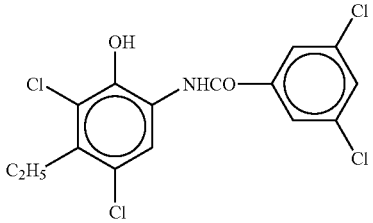

(Hydrogen Bonding Compound)

In the invention, in the case that the reducing agent has an aromatic hydroxyl group (—OH) or an amino group, particularly in the case that the reducing agent is a bisphenol described above, it is preferred to use in combination, a non-reducing compound having a group capable of reacting with these groups of the reducing agent, and that is also capable of forming a hydrogen bond therewith. As a group forming a hydrogen bond with a hydroxyl group or an amino group, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

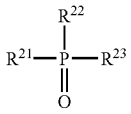

In formula (D), $R^{21}$ to $R^{23}$ each independently represent an alkyl group, an aryl group, an alkoxy group, an aryloxy group, an amino group, or a heterocyclic group, which may be substituted or not substituted. In the case $R^{21}$ to $R^{23}$ contain a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, tbutyl group, t-amyl group, t-octyl group, cyclohexyl group, 1-methylcyclohexyl group, benzyl group, phenetyl group, 2-phenoxypropyl group, and the like. As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like. As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like. As aryloxy groups, there can be mentioned phenoxy group, cresyloxy group, isopropylphenoxy group, 4-t-butylphenoxy group, naphthoxy group, biphenyloxy group, and the like. As amino groups, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

(D-1)

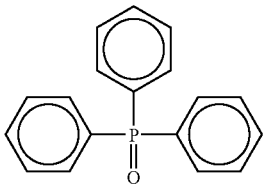

(D-2)

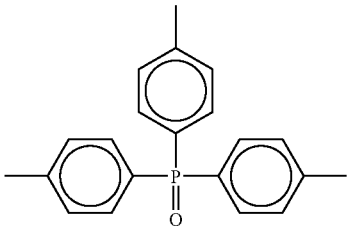

(D-3)

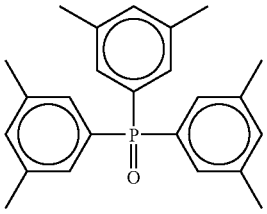

-continued (D-4)

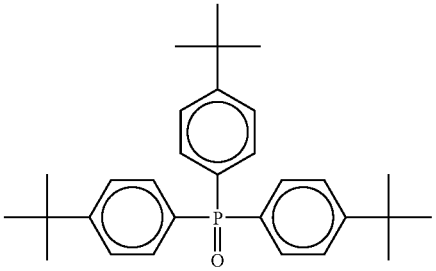

(D-5)

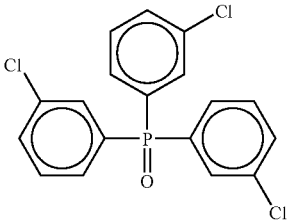

(D-6)

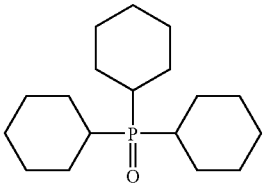

(D-7)

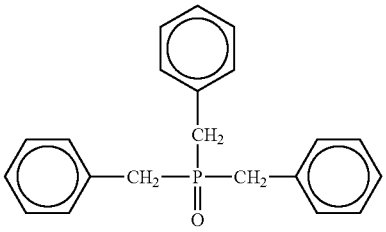

(D-8)

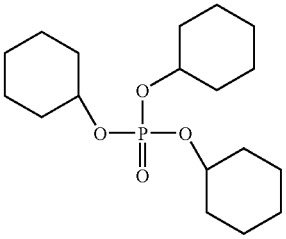

(D-9)

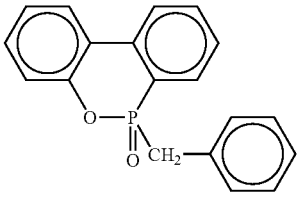

(D-10)

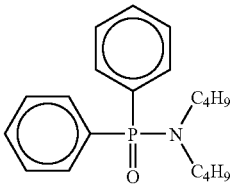

-continued (D-11)

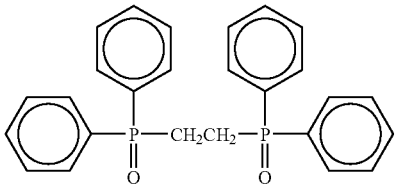

(D-12)

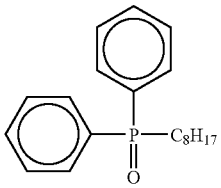

(D-13)

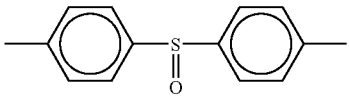

(D-14)

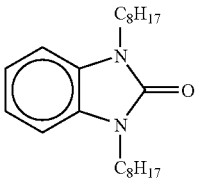

(D-15)

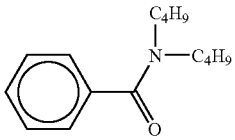

Specific examples of hydrogen bonding compounds other than those enumerated above can be found in those described in EP No. 1096310 and in JP-A Nos. 2002-156727 and 2002-318431.

The compound expressed by formula (D) used in the invention can be used in the photosensitive material by being incorporated into the coating solution in the form of solution, emulsion dispersion, or solid fine particle dispersion similar to the case of reducing agent, however, it is preferred to be used in the form of solid dispersion. In the solution, the compound expressed by formula (D) forms a hydrogen-bonded complex with a compound having a phenolic hydroxyl group or an amino group, and can be isolated as a complex in crystalline state depending on the combination of the reducing agent and the compound expressed by formula (D). It is particularly preferred to use the crystal powder thus isolated in the form of a solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill and the like.

The compound expressed by formula (D) is preferably used in the range of from 1 mol % to 200 mol %, more preferably from 10 mol % to 150 mol %, and further preferably, from 20 mol % to 100 mol %, with respect to the reducing agent.

(Silver Halide)

1) Halogen Composition

The photosensitive silver halide in the present invention has a silver iodide content of 40 mol % or more, more preferably 80 mol % or more, and particularly preferably 90 mol % or more. Components other than silver iodide are not particularly limited and can be selected from silver chloride and silver bromide and organic silver salts such as silver thiocyanate, silver phosphate and the like, and particularly, silver bromide and silver chloride are preferable.

The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. A core-high-silver iodide-structure which has a high content of silver iodide in the core part, and a shell-high-silver iodide-structure which has a high content of silver iodide in the shell part can also be preferably used. Further, a technique of localizing silver bromide or silver iodide on the surface of a grain can also be preferably used.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Average Grain Size

There is no particular restriction on the grain size of the photosensitive silver halide, and grains of various sizes can be used depending on the purpose. Particularly in the invention, because a light absorption which results from silver halide decreases after thermal development, grains having bigger size than conventionally used size can be used.

To be specific, grains having the size of 5.0 μm or less can be used. The grain size preferably is 0.001 μm to 5.0 μm, more preferably, 0.01 μm to 3.0 μm and, further preferably, 0.01 μm to 0.8 μm. The grain size as used herein means an average diameter of a circle converted such that it has a same area as a projection area of the silver halide grain (projection area of a main plane in a case of a tabular grain).

4) Grain Shape

The shape of the silver halide grain can include, for example, cubic, octahedral, plate-like, spherical, rod-like or potato-like shape. The cubic grain is particularly preferred in the invention. A silver halide grain rounded at corners can also be used preferably. While there is no particular restriction on the index of plane (Mirror's index) of an crystal surface of the photosensitive silver halide grain, it is preferred that the ratio of [100] face is higher, in which the spectral sensitizing efficiency is higher in a case of adsorption of a spectral sensitizing dye. The ratio is preferably 50% or more, more preferably, 65% or more and, further preferably, 80% or more. The ratio of the Mirror's index [100] face can be determined by the method of utilizing the adsorption dependency of [111] face and [100] face upon adsorption of a sensitizing dye described by T. Tani; in J. Imaging Sci., 29, 165 (1985).

5) Heavy Metal

The photosensitive silver halide grain of the invention can contain metals or complexes of metals belonging to groups 8 to 10 of the periodic table (showing groups 1 to 18). The metal or the center metal of the metal complex from groups 8 to 10 of the periodic table is preferably rhodium, ruthenium or iridium. The metal complex may be used alone, or two or more kinds of complexes comprising identical or different species of metals may be used together. A preferred content is in the range from $1\times10^{-9}$ mol to $1\times10^{-3}$ mol per one mol of silver. The heavy metals, metal complexes and the addition method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per one mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion forming step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion forming step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitization method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. And phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the addition method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. In the invention, sensitizing dye can be added preferably after desalting step and before coating step, and more preferably after desalting step and before the completion of chemical ripening.

In the invention, the sensitizing dye may be added at any amount according to the property of photosensitivity and fogging, but it is preferably added from $10^{-6}$ mol to 1 mol, and more preferably, from $10^{-4}$ mol to $10^{-1}$ mol per one mol of silver in each case.

The photothermographic material of the invention may also contain super sensitizers in order to improve spectral sensitizing effect. The super sensitizers usable in the invention can include those compounds described in EP-A No. 587,338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitization method, selenium sensitization method or tellurium sensitization method. As the compound used preferably for sulfur sensitization method, selenium sensitization method and tellurium sensitization method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are more preferred.

The photosensitive silver halide grain in the invention is preferably chemically sensitized by gold sensitization method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per one mol of the silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ mol per one mol of the silver halide.

There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

9) Compound That can be One-Electron-Oxidized to Provide a One-Electron Oxidation Product which Releases One or More Electrons The photothermographic material of the invention preferably contains a compound that can be one-electron-oxidized to provide a one-electron oxidation product which releases one or more electrons. The said compound can be used in combination with various chemical sensitizers described above to increase the sensitivity of silver halide.

As the compound that can be one-electron-oxidized to provide a one-electron oxidation product which releases one or more electrons is a compound selected from the following Groups 1 to 5.

(Group 1) a compound that can be one-electron-oxidized to provide a one-electron oxidation product which further releases at least two electrons, due to being subjected to a subsequent bond cleavage reaction;

(Group 2) a compound that has at least two groups adsorptive to the silver halide and can be one-electron-oxidized to provide a one-electron oxidation product which further releases one electron, due to being subjected to a subsequent bond cleavage reaction;

(Group 3) a compound that can be one-electron-oxidized to provide a one-electron oxidation product, which further releases at least one electron after being subjected to a subsequent bond formation;

(Group 4) a compound that can be one-electron-oxidized to provide a one-electron oxidation product which further releases at least one electron after a subsequent intramolecular ring cleavage reaction; and (Group 5) a compound represented by X-Y, in which X represents a reducible group and Y represents a leaving group, and convertable by one-electron-oxidizing the reducible group to a one-electron oxidation product which can be converted into an X radical by eliminating the leaving group in a subsequent X-Y bond cleavage reaction, one electron being released from the X radical.

Each compound of Group 1 and Groups 3 to 5 preferably is a "compound having a sensitizing dye moiety" or a "compound having an adsorptive group to the silver halide". More preferred is a "compound having an adsorptive group to the silver halide". Each compound of Groups 1 to 4 more preferably is a "compound having a heterocyclic group containing nitrogen atoms substituted by two or more mercapto groups".

The compound of Groups 1 to 5 will be described in detail below.

In the compound of Group 1, the term "the bond cleavage reaction" specifically means a cleavage reaction of a bond of carbon-carbon, carbon-silicon, carbon-hydrogen, carbon-boron, carbon-tin or carbon-germanium. Cleavage of a carbon-hydrogen bond may be followed after the cleavage reaction. The compound of Group 1 can be one-electron-oxidized to be converted into the one-electron oxidation product, and thereafter can release further two or more electrons, preferably three or more electrons with the bond cleavage reaction.

The compound of Group 1 is preferably represented by any one of formulae (A), (B), (1), (2) and (3).

Formula (A)

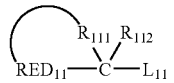

Formula (1)

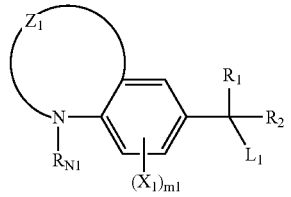

Formula (2)

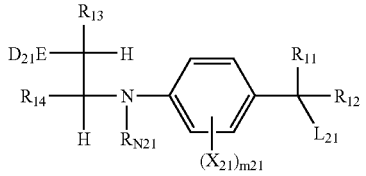

-continued

Formula (B)

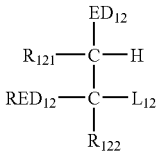

Formula (3)

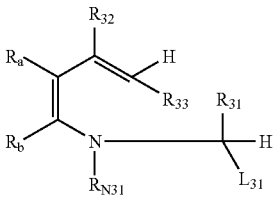

In formula (A), $RED_{11}$ represents a reducible group that can be one-electron-oxidized, and $L_{11}$ represents a leaving group. $R_{112}$ represents a hydrogen atom or a substituent. $R_{111}$ represents a nonmetallic atomic group forming a tetrahydro-, hexahydro- or octahydro-derivative of a 5- or 6-membered aromatic ring including aromatic heterocycles.

In formula (B), $RED_{12}$ represents a reducible group that can be one-electron-oxidized, and $L_{12}$ represents a leaving group. $R_{121}$ and $R_{122}$ each represent a hydrogen atom or a substituent. $ED_{12}$ represents an electron-donating group. In formula (B), $R_{12}$, and $RED_{12}$, $R_{121}$ and $R_{122}$, and $ED_{12}$ and $RED_{12}$ may bond together to form a ring structure, respectively.

In the compound represented by formula (A) or (B), the reducible group of $RED_{11}$ or $RED_{12}$ is one-electron-oxidized, and thereafter the leaving group of $L_{11}$ or $L_{12}$ is spontaneously eliminated in the bond cleavage reaction. Further two or more, preferably three or more electrons can be released with the bond cleavage reaction.

In formula (1), $Z_1$ represents an atomic group forming a 6-membered ring with a nitrogen atom and 2 carbon atoms in a benzene ring; $R_1$, $R_2$ and $R_{N1}$ each represent a hydrogen atom or a substituent; $X_1$ represents a substituent capable of substituting for a hydrogen atom on a benzene ring; $m_1$ represents an integer from 0 to 3; and $L_1$ represents a leaving group. In formula (2), $ED_{21}$ represents an electron-donating group; $R_{11}$, $R_{12}$, $R_{N21}$, $R_{13}$ and $R_{14}$ each represent a hydrogen atom or a substituent; $X_{21}$, represents a substituent capable of substituting for a hydrogen atom on a benzene ring; $m_{21}$, represents an integer from 0 to 3; and $L_{21}$ represents a leaving group. $R_{N21}$, $R_{13}$, $R_{14}$, $X_{21}$ and $ED_{21}$ may bond to each other to form a ring structure. In formula (3), $R_{32}$, $R_{33}$, $R_{31}$, $R_{N31}$, $R_a$ and $R_b$ each represent a hydrogen atom or a substituent; and $L_{31}$ represents a leaving group. Incidentally, $R_a$ and $R_b$ bond together to form an aromatic ring when $R_{N31}$ is not an aryl group.

After the compound is one-electron-oxidized, the leaving group of $L_1$, $L_{21}$ or $L_{31}$ is spontaneously eliminated in the bond cleavage reaction. Further two or more, preferably three or more electrons can be released with the bond cleavage reaction.

First, the compound represented by formula (A) will be described in detail below.

In formula (A), the reducible group of $RED_{11}$ can be one-electron-oxidized and can bond to after-mentioned $R_{111}$ to form the particular ring structure. Specifically, the reducible group may be a divalent group provided by removing one hydrogen atom from the following monovalent group at a position suitable for ring formation.

The monovalent group may be an alkylamino group; an arylamino group such as an anilino group and a naphthylamino group; a heterocyclic amino group such as a benzthiazolylamino group and a pyrrolylamino group; an alkylthio group; an arylthio group such as a phenylthio group; a heterocyclic thio group; an alkoxy group; an aryloxy group such as a phenoxy group; a heterocyclic oxy group; an aryl group such as a phenyl group, a naphthyl group and an anthranil group; or an aromatic or nonaromatic heterocyclic group, containing at least one heteroatom selected from the group consisting of a nitrogen atom, a sulfur atom, an oxygen atom and a selenium atom, which has a 5- to 7-membered, monocyclic or condensed ring structure such as a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring. $RED_{11}$ is hereinafter described as the monovalent group for convenience. The monovalent groups may have a substituent.

Examples of the substituent include halogen atoms; alkyl groups including aralkyl groups, cycloalkyl groups, active methine groups, etc.; alkenyl groups; alkynyl groups; aryl groups; heterocyclic groups, which may bond at any position; heterocyclic groups containing a quaternary nitrogen atom such as a pyridinio group, an imidazolio group, a quinolinio group and an isoquinolinio group; acyl groups; alkoxycarbonyl groups; aryloxycarbonyl groups; carbamoyl groups; a carboxy group and salts thereof; sulfonylcarbamoyl groups; acylcarbamoyl groups; sulfamoylcarbamoyl groups; carbazoyl groups; oxalyl groups; oxamoyl groups; a cyano group; carbonimidoyl groups; thiocarbamoyl groups; a hydroxy group; alkoxy groups, which may contain a plurality of ethyleneoxy groups or propyleneoxy groups as a repetition unit; aryloxy groups; heterocyclic oxy groups; acyloxy groups; alkoxy or aryloxy carbonyloxy groups; carbamoyloxy groups; sulfonyloxy groups; amino groups; alkyl, aryl or heterocyclic amino groups; acylamino groups; sulfoneamide groups; ureide groups; thioureide groups; imide groups; alkoxy or aryloxy carbonylamino groups; sulfamoylamino groups; semicarbazide groups; thiosemicarbazide groups; hydrazino groups; ammonio groups; oxamoylamino groups; alkyl or aryl sulfonylureide groups; acylureide groups; acylsulfamoylamino groups; a nitro group; a mercapto group; alkyl, aryl or heterocyclic thio groups; alkyl or aryl sulfonyl groups; alkyl or aryl sulfinyl groups; a sulfo group and salts thereof; sulfamoyl groups; acylsulfamoyl groups; sulfonylsulfamoyl groups and salts thereof; groups containing a phosphoric amide or phosphate ester structure; etc. These substituents may be further substituted by these substituents.

$RED_{11}$ is preferably an alkylamino group, an arylamino group, a heterocyclic amino group, an aryl group, an aromatic heterocyclic group, or nonaromatic heterocyclic group. $RED_{11}$ is more preferably an arylamino group (particularly an anilino group), or an aryl group (particularly a phenyl group). When $RED_{11}$ has a substituent, preferred as a substituent include halogen atoms, alkyl groups, alkoxy groups, carbamoyl groups, sulfamoyl groups, acylamino groups, sulfoneamide groups.

When $RED_{11}$ is an aryl group, it is preferred that the aryl group has at least one "electron-donating group". The "electron-donating group" is a hydroxy group; an alkoxy group; a mercapto group; a sulfoneamide group; an acylamino group; an alkylamino group; an arylamino group; a heterocyclic amino group; an active methine group; an electron-excess, aromatic, heterocyclic group with a 5-membered monocyclic ring or a condensed-ring including at least one nitrogen atom in the ring such as an indolyl group, a pyrrolyl group, an imidazolyl group, a benzimidazolyl group, a thiazolyl group, a benzthiazolyl group and an indazolyl group; a nitrogen-containing, nonaromatic heterocyclic group that substitutes at the nitrogen atom, such as so-called cyclic amino group like pyrrolidinyl group, an indolinyl group, a piperidinyl group, a piperazinyl group and a morpholino group; etc. The active methine group is a methine group having two "electron-attracting groups", and the "electron-attracting group" is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron-attracting groups may bond together to form a ring structure.

In formula (A), specific examples of $L_{11}$ include a carboxy group and salts thereof, silyl groups, a hydrogen atom, triarylboron anions, trialkylstannyl groups, trialkylgermyl groups and a $—CR_{C1}R_{C2}R_{C3}$ group. When $L_{11}$ represents a silyl group, the silyl group is specifically a trialkylsilyl group, an aryldialkylsilyl group, a triarylsilyl group, etc, and they may have a substituent.

When $L_{11}$ represents a salt of a carboxy group, specific examples of a counter ion to form the salt include alkaline metal ions, alkaline earth metal ions, heavy metal ions, ammonium ions, phosphonium ions, etc. Preferred as a counter ion are alkaline metal ions and ammonium ions, most preferred are alkaline metal ions such as $Li^+$, $Na^+$ and $K^+$.

When $L_{11}$ represents a $—CR_{C1}R_{C2}R_{C3}$ group, $R_{C1}$, $R_{C2}$ and $R_{C3}$ independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxy group. $R_{C1}$, $R_{C2}$ and $R_{C3}$ may bond to each other to form a ring structure, and may have a substituent. Incidentally, when one of $R_{C1}$, $R_{C2}$ and $R_{C3}$ is a hydrogen atom or an alkyl group, there is no case where the other two of them are a hydrogen atom or an alkyl group. $R_{C1}$, $R_{C2}$ and $R_{C3}$ are preferably an alkyl group, an aryl group (particularly a phenyl group), an alkylthio group, an arylthio group, an alkylamino group, an arylamino group, a heterocyclic group, an alkoxy group or a hydroxy group, respectively. Specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, a hydroxy group, etc. Examples of the ring structure formed by $R_{C1}$, $R_{C2}$ and $R_{C3}$ include a 1,3-dithiolane-2-yl group, a 1,3-dithiane-2-yl group, an N-methyl-1,3-thiazolidine-2-yl group, an N-benzyl-benzothiazolidine-2-yl group, etc.

It is also preferred that the $—CR_{C1}R_{C2}R_{C3}$ group is the same as a residue provided by removing $L_{11}$ from formula (A) as a result of selecting each of $R_{C1}$, $R_{C2}$ and $R_{C3}$ as above.

In formula (A), $L_{11}$ is preferably a carboxy group or a salt thereof, or a hydrogen atom, more preferably a carboxy group or a salt thereof.

When $L_{11}$ represents a hydrogen atom, the compound represented by formula (A) preferably has a base moiety. After the compound represented by formula (A) is oxidized, the base moiety acts to eliminate the hydrogen atom of $L_{11}$ and to release an electron.

The base is specifically a conjugate base of an acid with a pKa value of approximately 1 to 10. For example, the base moiety may contain a structure of a nitrogen-containing heterocycle such as pyridine, imidazole, benzoimidazole and thiazole; aniline; trialkylamine; an amino group; a carbon acid such as an active methylene anion; a thioacetic acid anion; carboxylate ($—COO^-$); sulfate ($—SO_3^-$); amineoxide ($>N^+(O^-)—$); and derivatives thereof. The base is preferably a conjugate base of an acid with a pKa value of approximately 1 to 8, more preferably carboxylate, sulfate or amineoxide, particularly preferably carboxylate. When these bases have an anion, the compound of formula (A) may have a counter cation. Examples of the counter cation include alkaline metal ions, alkaline earth metal ions, heavy metal ions, ammonium ions, phosphonium ions, etc. The base moiety may be at an optional position of the compound represented by formula (A). The base moiety may be connected to $RED_{11}$, $R_{111}$ or $R_{112}$ in formula (A), and to a substituent thereon.

In formula (A), $R_{112}$ represents a substituent capable of substituting a hydrogen atom or a carbon atom therewith, provided that $R_{112}$ and $L_{11}$ do not represent the same group.

$R_{112}$ preferably represents a hydrogen atom, an alkyl group, an aryl group (such as a phenyl group), an alkoxy group (such as a methoxy group, a ethoxy group, a benzyloxy group), a hydroxy group, an alkylthio group, (such as a methylthio group, a butylthio group), and amino group, an alkylamino group, an arylamino group, a heterocyclic amino group or the like; and more preferably represents a hydrogen atom, an alkyl group, an alkoxy group, a hydroxy group, a phenyl group and an alkylamino group.

Ring structures formed by $R_{111}$ in formula (A) are ring structures corresponding to a tetrahydro structure, a hexahydro structure, or an octahydro structure of a five-membered or six-membered aromatic ring (including an aromatic hetro ring), wherein a hydro structure means a ring structure in which partial hydrogenation is performed on a carbon-carbon double bond (or a carbon-nitrogen double bond) contained in an aromatic ring (an aromatic hetero ring) as a part thereof, wherein the tetrahydro structure is a structure in which 2 carbon-carbon double bonds (or carbon-nitrogen double bonds) are hydrogenated, the hexahydro structure is a structure in which 3 carbon-carbon double bonds (or carbon-nitrogen double bonds) are hydrogenated, and the octahydro structure is a structure in which 4 carbon-carbon double bonds (or carbon-nitrogen double bonds) are hydrogenated. Hydrogenation of an aromatic ring produces a partially hydrogenated non-aromatic ring structure.

Examples include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperazine ring, a tetralin ring, a tetrahydroquinoline ring, a tetrahydroisoquinoline ring, a tetrahydroquinazoline ring and a tetrahydroquinoxaline ring, a tetrahydrocarbazole ring, an octahydrophenanthridine ring and the like. The ring structures may have a substituent therein.

More preferable examples of a ring structure forming $R_{111}$ include a pyrrolidine ring, an imidazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring and a tetracarbazole ring. Particularly preferable examples include a pyrrolidine ring, a piperidine ring, a piperazine ring, a tetrahydropyridine ring, a tetrahydroquinoline ring, a tetrahydroisoquinoline ring, a tetrahydroquinazoline ring and a tetrahydroquinoxaline ring; and most preferable examples include a pyrrolidine ring, a piperidine ring, a tetrahydropyridine ring, a tetrahydroquinoline ring and a tetrahydroisoquinoline ring.

In formula (B), $RED_{12}$ and $L_{12}$ represent groups having the respective same meanings as $RED_{11}$ and $L_{11}$ in formula (A), and have the respective same preferable ranges as $RED_{11}$ and $L_{11}$ in formula (A). $RED_{12}$ is a monovalent group except a case where $RED_{12}$ forms the following ring structure and to be concrete, there are exemplified groups each with a name of a monovalent group described as $RED_{11}$. $RED_{121}$, and $L_{122}$ represent groups having the same meaning as $R_{112}$ in formula (A), and have the same preferable range as $R_{112}$ in formula (A). $ED_{12}$ represents an electron-donating group. Each pair of $R_{121}$ and $RED_{12}$; $R_{121}$ and $R_{122}$; or $ED_{12}$ and $RED_{12}$ may form a ring structure by bonding with each other.

An electron-donating group represented by $RED_{12}$ in formula (B) is the same as an electron-donating group described as a substituent when $RED_{11}$ represents an aryl group. Preferable examples of $RED_{12}$ include a hydroxy group, an alkoxy group, a mercapto group, a sulfonamide group, an alkylamino group, an arylamino group, an active methine group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute, and a phenyl group substituted with an electron donating group described above, and more preferable examples thereof include a non-aromatic nitrogen containing heterocyclic group further substituted with a hydroxy group, a mercapto group, a sulfonamide group, an alkylamino group, an arylamino group, an active methine group, or a nitrogen atom; and a phenyl group substituted with an electron-donating group described above (for example, a p-hydroxyphenyl group, a p-dialkylaminophenyl group, an o- or p-dialkoxyphenyl group and the like).

In formula (B), $R_{121}$ and $RED_{12}$; $R_{122}$ and $R_{121}$; or $ED_{12}$ and $RED_{12}$ may bond to each other to form a ring structure. A ring structure formed here is a non-aromatic carbon ring or hetero ring in a 5- to 7-membered single ring or fused ring structure which is substituted or unsubstituted. Concrete examples of a ring structure formed from $R_{121}$ and $RED_{12}$ include, in addition to the examples of the ring structure formed by $R_{111}$ in formula (A), a pyrroline ring, an imidazoline ring, a thiazoline ring, a pyrazoline ring, an oxazoline ring, an indan ring, a morphorine ring, an indoline ring, a tetrahydro-1,4-oxazine ring, 2,3-dihydrobenzo-1,4-oxazine ring, a tetrahydro-1,4-thiazine ring, 2,3-dihydrobenzo-1,4-thiazine ring, 2,3-dihydrobenzofuran ring, 2,3-dihydrobenzothiophene ring and the like. In formation of a ring structure from $ED_{12}$ and $RED_{12}$, $ED_{12}$ is preferably an amino group, an alkylamino group or an arylamino group and concrete examples of the ring structure include a tetrahyropyrazine ring, a piperazine ring, a tetrahydroquinoxaline ring, a tetrahydroisoquinoline ring and the like. Concrete examples of a ring structure formed from $R_{122}$ and $R_{121}$ include a cyclohexane ring, a cyclopentane ring and the like.

Description of formulae (1) to (3) will be given below.

In formulae (1) to (3), $R_1$, $R_2$, $R_{11}$, $R_{12}$ and $R_{31}$ represent the same meaning as $R_{112}$ of formula (A) and have the same preferable range as $R_{112}$ of formula (A). $L_1$, $L_{21}$ and $L_{31}$ independently represents the same leaving groups as the groups shown as concrete examples in description of $L_{11}$ of formula (A) and also have the same preferable range as $L_{11}$ of formula (A). The substituents represented by $X_1$ and $X_{21}$ are the same as the examples of substituents of $RED_{11}$ of formula (A) and have the same preferable range as $RED_{11}$ of formula (A). $m_1$ and $m_2$ are preferably integers from 0 to 2 and more preferably integer of 0 or 1.

When $R_{N1}$, $R_{N21}$ and $R_{N31}$ each represent a substituent, preferred as a substituent include an alkyl group, an aryl group or a heterocyclic group, and may further have a substituent. Each of $R_{N1}$, $R_{N21}$, and $R_{N31}$ is preferably a hydrogen atom, an alkyl group or an aryl group, more preferably a hydrogen atom or an alkyl group.

When $R_{13}$, $R_{14}$, $R_{32}$, $R_{33}$, $R_a$ and $R_b$ independently represent a substituent, the substituent is preferably an alkyl group, an aryl group, an acyl group, an alkoxycarbonyl group, a carbamoyl group, a cyano group, an alkoxy group, an acylamino group, a sulfoneamide group, a ureide group, a thiouredide group, an alkylthio group, an arylthio group, an alkylsulfonyl group, an arylsulfonyl group, or a sulfamoyl group.

The 6-membered ring formed by $Z_1$ in formula (1) is a nonaromatic heterocycle condensed with the benzene ring in formula (1). The ring structure containing the nonaromatic heterocycle and the benzene ring to be condensed may be specifically a tetrahydroquinoline ring, a tetrahydroquinoxaline ring, or a tetrahydroquinazoline ring, which may have a substituent.

In formula (2), $ED_{21}$ is the same as $ED_{12}$ in formula (B) with respect to the meanings and preferred embodiments.

In formula (2), any two of $R_{N21}$, $R_{13}$, $R_{14}$, $X_{21}$ and $ED_{21}$ may bond together to form a ring structure. The ring structure formed by $R_{N21}$ and $X_{21}$ is preferably a 5- to 7-membered, carbocyclic or heterocyclic, nonaromatic ring structure condensed with a benzene ring, and specific examples thereof include a tetrahydroquinoline ring, a tetrahydroquinoxaline ring, an indoline ring, a 2,3-dihydro-5,6-benzo-1,4-thiazine ring, etc. Preferred are a tetrahydroquinoline ring, a tetrahydroquinoxaline ring and an indoline ring.

When $R_{N31}$ is a group other than an aryl group in formula (3), $R_a$ and $R_b$ bond together to form an aromatic ring. The aromatic ring is an aryl group such as a phenyl group and a naphthyl group, or an aromatic heterocyclic group such as a pyridine ring group, a pyrrole ring group, a quinoline ring group and an indole ring group, preferably an aryl group. The aromatic ring group may have a substituent.

In formula (3), $R_a$ and $R_b$ preferably bond together to form an aromatic ring, particularly a phenyl group.

In formula (3), $R_{32}$ is preferably a hydrogen atom, an alkyl group, an aryl group, a hydroxy group, an alkoxy group, a mercapto group or an amino group. When $R_{32}$ is a hydroxy group, $R_{33}$ is preferably an electron-attracting group. The electron-attracting group is the same as described above, preferably an acyl group, an alkoxycarbonyl group, a carbamoyl group or a cyano group.

The compound of Group 2 will be described below.

According to the compound of Group 2, the "bond cleavage reaction" is a cleavage reaction of a bond of carbon-carbon, carbon-silicon, carbon-hydrogen, carbon-boron, carbon-tin or carbon-germanium. Cleavage of a carbon-hydrogen bond may be caused with the cleavage reaction.

The compound of Group 2 has two or more, preferably 2 to 6, more preferably 2 to 4, adsorbent groups to the silver halide. The adsorptive group is further preferably a mercapto-substituted, nitrogen-containing, heterocyclic group. The adsorptive group will hereinafter be described.

The compound of Group 2 is preferably represented by the following formula (C).

Formula (C)

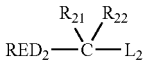

In the compound represented by formula (C), the reducible group of $RED_2$ is one-electron-oxidized, and thereafter the leaving group of $L_2$ is spontaneously eliminated, thus a C (carbon atom)-$L_2$ bond is cleaved, in the bond cleavage reaction. Further one electron can be released with the bond cleavage reaction.

In formula (C), $RED_2$ is the same as $RED_{12}$ in formula (B) with respect to the meanings and preferred embodiments. $L_2$ is the same as $L_{11}$ in formula (A) with respect to the meanings and preferred embodiments. Incidentally, when $L_2$ is a silyl group, the compound of formula (C) has two or more mercapto-substituted, nitrogen-containing, heterocyclic groups as the adsorbent groups. $R_{21}$ and $R_{22}$ each represent a hydrogen atom or a substituent, and are the same as $R_{112}$ in formula (A) with respect to the meanings and preferred embodiments. $RED_2$ and $R_{21}$ may bond together to form a ring structure.

The ring structure is a 5- to 7-membered, monocyclic or condensed, carbocyclic or heterocyclic, nonaromatic ring, and may have a substituent. Incidentally, there is no case where the ring structure corresponds to a tetrahydro-, hexahydro- or octahydro-derivative of an aromatic ring or an aromatic heterocycle. The ring structure is preferably such that corresponds to a dihydro-derivative of an aromatic ring or an aromatic heterocycle, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-□-pyran ring, a 1,2-dihydroquinoline ring, a 1,2-dihydroquinazoline ring, a 1,2-dihydroquinoxaline ring, etc. Preferred are a 2-imidazoline ring, a 2-thiazoline ring, an indoline ring, a benzoimidazoline ring, a benzothiazoline ring, a benzoxazoline ring, a 1,2-dihydro pyridine ring, a 1,2-dihydroquinoline ring, a 1,2-dihydroquinazoline ring and a 1,2-dihydroquinoxaline ring, more preferred are an indoline ring, a benzoimidazoline ring, a benzothiazoline ring and a 1,2-dihydroquinoline ring, particularly preferred is an indoline ring.

The compound of Group 3 will be described below.

According to the compound of Group 3, "bond formation" means that a bond of carbon-carbon, carbon-nitrogen, carbon-sulfur, carbon-oxygen, etc. is formed.

It is preferable that the one-electron oxidation product releases one or more electrons after an intramolecular bond-forming reaction between the one-electron-oxidized portion and a reactive site in the same molecular such as a carbon-carbon double bond, a carbon-carbon triple bond, an aromatic group and a benzo-condensed, nonaromatic heterocyclic group.

To be more detailed, a one-electron oxidized product (a cation radical species or a neutral radical species generated by elimination of a proton therefrom) formed by one electron oxidizing a compound of Group 3 reacts with a reactive group described above coexisting in the same molecule to form a bond and form a radical species having a new ring structure therein. The radical species have a feature to release a second electron directly or in company with elimination of a proton therefrom. One of compounds of Group 3 has a chance to further release one or more electrons, in a ordinary case two or more electrons, after formation of a two-electron oxidized product, after receiving a hydrolysis reaction in one case or after causing a tautomerization reaction accompanying direct migration of a proton in another case. Alternatively, compounds of Group 3 also include a compound having an ability to further release one or more electron, in an ordinary case two or more electrons directly from a two-electron oxidized product, not by way of a tautomerization reaction.

The compound of Group 3 is preferably represented by the following formula (D).

$$RED_3\text{-}L_3\text{-}Y_3 \qquad \text{Formula (D)}$$

In formula (D), $RED_3$ represents a reducible group that can be one-electron-oxidized, and $Y_3$ represents a reactive group that reacts with the one-electron-oxidized $RED_3$, specifically an organic group containing a carbon-carbon double bond, a carbon-carbon triple bond, an aromatic group or a benzo-condensed, nonaromatic heterocyclic group. $L_3$ represents a linking group that connects $RED_3$ and $Y_3$.

In formula (D), $RED_3$ has the same meanings as $RED_{12}$ in formula (B). In formula (D), $RED_3$ is preferably an arylamino group, a heterocyclic amino group, an aryloxy group, an arylthio group, an aryl group, or an aromatic or nonaromatic heterocyclic group that is preferably a nitrogen-containing heterocyclic group. $RED_3$ is more preferably an arylamino group, a heterocyclic amino group, an aryl group, or an aromatic or nonaromatic heterocyclic group. Preferred as the heterocyclic group are a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzoimidazole ring group, a benzoimidazoline ring group, a benzothiazoline ring group, a 3,4-methylenedioxyphenyl-1-yl group, etc. Particularly preferred as $RED_3$ are an arylamino group (particularly an anilino group), an aryl group (particularly a phenyl group), and an aromatic or nonaromatic heterocyclic group.

The aryl group represented by $RED_3$ preferably has at least one electron-donating group. The term "electron-donating group" means the same as above-mentioned electron-donating group.

When $RED_3$ is an aryl group, more preferred as a substituent on the aryl group are an alkylamino group, a hydroxy group, an alkoxy group, a mercapto group, a sulfoneamide group, an active methine group, and a nitrogen-containing, nonaromatic heterocyclic group that substitutes at the nitrogen atom, furthermore preferred are an alkylamino group, a hydroxy group, an active methine group, and a nitrogen-containing, nonaromatic heterocyclic group that substitutes at the nitrogen atom, and the most preferred are an alkylamino group, and a nitrogen-containing, nonaromatic heterocyclic group that substitutes at the nitrogen atom.

When $Y_3$ is an organic group containing carbon-carbon double bond (for example a vinyl group) having a substituent, more preferred as the substituent are an alkyl group, a phenyl group, an acyl group, a cyano group, an alkoxycarbonyl group, a carbamoyl group and an electron-donating group. The electron-donating group is preferably an alkoxy group; a hydroxy group (that may be protected by a silyl group, and examples of the silyl-protected group include a trimethylsilyloxy group, a t-butyldimethylsilyloxy group, a triphenylsilyloxy group, a triethylsilyloxy group, a phenyldimethylsilyloxy group, etc); an amino group; an alkylamino group; an arylamino group; a sulfoneamide group; an active methine group; a mercapto group; an alkylthio group; or a phenyl group having the electron-donating group as a substituent.

Incidentally, when the organic group containing the carbon-carbon double bond has a hydroxy group as a substituent, $Y_3$ contains a moiety of $>C_1{=}C_2(-OH)-$, which may be tautomerized into a moiety of $>CH^1\ H-C_2(=O)-$. In this case, it is preferred that a substituent on the $C_1$ carbon is an electron-attracting group, and as a result, $Y_3$ has a moiety of an active methylene group or an active methine group. The electron-attracting group, which can provide such a moiety of an "active methylene group" or an "active methine group", may be the same as above-mentioned electron-attracting group on the methine group of the "active methine group".

When $Y_3$ is an organic group containing a carbon-carbon triple bond (for example a ethynyl group) having a substituent, preferred as the substituent is an alkyl group, a phenyl group, an alkoxycarbonyl group, a carbamoyl group, an electron-donating group, etc.

When $Y_3$ is an organic group containing an aromatic group, preferable as the aromatic group is an aryl group, particularly a phenyl group, having an electron-donating group as a substituent, and an indole ring group. The electron-donating group is preferably a hydroxy group, which may be protected by a silyl group; an alkoxy group; an amino group; an alkylamino group; an active methine group; a sulfoneamide group; or a mercapto group.

When $Y_3$ is an organic group containing a benzo-condensed, nonaromatic heterocyclic group, preferred as the benzo-condensed, nonaromatic heterocyclic group are groups having an aniline moiety, such as an indoline ring group, a 1,2,3,4-tetrahydroquinoline ring group, a 1,2,3,4-tetrahydroquinoxaline ring group and a 4-quinolone ring group.

The reactive group of $Y_3$ is more preferably an organic group containing a carbon-carbon double bond, an aromatic group, or a benzo-condensed, nonaromatic heterocyclic group. Furthermore preferred are an organic group containing a carbon-carbon double bond; a phenyl group having an electron-donating group as a substituent; an indole ring group; and a benzo-condensed, nonaromatic heterocyclic group having an aniline moiety. The carbon-carbon double bond more preferably has at least one electron-donating group as a substituent.

It is also preferred that the reactive group represented by $Y_3$ contains a moiety the same as the reducible group represented by $RED_3$ as a result of selecting the reactive group as above.

$L_3$ represents a linking group that connects $RED_3$ and $Y_3$, specifically a single bond, an alkylene group, an arylene group, a heterocyclic group, —O—, —S—, —$NR_N$—, —C(=O)—, —$SO_2$—, —SO—, —P(=O)—, or a combination thereof. $R_N$ represents a hydrogen atom, an alkyl group, an aryl group or a heterocyclic group. The linking group represented by $L_3$ may have a substituent. The linking group represented by $L_3$ may bond to each of $RED_3$ and $Y_3$ at an optional position such that the linking group substitutes optional one hydrogen atom of each $RED_3$ and $Y_3$. Preferred examples of $L_3$ include a single bond; alkylene groups, particularly a methylene group, an ethylene group or a propylene group; arylene groups, particularly a phenylene group; a —C(=O)— group; a —O— group; a —NH— group; —N(alkyl)-groups; and divalent linking groups of combinations thereof.

When a cation radical ($X^+$.) provided by oxidizing $RED_3$ or a radical (X.) provided by eliminating a proton therefrom reacts with the reactive group represented by $Y_3$ to form a bond, it is preferable that they form a 3 to 7-membered ring structure containing the linking group represented by $L_3$. Thus, the radical ($X^+$. or X.) and the reactive group of Y are preferably connected though 3 to 7 atoms.

Next, the compound of Group 4 will be described below.

The compound of Group 4 has a reducible group-substituted ring structure. After the reducible group is one-electron-oxidized, the compound can release further one or more electrons with a ring structure cleavage reaction. The ring cleavage reaction proceeds as follows.

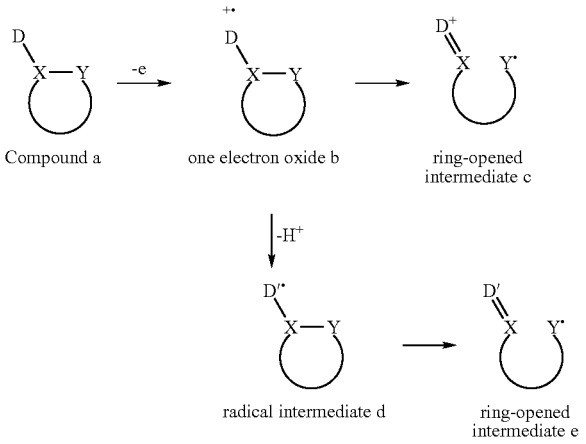

In the formula, compound a is the compound of Group 4. In compound a, D represents a reducible group, and X and Y each represent an atom forming a bond in the ring structure, which is cleaved after the one-electron oxidation. First, compound a is one-electron-oxidized to generate one-electron oxidation product b. Then, the X-Y bond is cleaved with conversion of the D-X single bond into a double bond, whereby ring-opened intermediate c is provided. Alternatively, there is a case where one-electron oxidation product b is converted into radical intermediate d with deprotonation, and ring-opened intermediate e is provided in the same manner. Subsequently, further one or more electrons are released form thus-provided ring-opened intermediate c or e.

The ring structure in the compound of Group 4 is a 3 to 7-membered, carbocyclic or heterocyclic, monocyclic or condensed, saturated or unsaturated, nonaromatic ring. The ring structure is preferably a saturated ring structure, more preferably 3- or 4-membered ring. Preferred examples of the ring structure include a cyclopropane ring, a cyclobutane ring, an oxirane ring, an oxetane ring, an aziridine ring, an azetidine ring, an episulphide ring and a thietane ring. More preferred are a cyclopropane ring, a cyclobutane ring, an oxirane ring, an oxetane ring and an azetidine ring, particularly preferred are a cyclopropane ring, a cyclobutane ring and an azetidine ring. The ring structure may have a substituent.

The compound of Group 4 is preferably represented by the following formulae (E) or (F).

Formula (E)

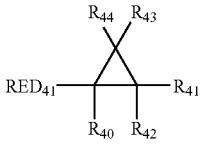

Formula (F)

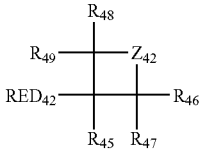

In formulae (E) and (F), $RED_{41}$ and $RED_{42}$ are the same as $RED_{12}$ in formula (B) with respect to the meanings and preferred embodiments, respectively. $R_{40}$ to $R_{44}$ and $R_{45}$ to $R_{49}$ each represent a hydrogen atom or a substituent. In formula (F), $Z_{42}$ represents —$CR_{420}R_{421}$—, —$NR_{423}$—, or —O—. $R_{420}$ and $R_{421}$ each represent a hydrogen atom or a substituent, and $R_{423}$ represents a hydrogen atom, an alkyl group, an aryl group or a heterocyclic group.

In formulae (E) and (F), each of $R_{40}$ and $R_{45}$ is preferably a hydrogen atom, an alkyl group or an aryl group, more preferably a hydrogen atom, an alkyl group or an aryl group. Each of $R_{41}$ to $R_{44}$ and $R_{46}$ to $R_{49}$ is preferably a hydrogen atom, an alkyl group, an alkenyl group, an aryl group, a heterocyclic group, an arylthio group, an alkylthio group, an acylamino group or a sulfoneamide group, more preferably a hydrogen atom, an alkyl group, an aryl group or a heterocyclic group, It is preferred that at least one of $R_{41}$ to $R_{44}$ is a donor group, and it is also preferred that both of $R_{41}$ and $R_{42}$, or both of $R_{43}$ and $R_{44}$ are an electron-attracting group. It is more preferred that at least one of $R_{41}$ to $R_{44}$ is a donor group. It is furthermore preferred that at least one of $R_{41}$ to $R_{44}$ is a donor group and $R_{41}$ to $R_{44}$ other than the donor group are selected from a hydrogen atom and an alkyl group.

A donor group referred to here is an "electron-donating group" or an aryl group substituted with at least one "electron-donating group." Preferable examples of donor groups include an alkylamino group, an arylamino group, a heterocyclicamino group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute and a phenyl group substituted with at least one electron-donating group. More preferable examples thereof include an alkylamino group, an aryamino group, an electron excessive aromatic heterocyclic group in a five-membered single ring or fused ring containing at least one nitrogen atom in a ring structure as a part (an indol ring, a pyrrole ring, a carbazole ring and the like), and a phenyl group substituted with an electron-donating group (a phenyl group substituted with three or more alkoxy groups, a phenyl group substituted with a hydroxy group, an alkylamino group, or an arylamino group and the like). Particularly preferable examples thereof include an aryamino group, an electron excessive aromatic heterocyclic group in a five-membered single ring or fused ring containing at least one nitrogen atom in a ring structure as a part (especially, a 3-indolyl group), and a phenyl group substituted with an electron-donating group (especially, a trialkoxyphenyl group and a phenyl group substituted with an alkylamino group or an arylamino group).

$Z_{42}$ is preferably —$CR_{420}R_{421}$— or —$NR_{423}$—, more preferably —$NR_{423}$—. Each of $R_{420}$ and $R_{421}$ is preferably a hydrogen atom, an alkyl group, an aryl group, a heterocyclic group, an acylamino group or a sulfoneamino group, more preferably a hydrogen atom, an alkyl group, an aryl group or a heterocyclic group. $R_{423}$ is preferably a hydrogen atom, an alkyl group, an aryl group or an aromatic heterocyclic group, more preferably a hydrogen atom, an alkyl group or an aryl group.

The substituent represented by each of $R_{40}$ to $R_{49}$, $R_{420}$, $R_{42}$, and $R_{423}$ preferably has 40 or less carbon atoms, more preferably has 30 or less carbon atoms, particularly preferably 15 or less carbon atoms. The substituents of $R_{40}$ to $R_{49}$, $R_{420}$, $R_{42}$, and $R_{423}$ may bond to each other or to the other portion such as $RED_{41}$, $RED_{42}$ and $Z_{42}$, to form a ring.

In the compounds of Groups 1 to 4 used in the invention, the adsorptive group to the silver halide is such a group that is directly adsorbed on the silver halide or promotes adsorption of the compound onto the silver halide. Specifically, the adsorptive group is a mercapto group or a salt thereof; a thione group (—C(═S)—); a heterocyclic group containing at least one atom selected from the group consisting of a nitrogen atom, a sulfur atom, a selenium atom and a tellurium atom; a sulfide group; a cationic group; or an ethynyl group. Incidentally, the adsorptive group in the compound of Group 2 is not a sulfide group.

The mercapto group or a salt thereof used as the adsorptive group may be a mercapto group or a salt thereof itself, and is more preferably a heterocyclic group, an aryl group or an alkyl group having a mercapto group or a salt thereof as a substituent. The heterocyclic group is a 5- to 7-membered, monocyclic or condensed, aromatic or nonaromatic, heterocyclic group. EXAMPLEs thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, etc.

The heterocyclic group may contain a quaternary nitrogen atom, and in this case, the mercapto group bonding to the heterocyclic group may be dissociated into a mesoion. Such heterocyclic group may be an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group, etc. Preferred among them is a triazolium ring group such as a 1,2,4-triazolium-3-thiolate ring group. Examples of the aryl group include a phenyl group and a naphthyl group. Examples of the alkyl group include straight, branched or cyclic alkyl groups having 1 to 30 carbon atoms. When the mercapto group forms a salt, a counter ion of the salt may be a cation of an alkaline metal, an alkaline earth metal, a heavy metal, etc. such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; etc.

Further, the mercapto group used as the adsorptive group may be tautomerized into a thione group. Specific examples of the thione group include a thioamide group (herein a —C(═S)—NH— group); and groups containing a structure of the thioamide group, such as linear or cyclic thioamide groups, a thiouredide group, a thiourethane group and a dithiocarbamic acid ester group. Examples of the cyclic thioamide group include a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group, etc.

The thione group used as the adsorbent group, as well as the thione group derived from the mercapto group by tautomerization, may be a linear or cyclic, thioamide, thiouredide, thiourethane or dithiocarbamic acid ester group that cannot be tautomerized into the mercapto group or has no hydrogen atom at □-position of the thione group.

The heterocyclic group containing at least one atom selected from the group consisting of a nitrogen atom, a sulfur atom, a selenium atom and tellurium atom, which is used as the adsorbent group, is a nitrogen-containing heterocyclic group having a —NH— group that can form a silver imide (>NAg) as a moiety of the heterocycle; or a heterocyclic group having a —S— group, a —Se— group, a —Te— group or a ═N— group that can form a coordinate bond with a silver ion as a moiety of the heterocycle. Examples of the former include a benzotriazole group, a triazole group, an indazole group, a pyrazole group, a tetrazole group, a benzimidazole group, an imidazole group, a purine group, etc. Examples of the latter include a thiophene group, a thiazole group, an oxazole group, a benzothiazole group, a benzoxazole group, a thiadiazole group, an oxadiazole group, a triazine group, a selenazole group, a benzselenazole group, a tellurazole group, a benztellurazole group, etc. The former is preferable.

The sulfide group used as the adsorptive group may be any group with a —S— moiety, and preferably has a moiety of: alkyl or alkylene-S-alkyl or alkylene; aryl or arylene-S-alkyl or alkylene; or aryl or arylene-S-aryl or arylene. The sulfide group may form a ring structure, and may be a —S—S— group. Specific examples of the ring structure include groups with a thiolane ring, a 1,3-dithiolane ring, a 1,2-dithiolane ring, a thiane ring, a dithiane ring, a tetrahydro-1,4-thiazine ring (a thiomorpholine ring), etc. Particularly preferable as the sulfide groups are groups having a moiety of alkyl or alkylene-S-alkyl or alkylene.

The cationic group used as the adsorptive group is a quaternary nitrogen-containing group, specifically a group with an ammonio group or a quaternary nitrogen-containing heterocyclic group. Incidentally, there is no case where the cationic group partly composes an atomic group forming a dye structure, such as a cyanine chromophoric group. The ammonio group may be a trialkylammonio group, a dialkylarylammonio group, an alkyldiarylammonio group, etc., and examples thereof include a benzyldimethylammonio group, a trihexylammonio group, a phenyldiethylammonio group, etc. Examples of the quaternary nitrogen-containing heterocyclic group include a pyridinio group, a quinolinio group, an isoquinolinio group, an imidazolio group, etc. Preferred are a pyridinio group and an imidazolio group, and particularly preferred is a pyridinio group. The quaternary nitrogen-containing heterocyclic group may have an optional substituent. Preferred as the substituent in the case of the pyridinio group and the imidazolio group are alkyl groups, aryl groups, acylamino groups, a chlorine atom, alkoxycarbonyl groups and carbamoyl groups. Particularly preferred as the substituent in the case of the pyridinio group is a phenyl group.

The ethynyl group used as the adsorptive group means a —C≡CH group, in which the hydrogen atom may be substituted.

The adsorptive group may have an optional substituent.

Specific examples of the adsorptive group further include groups described in pages 4 to 7 of a specification of JP-A No. 11-95355.

Preferred as the adsorptive group used in the invention are mercapto-substituted, nitrogen-containing, heterocyclic groups such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group and a 1,5-dimethyl-1,2,4-triazolium-3-thiolate group; and nitrogen-containing heterocyclic groups having a —NH— group that can form a silver imide (>NAg) as a moiety of the heterocycle, such as a benzotriazole group, a benzimidazole group and an indazole group. Particularly preferred are a 5-mercaptotetrazole group, a 3-mercapto-1,2,4-triazole group and a benzotriazole group, and the most preferred are a 3-mercapto-1,2,4-triazole group and a 5-mercaptotetrazole group.

Among these compounds, it is particularly preferred that the compound has two or more mercapto groups as a moiety. The mercapto group (—SH) may be converted into a thione group in the case where it can be tautomerized. The compound may have two or more adsorbent groups containing above-mentioned mercapto or thione group as a moiety, such as a cyclic thioamide group, an alkylmercapto group, an arylmercapto group and a heterocyclic mercapto group. Further, the compound may have one or more adsorptive group containing two or more mercapto or thione groups as a moiety, such as a dimercapto-substituted, nitrogen-containing, heterocyclic group.

Examples of the adsorptive group containing two or more mercapto group, such as a dimercapto-substituted, nitrogen-containing, heterocyclic group, include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolo pyrimidine group, a 2,5-dimercapto-imidazole group, etc. Particularly preferred are a 2,4-dimercaptopyrimidine group, a 2,4-dimercaptotriazine group, and a 3,5-dimercapto-1,2,4-triazole group.

The adsorptive group may be connected to any position of the compound represented by each of formulae (A) to (F) and (1) to (3). Preferred portions, which the adsorptive group bonds to, are $RED_{11}$, $RED_{12}$, $RED_2$ and $RED_3$ in formulae (A) to (D), $RED_{41}$, $R_{41}$, $RED_{42}$, and $R_{46}$ to $R_{48}$ in formulae (E) and (F), and optional portions other than $R_1$, $R_2$, $R_{11}$, $R_{12}$, $R_{31}$, $L_1$, $L_{21}$ and $L_{31}$ in formulae (1) to (3). Further, more preferred portions are $RED_{11}$ to $RED_{42}$ in formulae (A) to (F).

The spectral sensitizer moiety is a group containing a spectral sensitizer chromophore, a residual group provided by removing an optional hydrogen atom or substituent from a spectral sensitizer compound. The spectral sensitizer moiety may be connected to any position of the compound represented by each of formulae (A) to (F) and (1) to (3). Preferred portion, which the spectral sensitizer moiety bonds to, are $RED_{11}$, $RED_{12}$, $RED_2$ and $RED_3$ in formulae (A) to (D), $RED_{41}$, $R_{41}$, $RED_{42}$, and $R_{46}$ to $R_{48}$ in formulae (E) and (F), and optional portions other than $R_1$, $R_2$, $R_{11}$, $R_{12}$, $R_{31}$, $L_1$, $L_{21}$ and $L_{31}$ in formulae (1) to (3). Further, more preferred portions are $RED_{11}$ to $RED_{42}$ in formulae (A) to (F). The spectral sensitizer is preferably such that typically used in color sensitizing techniques. Examples thereof include cyanine dyes, composite cyanine dyes, merocyanine dyes, composite merocyanine dyes, homopolar cyanine dyes, styryl dyes, and hemicyanine dyes. Typical spectral sensitizers are disclosed in Research Disclosure, Item 36544, September 1994. The dyes can be synthesized by one skilled in the art according to procedures described in the above Research Disclosure and F. M. Hamer, *The Cyanine dyes and Related Compounds*, Interscience Publishers, New York, 1964. Further, dyes described in pages 4 to 7 of a specification of JP-A No. 11-95355 (U.S. Pat. No. 6,054,260) may be used in the invention.

The compounds of Groups 1 to 4 used in the invention has preferably 10 to 60 carbon atoms in total, more preferably 15 to 50 carbon atoms, furthermore preferably 18 to 40 carbon atoms, particularly preferably 18 to 30 carbon atoms.

When a silver halide photosensitive material using the compounds of Groups 1 to 4 is exposed, the compound is one-electron-oxidized. After the subsequent reaction, the compound is further oxidized while releasing one electron, or two or more electrons depending on Group. An oxidation potential in the first one-electron oxidation is preferably 1.4 V or less, more preferably 1.0 V or less. This oxidation potential is preferably 0 V or more, more preferably 0.3 V or more. Thus, the oxidation potential is preferably approximately 0 V to 1.4 V, more preferably approximately 0.3 V to 1.0 V.

The oxidation potential may be measured by a cyclic voltammetry technique. Specifically, a sample is dissolved in a solution of acetonitrile/water containing 0.1 M lithium perchlorate=80/20 (volume %), nitrogen gas is passed through the resultant solution for 10 minutes, and then the oxidation potential is measured at 25° C. at a potential scanning rate of 0.1 V/second by using a glassy carbon disk as a working electrode, using a platinum wire as a counter electrode, and using a calomel electrode (SCE) as a reference electrode. The oxidation potential per SCE is obtained at peak potential of cyclic voltammetric curve.

In the case where the compound of Groups 1 to 4 is one-electron-oxidized and release further one electron after the subsequent reaction, an oxidation potential in the subsequent oxidation is preferably −0.5 V to −2 V, more preferably −0.7 V to −2 V, furthermore preferably −0.9 V to −1.6 V.

In the case where the compound of Groups 1 to 4 is one-electron-oxidized and release further two or more electrons after the subsequent reaction, oxidation potentials in the subsequent oxidation are not particularly limited. The oxidation potentials in the subsequent oxidation often cannot be measured precisely, because an oxidation potential in releasing the second electron cannot be clearly differentiated from an oxidation potential in releasing the third electron.

Next, the compound of Group 5 will be described.

The compound of Group 5 is represented by X-Y, in which X represents a reducible group and Y represents a leaving group. The reducible group represented by X can be one-electron-oxidized to provide a one-electron oxidation product, which can be converted into an X radical by eliminating the leaving group of Y with a subsequent X-Y bond cleavage reaction. The X radical can release further one electron. The oxidation reaction of the compound of Group T5 may be represented by the following formula.

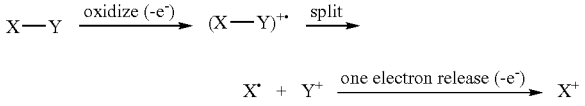

The compound of Group 5 exhibits an oxidation potential of preferably 0 V to 1.4 V, more preferably 0.3 V to 1.0 V. The radical X. generated in the formula exhibits an oxidation potential of preferably −0.7 V to −2.0 V, more preferably −0.9 V to −1.6 V.

The compound of Group 5 is preferably represented by the following formula (G).

Formula (G)

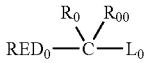

In formula (G), $RED_0$ represents a reducible group, $L_0$ represents a leaving group, and $R_0$ and $R_{00}$ each represent a hydrogen atom or a substituent. $RED_0$ and $R_0$, and $R_0$ and $R_{00}$ may be bond together to form a ring structure, respectively. $RED_0$ is the same as $RED_2$ in formula (C) with respect to the meanings and preferred embodiments. $R_0$ and $R_{00}$ are the same as $R_{21}$ and $R_{22}$ in formula (C) with respect to the meanings and preferred embodiments, respectively. Incidentally, $R_0$ and $R_{00}$ are not the same as the leaving group of $L_0$ respectively, except for a hydrogen atom. $RED_0$ and $R_0$ may bond together to form a ring structure with examples and preferred embodiments the same as those of the ring structure formed by bonding $RED_2$ and $R_{21}$ in formula (C). Examples of the ring structure formed by bonding $R_0$ and $R_{00}$ each other include a cyclopentane ring, a tetrahydrofuran ring, etc. In formula (G), $L_0$ is the same as $L_2$ in formula (C) with respect to the meanings and preferred embodiments.

The compound represented by formula (G) preferably has an adsorptive group to the silver halide or a spectrally sensitizing dye moiety. However, the compound does not have two or more adsorptive groups when $L_0$ is a group other than a silyl group. Incidentally, the compound may have two or more sulfide groups as the adsorbent groups, not depending on $L_0$.

The adsorptive group to the silver halide in the compound represented by formula (G) may be the same as those in the compounds of Groups 1 to 4, and further may be the same as all of the compounds and preferred embodiments described as "an adsorptive group to the silver halide" in pages 4 to 7 of a specification of JP-A No. 11-95355.

The spectral sensitizer moiety in the compound represented by formula (G) is the same as in the compounds of Groups 1 to 4, and may be the same as all of the compounds and preferred embodiments described as "photoabsorptive group" in pages 7 to 14 of a specification of JP-A No. 11-95355.

Specific examples of the compounds of Groups 1 to 5 used in the invention are illustrated below without intention of restricting the scope of the invention.

1

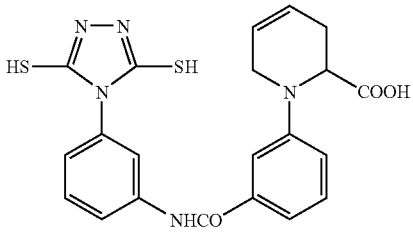

2

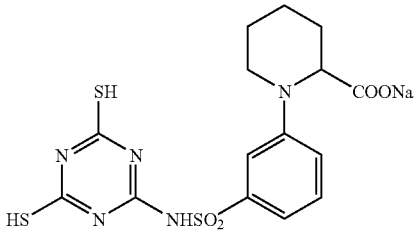

-continued
3
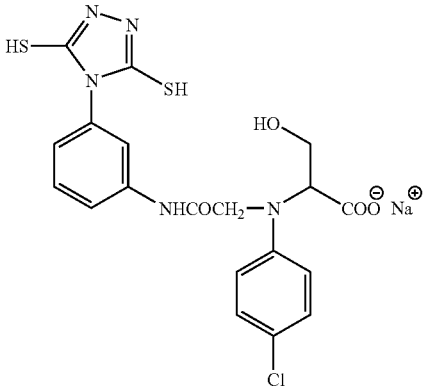
4
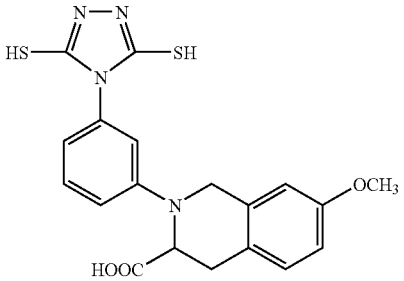
5
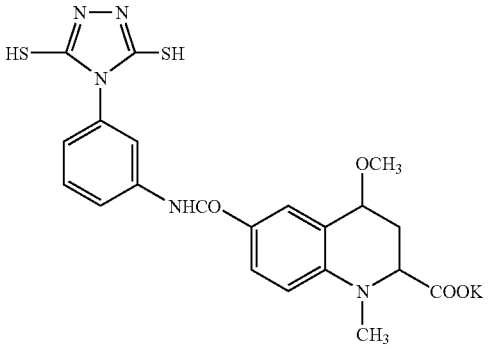
6
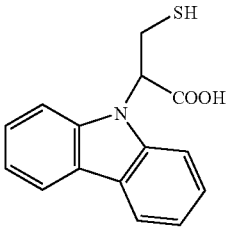
7
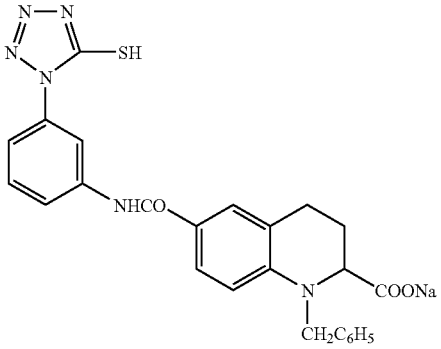
-continued
8
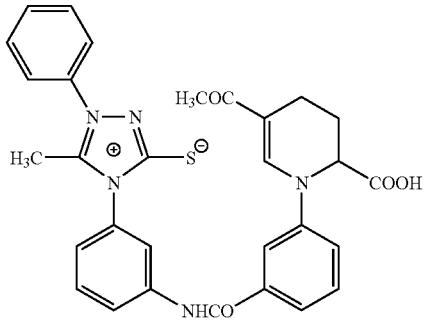
9
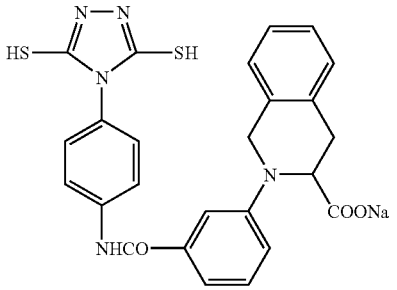
10
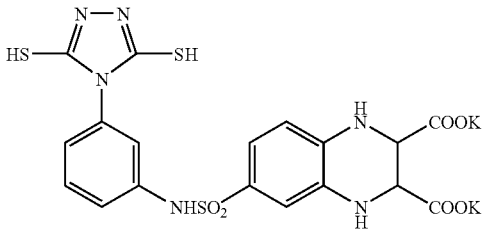
11
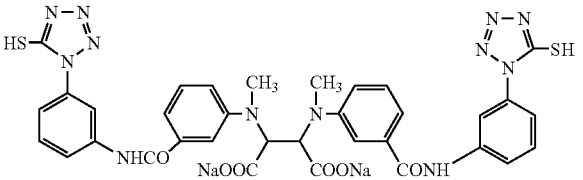
12
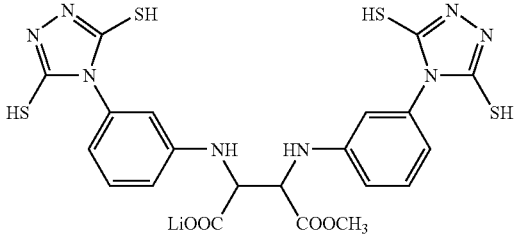
13
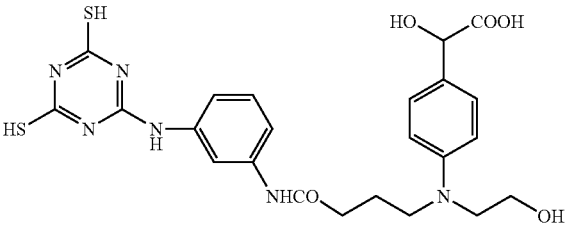

-continued
14
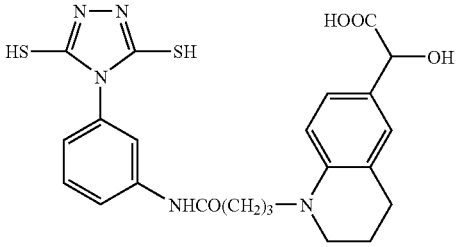
15
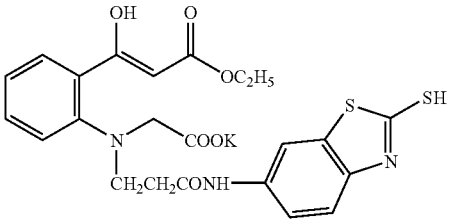
16
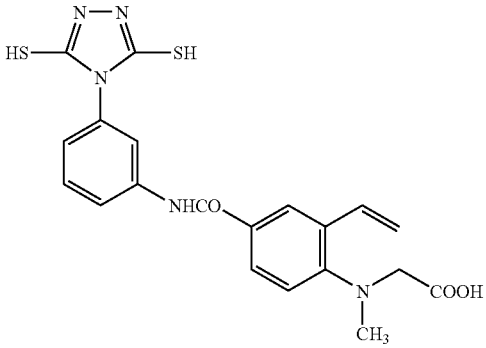
17
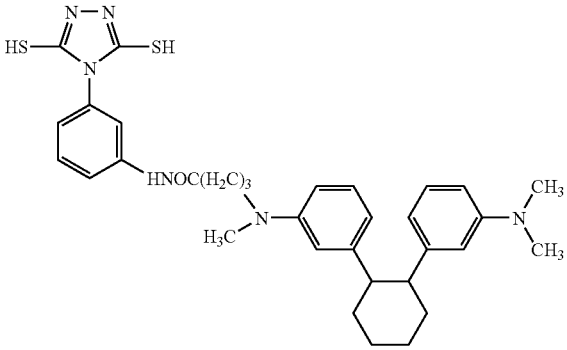
18
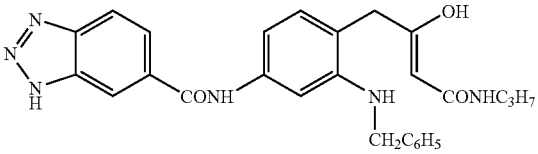
-continued
19
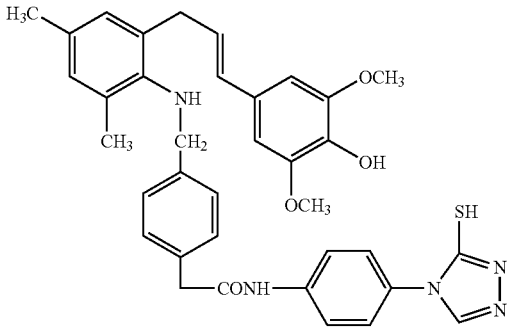
20
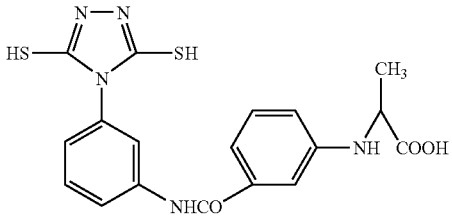
21
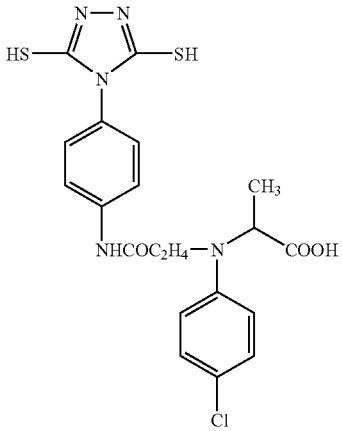
22
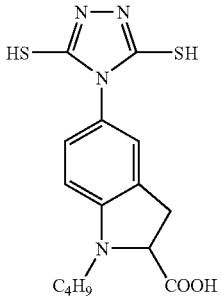

-continued
23
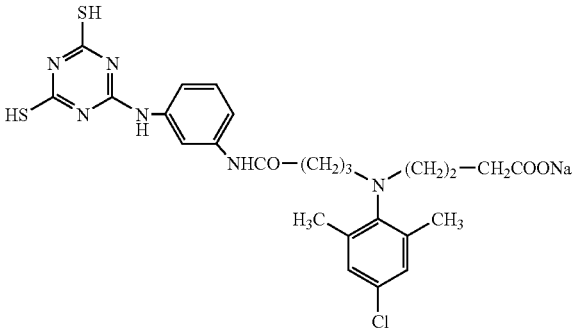
24
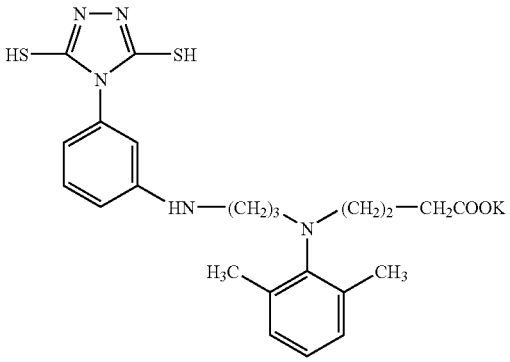
25
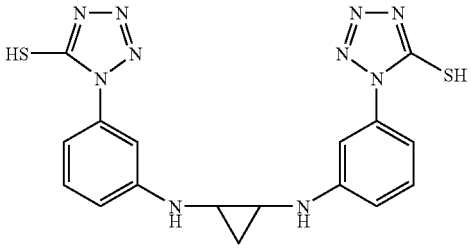
26
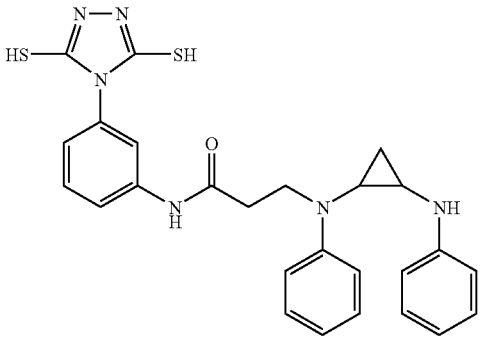
27
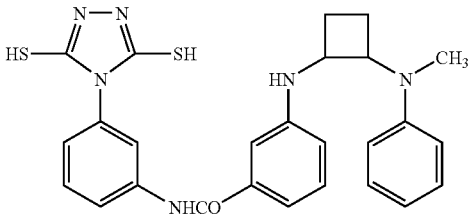
-continued
28
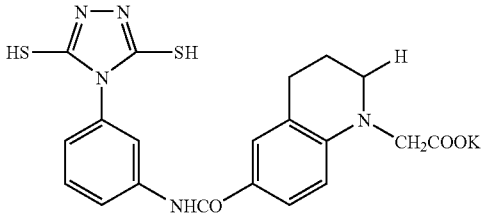
29
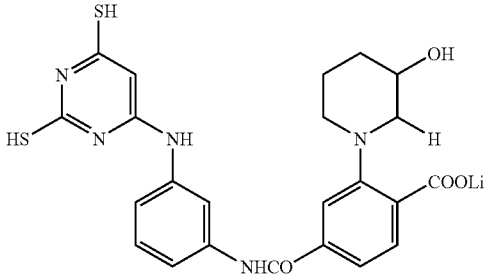
30
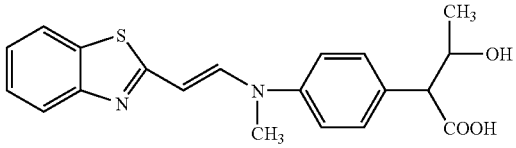
31
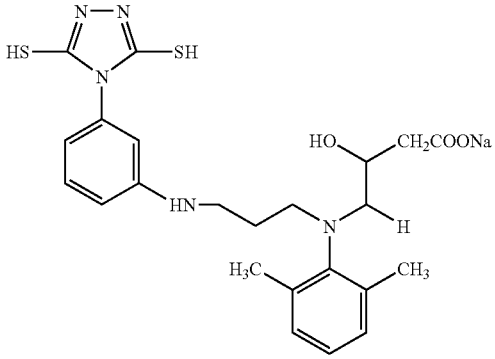
32
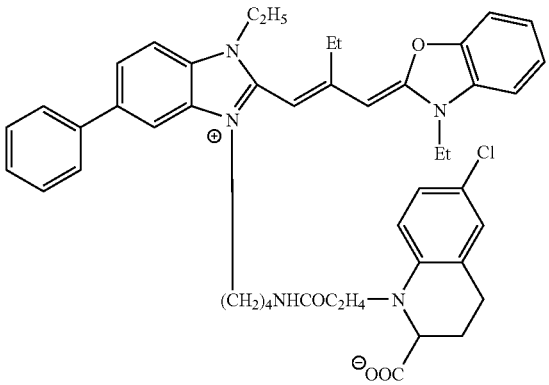

-continued

33

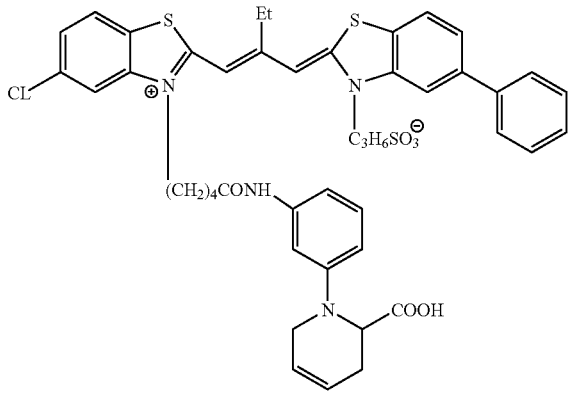

34

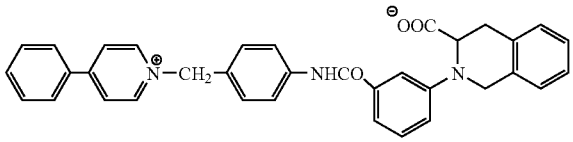

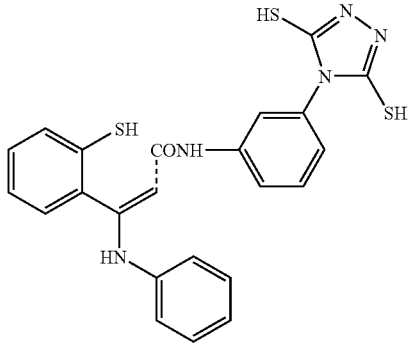

G-1

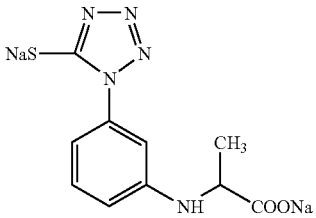

G-2

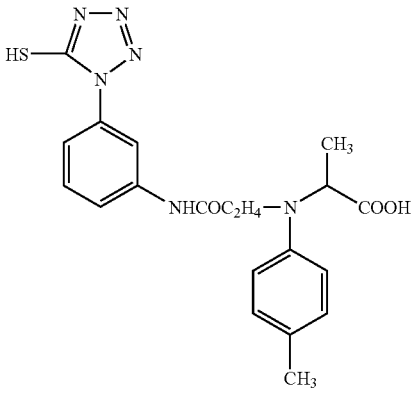

-continued

G-3

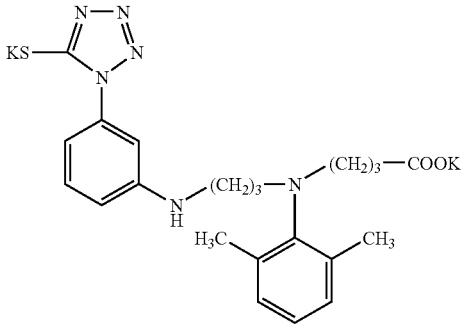

G-4

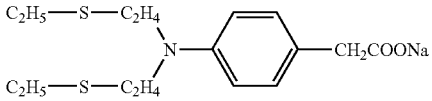

G-5

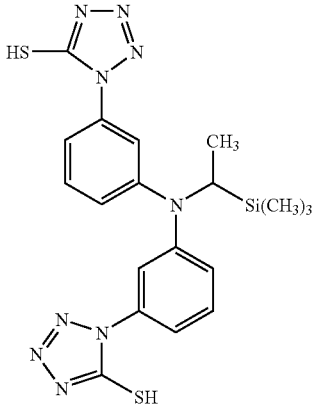

The compounds of Groups 1 to 4 used in the invention are the same as compounds described in detail in JP-A Nos. 2003-114487, 2003-114486, 2003-140287, 2003-75950 and 2003-114488, respectively. The specific examples of the compounds of Groups 1 to 4 used in the invention further include compound examples disclosed in the specifications. Synthesis examples of the compounds of Groups 1 to 4 used in the invention may be the same as described in the specifications.

Specific examples of the compound of Group 5 further include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692 A1 (Compound INV 1 to 35); EP No. 893732 A1; U.S. Pat. Nos. 6,054,260 and 5,994,051; etc.

The compounds of Groups 1 to 5 may be used at any time during preparation of the photosensitive silver halide emulsion and production of the photothermographic material. For example, the compound may be used, in a photosensitive silver halide grain formation step, in a desalting step, in a chemical sensitization step, and before coating, etc. The compound may be added in several times, during these steps. The compound is preferably added, after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 to 5 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Groups 1 to 5 used in the invention is preferably added to the image forming layer comprising the photosensitive silver halide and the non-photosensitive organic silver salt. The compound may be added to a surface protective layer, or an intermediate layer, as well as the image forming layer comprising the photosensitive silver halide and the non-photosensitive organic silver salt, to be diffused to the image forming layer in the coating step. The compound may be added before or after addition of a sensitizing dye. A mol value of the compound per one mol of the silver halide is preferably $1\times10^{-9}$ mol to $5\times10^{-1}$ mol, more preferably $1\times10^{-8}$ mol to $5\times10^{-2}$ mol, in a layer comprising the photosensitive silver halide emulsion.

10) Compound Having Adsorptive Group and Reducible Group

The photothermographic material of the present invention preferably comprises a compound having an adsorptive group and a reducible group in a molecule. It is preferred that the compound having an adsorptive group and a reducible group used in the invention is represented by the following formula (I).

A-(W)n-B Formula (I)

In formula (I), A represents a group capable of adsorption to a silver halide (hereafter, it is called an adsorptive group) and W represents a divalent connecting group and n represents 0 or 1 and B represents a reducible group.

Next, formula (I) is explained in more detail.

In formula (I), the adsorptive group represented by A is a group to adsorb directly to a silver halide or a group to promote adsorption to a silver halide. As typical examples, a mercapto group (or the salt thereof), a thione group (—C(═S)—), a nitrogen atom, a heterocyclic ring containing at least one atom selected from a nitrogen atom, a sulfur atom, a selenium atom and a tellurium atom, a sulfide group, a disulfide group, a cationic group, an ethynyl group and the like are described.

The mercapto group as an adsorptive group means a mercapto group (and the salt thereof) itself and simultaneously more preferably represents a heterocyclic ring group or an aryl group or an alkyl group substituted by at least one mercapto group (or the salt thereof). Herein, as the heterocyclic ring group, a monocyclic or a condensed aromatic or nonaromatic heterocyclic ring group having at least a 5 to 7 membered ring, e.g., an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group and the like are described. A heterocyclic ring having quarternalized nitrogen atom may also be adopted, wherein a mercapto group as a substituent may dissociate to form a mesoion. As examples of such heterocyclic ring group, an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group and the like are described and among them, a triazolium ring group (e.g., a 1,2,4-triazolium-3-thiolate ring group) is preferable. As an aryl group, a phenyl group or a naphthyl group is described. As an alkyl group, a straight chain, branched chain or cyclic alkyl group having 1 to 30 carbon atoms is described. As a counter ion, whereby a mercapto group forms the salt thereof, a cation such as an alkali metal, an alkali earth metal, a heavy metal and the like ($Li^+$, $Na^+$, $K^+$, $Mg^{2+}$, $Ag^+$, $Zn^{2+}$ and the like), an ammonium ion, a heterocyclic ring group having quaternalized nitrogen atom, a phosphonium ion and the like are described. Further, the mercapto group as an adsorptive group may become a thione group by a tautomerization. For example, a thioamide group (herein —C(═S)—NH— group) and the group containing the said thioaminde group as a partial structure, namely a chain or a cyclic thioamide, thioureide, thiourethane or dithiocarbanic ester group and the like are described. Herein, as cyclic examples, a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group and the like are described.

The thione group as an adsorptive group may also contain a chain or a cyclic thioamide group, a thioureido group, a thiouretane group or a thioester group which can not tautomerize to a mercapto group (having no hydrogen atom on the □-position of a thione group) with containing a mercapto group capable to become a thion group by tautomerization.

The heterocyclic ring group containing at least one atom selected from a nitrogen atom, a sulfur atom, a selenium atom and a tellurium atom represents a nitrogen atom containing heterocyclic ring group having —NH— group, as a partial structure of hetero ring, capable to form a silver iminate (>NAg) or a heterocyclic ring group, having —S— group, —Se— group, —Te— group or ═N— group as a partial structure of hetero ring, and capable to coordinate to a silver ion by a chelate bonding. As the former examples, a benzotriazole group, a triazole group, an indazole group, a pyrazole group, a tetrazole group, a benzimidazole group, a purine group and the like are described. As the latter examples, a thiophene group, a thiazole group, a benzoxazole group, a thiadiazole group, an oxadiazole group, a triazine group, a selenoazole group, a benzoselenazole group, a tellurazole group, a benzotellurazole group and the like are described. The former is preferable.

The sulfide group or disulfide group as an adsorptive group contains all groups having "—S—" or "—S—S—" as a partial structure, but the group having "alkyl (or an alkylene)-X-alkyl (or alkylene)", "aryl (or arylene)-X-alkyl (or alkylene)", and "aryl (or arylene)-X-aryl (or arylene)" as a partial structure are preferably, wherein X represents "—S— group" or "—S—S— group". Further, these sulfide groups or disulfide groups may form a cyclic structure. As typical examples of a cyclic structure formation, the group containing a thiorane ring, a 1,3-dithiorane ring, a 1,2-dithiorane ring, a thiane ring, a dithiane ring, a thiomorphorine ring and the like are described. As a sulfide group, the group having "alkyl (or alkylene)-S-alkyl (or alkylene)" as a partial structure and as a disulfide group, a 1,2-dithiorane ring group are particularly preferably described.

The cationic group as an adsorptive group means the group containing a quaternalized nitrogen atom, such as an ammonio group or a nitrogen containing heterocyclic ring group containing a quaternalized nitrogen atom. Herein, an ammonio group means a trialkylammonio group, a dialkylarylammonio group, an alkyldiarylammonio group, such as a benzyldimethylammonio group, a trihexylammonio group, a phenyldiethylammonio group and the like are described. As examples of the heterocyclic ring group containing a quaternalized nitrogen atom, a pyridinio group, a quinolinio group, an isoquinolinio group, an imidazolio group and the like are described. A pyridinio group and an imidazolio group are preferable and a pyridinio group is particularly preferable. These nitrogen containing heterocyclic ring groups containing a quaternalized nitrogen atom may have any substituent, but in the case of a pyridinio group and an imidazolio group, an alkyl group, an aryl group, an acylamino group, a chlorine atom, an alkoxycarbonyl group, a carbamoyl group and the like are preferably as a substituent and in a pyridinio group, a phenyl group is particularly preferable as a substituent.

The ethynyl group as an adsorptive group means —C□CH group and the said hydrogen atom may be substituted.

The adsorptive group described above may have any substituent. As examples of a substituent, a halogen atom (a fluorine atom, a chlorine atom, a bromine atom or an iodine atom), an alkyl group (a straight chain alkyl group, a branched chain alkyl group, a cyclic alkyl group and a bicyclic alkyl group and an active methine group are contained), an alkenyl group, an alkynyl group, an aryl group, a heterocyclic ring group (irrelevant to a substituting position), an acyl group, an alkoxycarbonyl group, an aryloxycarbonyl group, a heterocyclic oxycarbonyl ring group, a carbamoyl group, a N-hydroxycarbamoyl group, a N-acylcarbamoyl group, a N-sulfonylcarbamoyl group, a N-carbamoylcarbamoyl group, a thiocarbamoyl group, a N-sulfamoylcarbamoyl group, a carbazoyl group, a carboxy group or a salt thereof, an oxalyl group, an oxamoyl group, a cyano group, a carbonimidoyl group, a formyl group, a hydroxy group, an alkoxy group (a group containing an ethyleneoxy group or a propyleneoxy group as repeating unit is contained), an aryloxy group, an oxy group substituted to heterocyclic ring, an acyloxy group, (an alkoxy or an aryloxy)carbonyloxy group, a carbamoyloxy group, a sulfonyloxy group, an amino group, (an alkyl, an aryl or a heterocyclic ring)amino group, an acylamino group, a sulfonamide group, an ureido group, a thioureido group, a N-hydroxyureido group, an imide group, (an alkoxy or aryloxy)carbonylamino group, a sulfamoylamino group, a semicarbazide group, a thiosemicarbazide group, a hydrazino group, an ammonio group, an oxamoylamino group, a N-alkyl or aryl)sulfonylureido group, a N-acylureido group, a N-acylsulfamoylamino group, a hydroxyamino group, a nitro group, a heterocyclic ring group containing quaternalized nitrogen atom (e.g., a pyridinio group, an imidazolio group, a quinolinio group, an isoquinolinio group), an isocyano group, an imino group, a mercapto group, (an alkyl, an aryl or a heterocyclic ring)thio group, (an alkyl, an aryl or a heterocyclic ring)dithio group, (an alkyl, or an aryl)sulfonyl group, (an alkyl or an aryl)sulfinyl group, a sulfo group and the salt thereof, a sulfamoyl group, a N-acylsulfamoyl group, a N-sulfonylsulfamoyl group and a salt thereof, a phosphino group, a phosphinyl group, a phosphinyloxy group, a phosphinylamino group, a silyl group and the like are described. Herein, the active methine group means a mathine group subsutituted by two electron-withdrawing group, wherein the electron-withdrawing group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group and a carbonimidoyl group. Herein, two electron-withdrawing groups may bind each other to form a cyclic structure. The salt means a cation such as from an alkali metal, an alkali earth metal and a heavy metal and an organic cation such as an ammonium ion, a phosphonium ion and the like.

Further, as typical examples of an adsorptive group, the compounds described in pages 4 to 7 in the specification of JP-A No. 11-95355 are described.

As an adsorptive group represented by A in formula (I), a heterocyclic ring group substituted by a mercapto group (e.g., a 2-mercaptothiadiazole group, a 3-mercapto-1,2,4-triazole group, a 5-mercaptotetrazole group, a 2-mercapto-1,3,4-oxadiazole group, a 2-mercaptobenzothiazole group, a 2-mercaptobenzimidazole group, a 1,5-dimethyl-1,2,4-triazorium-3-thiolate group and the like), a heterocyclic ring group substituted by two mercapto groups (e.g., a 2,4-dimercaptopyrimidine group, a 2,4-dimercatotriazine group, a 3,5-dimercapto-1,2,4-triazole group, a 2,5-dimercapto-1,3-thiazole group and the like) or a nitrogen atom containing heterocyclic ring group having a —NH— group capable to form an imino-silver (>NAg) as a partial structure of heterocyclic ring (e.g., a benzotriazole group, a benzimidazole group, an indazole group and the like) are more preferably and a heterocyclic ring group substituted by two mercapto groups is particularly preferable.

In formula (I), W represents a divalent connection group. The said connection group may be any divalent connection group, as far as it does not give a bad effect toward a photographic property. For example, a divalent connection group composed of a carbon atom, a hydrogen atom, an oxygen atom a nitrogen atom and a sulfur atom can be used. As typical examples, an alkylene group having 1 to 20 carbon atoms (e.g., a methylene group, an ethylene group, a trimethylene group, a tetramethylene group, a hexamethylene group and the like), an arylene group having 6 to 20 carbon atoms (e.g., a phenylene group, a nephthylene group and the like), $—CONR_1—$, $—SO_2NR_2—$, —O—, —S—, $—NR_3—$, $—NR_4CO—$, $—NR_5SO_2—$, $—NR_6CONR_7—$, —COO—, —OCO— and the combination of these connecting groups are described. Herein, $R_1$, $R_2$, $R_3$, $R_4$, $R_5$, $R_6$ and $R_7$ independently represent a hydrogen atom, an aliphatic group and an aryl group. As preferred aliphatic group represented by $R_1$, $R_2$, $R_3$, $R_4$, $R_5$, $R_6$ and $R_7$, a straight chain, branched chain or cyclic alkyl group, an alkenyl group, an alkynyl group, an aralkyl group having 1 to 30 carbon atoms, particularly 1 to 20 carbon atoms (e.g., a methyl group, an ethyl group, an isopropyl group, a t-butyl group, a n-octyl group, a n-decyl group, a n-hexadecyl group, a cyclopropyl group, a cyclopentyl group, a cyclohexyl group, an aryl group, a 2-butenyl group, a 3-pentenyl group, a propargyl group, a 3-pentynyl group, a benzyl group and the like) are described. In formula (I), as an aryl group represented by $R_1$, $R_2$, $R_3$, $R_4$, $R_5$, $R_6$ and $R_7$, a monocyclic or condensed ring aryl group having 6 to 30 carbon atoms is preferable and that having 6 to 20 carbon atoms is more preferable. For example, a phenyl group and a naphthyl group and the like are described. The above substituent represented by $R_1$, $R_2$, $R_3$, $R_4$, $R_5$, $R_6$ and $R_7$ may have still more any substituent, whereby the substituent defined as similar to the substituent for an adsorptive group described above.

In formula (I), a reducible group represented by B represents the group capable to reduce a silver ion. As the examples, a formyl group, an amino group, a triple bond group such as an acetylene group, a propargyl group and the like, an alkylmercapto group or an arylmercapto group, hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols and polyphenols such as hydroquinones, catechols, resorcinols, benzenetriols, bisphenols are contained), hydrazines, hydrazides and phenidones can be described.

In formula (I), a preferable reducible group represented by B is the residue derived from the compound represented by formulae (B1) to (B13).

($B_1$)

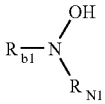

($B_2$)

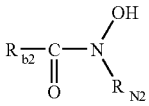

($B_3$)

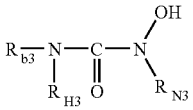

($B_4$)

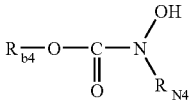

($B_5$)

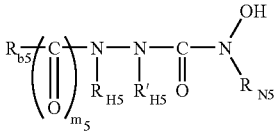

($B_6$)

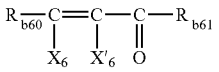

($B_7$)

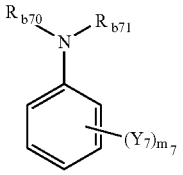

($B_8$)

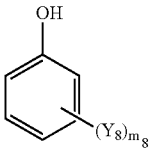

($B_9$)

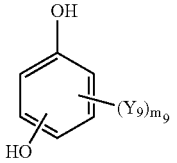

-continued ($B_{10}$)

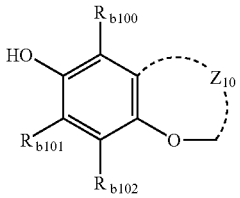

($B_{11}$)

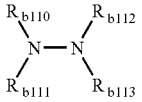

($B_{12}$)

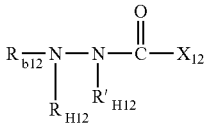

($B_{13}$)

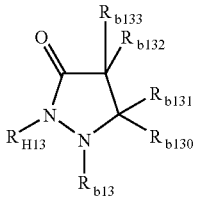

In formulae (B1) to (B13), $R_{b1}$, $R_{b2}$, $R_{b3}$, $R_{b4}$, $R_{b5}$, $R_{b70}$, $R_{b71}$, $R_{b110}$, $R_{b111}$, $R_{b112}$, $R_{b113}$, $R_{b12}$, $R_{b13}$, $R_{N1}$, $R_{N2}$, $R_{N3}$, $R_{N4}$, and $R_{N5}$ represent a hydrogen atom, an alkyl group, an aryl group or a heterocyclic ring group; and $R_{H3}$, $R_{H5}$, $R'_{H5}$, $R_{H12}$, $R'_{H12}$, and $R_{H13}$ represent a hydrogen atom, an alkyl group, an aryl group, an acyl group, an alkylsulfonyl group or an arylsulfonyl group; and among them, $R_{H3}$ may still more represent a hydroxy group. $R_{b100}$, $R_{b101}$, $R'_{b102}$, and $R_{b130}$ to $R_{b133}$ represent a hydrogen atom or a substituent. $Y_7$ and $Y_8$ represent a substituent except for a hydroxy group and $Y_9$ represents a substituent and $m_5$ represents 0 or 1 and $m_7$ represents an integer from 0 to 5 and $m_8$ represents an integer from 1 to 5 and $m_9$ represents an integer from 0 to 4. $Y_7$, $Y_8$ and $Y_9$ may still more represent an aryl group condensed to a benzene ring (e.g., a benzene condensed ring) and further more may have a substituent. $Z_{10}$ represents a non-metal atomic group capable to form a ring and X12 represents a hydrogen atom, an alkyl group, an aryl group, a heterocyclic ring group, an alkoxy group, an amino group (an alkylamino group, an arylamino group, an amino group substituted to a heterocyclic ring or a cyclic amino group are contained) and a carbamoyl group.

In formula (B6), $X_6$ and $X'_6$ each represent a hydroxy group, an alkoxy group, a mercapto group, an alkylthio group, an amino group (an alkylamino group, an arylamino group, an amino group substituted to a heterocyclic ring group or a cyclic amino group are contained), an acylamino group, a sulfonamide group, an alkoxycarbonylamino group, an ureido group, an acyloxy group, an acylthio group, an alkylaminocarbonyloxy group or an arylaminocarbonyloxy group. $R_{b60}$ and $R_{b61}$ represent an alkyl group, an aryl group, an amino group, an alkoxy group and an aryloxy group and $R_{b60}$ and $R_{b61}$ may bind each other to form a cyclic structure. In the explanation of each group in above formula (B1) to (B13), an alkyl group means a straight chain, branched chain or cyclic and a substituted or unsubstituted alkyl group having 1 to 30 carbon atoms and an aryl group means a monocyclic or condensed and a substituted or unsubstituted aromatic alicyclic ring such as a phenyl group and a naphthyl group and a heterocyclic ring group means an aromatic or nonaromatic and a monocyclic or condensed and a substituted or unsubstituted heterocyclic ring group having at least one hetero atom.

And the substituent described in the explanation of each substituent in formula (B1) to (B13) means the same as the substituent for an adsorptive group described above. These substituents may be more substituted by these substituents.

In formula (B1) to (B5), $R_{N1}$, $R_{N2}$, $R_{N3}$, $R_{N4}$ and $R_{N5}$ are preferably a hydrogen atom or an alkyl group and herein, an alkyl group is preferably a straight, branched or cyclic and a substituted or unsubstituted alkyl group having 1 to 12 carbon atoms and more preferably a straight, branched or cyclic and a substituted or unsubstituted alkyl group having 1 to 6 carbon atoms such as a methyl group, an ethyl group, a propyl group, a benzyl group and the like.

In formula (B1), $R_{b1}$ is preferably an alkyl group and a heterocyclic ring group and herein, an alkyl group means a straight, branched or cyclic and a substituted or unsubstituted alkyl group and is preferably an alkyl group having 1 to 30 carbon atoms and more preferably an alkyl group having 1 to 8 carbon atoms. A heterocyclic ring group means a 5 or 6 membered monocyclic or condensed ring and an aromatic or nonaromatic heterocyclic ring group and may have a substituent. As a heterocyclic ring group, an aromatic heterocyclic ring group is preferable, for examples, a pyridine ring group, a pyrimidine ring group, a triazine ring group, a thiazole ring group, a benzothiazole ring group, an oxazole ring group, a benzoxazole ring group, an imidazole ring group, a benzimidazole ring group, a pyrazole ring group, an indazole ring group, an indole ring group, a purine ring group, a quinoline ring group, an isoquinoline ring group, a quinazoline ring group and the like are described. Especially, a triazine ring group and a benzothiazole ring group are preferable. The case, wherein an alkyl group or a heterocyclic ring group represented by $R_{b1}$ further has one or two or more of —NH($R_{N1}$)OH group as its substituent is one of preferred embodiments of the compound represented by formula (B1).

In formula (B2), $R_{b2}$ is preferably an alkyl group, an aryl group or a heterocyclic ring group and more preferably is an alkyl group or an aryl group. Preferred range of alkyl group is similar to that in the explanation of $R_{b1}$. As an aryl group, a phenyl group or a naphthyl group is preferable and a phenyl group is particularly preferable and may have a substituent. The case, wherein the group represented by $R_{b2}$ further has one or two or more of —NH($R_{N2}$)OH group as its substituent is one of preferred embodiments of the compound represented by formula (B2).

In formula (B3), $R_{b3}$ is preferably an alkyl group or an aryl group, wherein a preferred range thereof is similar to that in the explanation of $R_{b1}$ and $R_{b2}$. $R_{H3}$ is preferably a hydrogen atom, an alkyl group or a hydroxy group and more preferably a hydrogen atom. The case, wherein the group represented by $R_{b3}$ further has one or two or more of —NH($R_{N3}$)CON($R_{N3}$)OH group as its substituent is one of preferred embodiments of the compound represented by formula (B3). And $R_{b3}$ and $R_{N3}$ may bind each other to form a cyclic structure (preferably a 5 or 6 membered saturated heterocyclic ring).

In formula (B4), $R_{b4}$ is preferably an alkyl group, wherein a preferred range thereof is similar to that in the explanation of $R_{b1}$. The case where the group represented by $R_{b4}$ further has one or two or more of —OCON($R_{N4}$)OH group as its substituent is one of preferred embodiments of the compound represented by formula (B4).

In formula (B5), $R_{b5}$ preferably is an alkyl group or an aryl group and more preferably is an aryl group, wherein a preferred range is similar to that in the explanation of $R_{b1}$ and $R_{b2}$. $R_{H5}$ and $R'_{H5}$ are preferably a hydrogen atom or an alkyl group and more preferably a hydrogen atom.

In formula (B6), it is preferred that $R_{b60}$ and $R_{b61}$ bind each other to form a cyclic structure. The cyclic structure formed herein is 5 to 7 membered nonaromatic carbon ring or a heterocyclic ring and may be monocyclic or condensed ring. As typical examples of preferred cyclic structure, a 2-cyclopentene-1-one ring, a 2,5-dihydrofurane-2-one ring, a 3-pyrroline-2-one ring, a 4-pyrazoline-3-one ring, a 2-cyclohexene-1-one ring, a 4-pyrazoline-3-one ring, a 2-cyclohexene-1-one ring, a 5,6-dihydro-2H-pyrane-2-one ring, a 5,6-dihydro-2-pyridone ring, a 1,2-dihydronaphthalene-2-one ring, a cumarin ring (a benzo-□-pyrane-2-one ring), a 2-quinolone ring, a 1,4-dihydronaphthalene-1-one ring, a chromone ring (a benzo-□-pyrane-4-one ring), a 4-quinolone ring, an indene-1-one ring, a 3-pyrroline-2,4-dione ring, an uracil ring, a thiouracil ring, a dithiouracil ring and the like are described and a 2-cycolopentene-1-one ring, a 2,5-dihydrofurane-2-one ring, 3-pyrroline-2-one ring, a 4-pyrazoline-3-one ring, a 1,2-dihydronaphthalene-2-one ring, a cumarin ring (a benzo-□-pyrane-2-one ring), a 2-quinolone ring, a 1,4-dihydronaphthalene-1-one ring, a chromone ring (a benzo-□-pyrane-4-one ring), a 4-quinolone ring, an indene-1-one ring, a dithiouracil ring and the like are more preferably and a 2-cycolopentene-1-one ring, a 2,5-dihydrofurane-2-one ring, a 3-pyrroline-2-one ring, an indene-1-one ring and a 4-pyrazoline-3-one ring are still more preferable.

When $X_6$ and $X'_6$ represent a cyclic amino group, a cyclic amino group means a nonaromatic nitrogen atom containing heterocyclic ring group bound at a nitrogen atom, e.g., a pyrrolidino group, a pyperidino group, a pyperadino group, a morphorino group, a 1,4-thiazine-4-yl group, a 2,3,5,6-tetrahydro-1,4-thiazine-4-yl group, an indolyl group and the like are included.

As $X_6$ and $X'_6$, a hydroxy group, a mercapto group, an amino group (an alkylamino group, an arylamino group or a cyclic amino group are contained), an acylamino group, a sulfonamide group, or an acyloxy group and an acylthio group are preferable and a hydroxy group, a mercapto group, an amino group, an alkylamino group, a cyclic amino group, a sulfonamide group, an acylamino group or an acyloxy group are more preferable and a hydroxy group, an amino group, an alkylamino group and a cyclic amino group are particularly preferable. Further, it is preferred that at least one of $X_6$ and $X'_6$ is a hydroxy group.

In formula (B7), $R_{b70}$ and $R_{b71}$ preferably are a hydrogen atom, an alkyl group or an aryl group and more preferably an alkyl group. The preferred range of alkyl group is similar to that in the explanation of $R_{b1}$. $R_{b70}$ and $R_{b71}$ may bind each other to form a cyclic structure (e.g., a pyrrolidine ring, a pyperidine ring, a morphorino ring, a thiomorphorino ring and the like). As the substituent represented by $Y_7$, an alkyl group (that preferred range is the same as the explanation of $R_{b1}$), an alkoxy group, an amino group, an acylamino group, a sulfonamide group, an ureido group, an acyl group, an alkoxycarbonyl group, a carbamoyl group, a sulfamoyl group, a chlorine atom, a sulfo group or the salt thereof, a carboxy group or the salt thereof and the like are preferable and $m_7$ preferably represents integer from 0 to 2.

In formula (B8), $m_8$ preferably is integer from 1 to 4 and the plural $Y_8$ may be same or different. $Y_8$ in the case, wherein $m_8$ is 1 or at least one of the plural $Y_8$ in the case, wherein $m_8$ is 2 or more, is preferably an amino group (an alkylamino group and an arylamino group are contained), a sulfonamide group or an acylamino group. In the case, wherein $m_8$ is 2 or more, remaining $Y_8$ is preferably a sulfonamide group, an acylamino group, an ureido group, an alkyl group, an alkylthio group, an acyl group, an alkoxycarbonyl group a carbamoyl group, a sulfo group or the salt thereof, a carboxy group or the salt thereof, a chlorine atom and the like. Herein, in the case, wherein o'-(or p'-)hydroxyphenylmethyl group (may have more substituents) is substituted at the ortho or para position toward a hydroxy group as the substituent represented by $Y_8$, these compounds represent a compound group generally called as a bisphenol. The said compound is one of the preferred examples represented by formula (B8) too. Further, the case, wherein $Y_8$ represent a benzene condensed ring and results to represent naphthols for formula (B8) is very preferable.

In formula (B9), the substitution position of two hydroxy groups may be each other an ortho position (catechols), a meta position (resorcinols) or a para position (hydroquinones). $m_9$ is preferably 1 or 2 and the plural $Y_9$ may be the same or different. As preferred substituents represented by $Y_9$, a chlorine atom, an acylamino group, an ureido group, a sulfonamide group, an alkyl group, an alkylthio group, an alkoxy group, an acyl group, an alkoxycarbonyl group, a carbamoyl group, a sulfo group or the salt thereof, a carboxy group or the salt thereof, a hydroxy group, an alkylsulfonyl group, an arylsulfonyl group and the like are described. The case where $Y_9$ represents a benzene condensed ring and results to represent 1,4-naphthohydroquinones for formula (B9) is also preferable. When formula (B9) represents catechols, $Y_9$ is particularly preferably a sulfo group or the salt thereof and a hydroxy group.

In formula (B10), when $R_{b100}$, $R_{b101}$ and $R_{b102}$ represent substituents, preferred examples of substituent are similar to that in preferred examples of $Y_9$. Among them, an alkyl group (particularly a methyl group) is preferable. As preferred examples of a cyclic structure to form $Z_{10}$, are a chroman ring and a 2,3-dihydrobenzofurane ring are described and these cyclic structures may have a substituent and may form a spiro ring.

In formula (B11), as preferred examples of $R_{b111}$, $R_{b112}$ and $R_{b113}$ are an alkyl group, an aryl group or a heterocyclic ring group and their preferred ranges are similar to that in the explanation of $R_{b1}$ and $R_{b2}$. Among them, an alkyl group is preferable and two alkyl groups in $R_{b110}$ to $R_{b113}$ may bind to form a cyclic structure. Herein, a cyclic structure means 5 to 7 membered nonaromatic heterocyclic ring, e.g., a pyrrolidine ring, a pyperidine ring, a morphorino group, a thiomorphorino group, a hexahydropyridazine ring and the like.

In formula (B12), $R_{b12}$ preferably is an alkyl group, an aryl group or a heterocyclic ring group and their preferred ranges are similar to that in the explanation of $R_{b1}$ and $R_{b2}$. $X_{12}$ preferably is an alkyl group, an aryl group (particularly a phenyl group), a heterocyclic ring group, an alkoxy group, an amino group (an alkylamino group, an arylamino group, an amino group sunstitiuted to a heterocyclic ring or a cyclic amino group are contained), and a carbamoyl group and more preferably is an alkyl group (particularly, an alkyl group having 1 to 8 carbon atoms is preferable), an aryl group (particularly, a phenyl group is preferable), an amino group (an alkylamino group, an arylamino group or a cyclic amino group are contained). $R_{H12}$ and $R'_{H12}$, preferably are a hydrogen atom or an alkyl group and more preferably are a hydrogen atom.

In formula (B13), $R_{b13}$ preferably is an alkyl group or an aryl group and their preferred ranges are similar to that in the explanation of $R_{b1}$ and $R_{b2}$. $R_{b130}$, $R_{b131}$, $R_{b132}$ and $R_{b133}$ preferably are a hydrogen atom, an alkyl group (particularly, an alkyl group having 1 to 8 carbon atoms are preferable) and an aryl group (particularly, a phenyl group is preferable). $R_{H13}$ preferably is a hydrogen atom or an acyl group and more preferably is a hydrogen atom.

In formula (I), a reducible group represented by B preferably is hydroxylamines, hydroxamic acids, hydroxyureas, hydroxysemicarbazides, phenols, hydrazines, hydrazides and phenidones and more preferably is hydroxyureas, hydroxysemicarbazides, phenols, hydrazides and phenidones.

The oxidation potential of a reducible group represented by B in formula (I), can be measured by using the measuring method described in Akira Fujishima, "DENKIKAGAKU SOKUTEIHO", pages 150 to 208, GIHODO SHUPPAN and NIHON KAGAKUKAI, "ZIKKEN KAGAKUKOUZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E½) can be calculated by that obtained voltamograph.

When a reducible group represented by B in the present invention is measured by the method described above, an oxidation potential preferably is in the range of about −0.3 V to about 1.0 V, more preferably about −0.1 V to about 0.8 V, and most preferably about 0 V to about 0.7 V.

Most of the reducible groups represented by B in the present invention are known in the photographic industry and those examples are described in the following patents. For example, JP-A Nos. 200142466, 8-114884, 8-314051, 8-333325, 9-133983, 11-282117, 10-246931, 10-90819, 9-54384, 10-171060 and 7-77783 can be described. And as an example of phenols, the compound described in U.S. Pat. No. 6,054,260 is described too.

The compound of formula (I) in the present invention may have the ballasted group or polymer chain in it generally used in the nonmoving photographic additives as a coupler. And as a polymer, for example, the polymer described in JP-A No. 1-100530 can be described.

The compound of formula (I) in the present invention may be bis or tris type of compound. The molecular weight of the compound represented by formula (I) in the present invention is preferably 100 to 10000 and more preferably 120 to 1000 and particularly preferably 150 to 500.

The examples of the compound represented by formula (I) in the present invention are shown below, but the present invention is not limited in these. The compounds shown in JP-A Nos. 2000-330247 and 2001-42446 are also preferable examples.

(1)
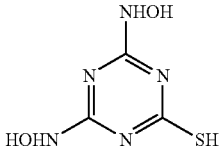
(2)
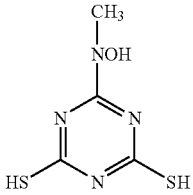
(3)
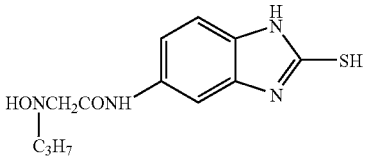
(4)
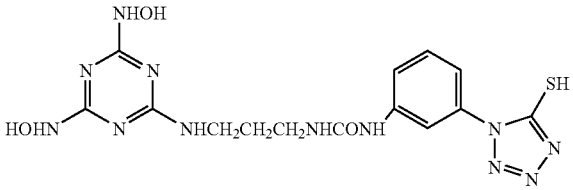
(5)
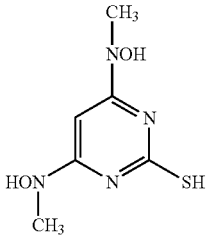
(6)
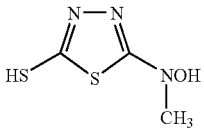
(7)
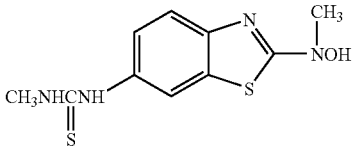
(8)
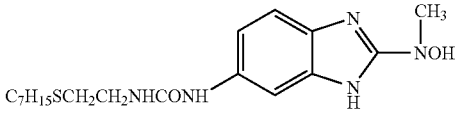
(9)
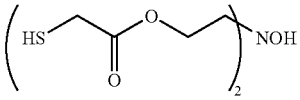
-continued
(10)
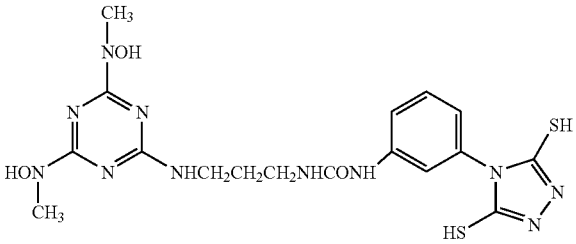
(11)
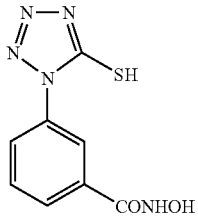
(12)
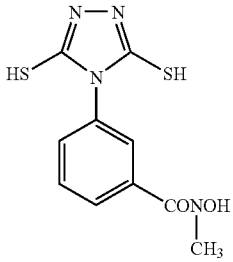
(13)
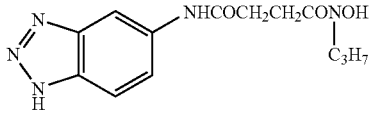
(14)
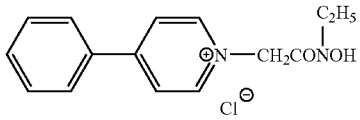
(15)
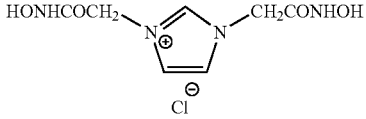
(16)
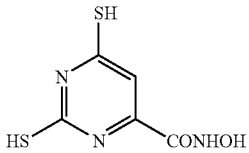
(17)
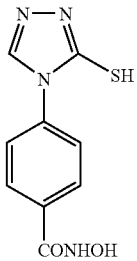

-continued
(18)
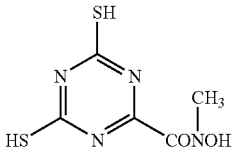
(19)
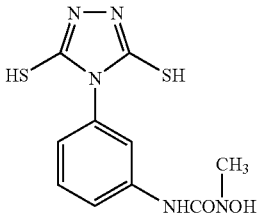
(20)
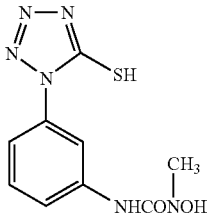
(21)
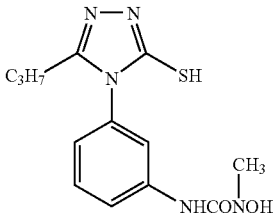
(22)
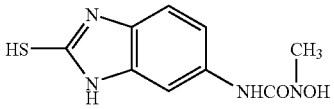
(23)
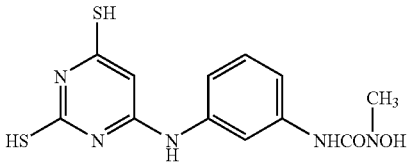
(24)
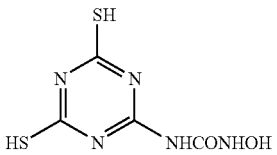
(25)
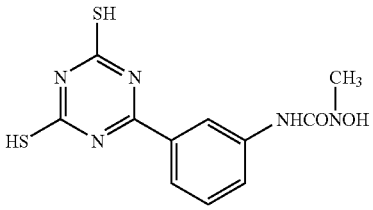
-continued
(26)
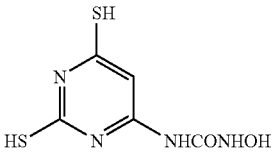
(27)
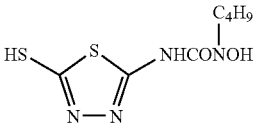
(28)
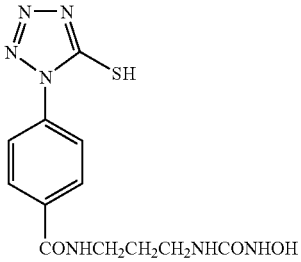
(29)
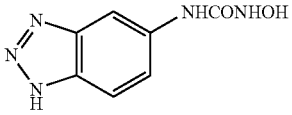
(30)
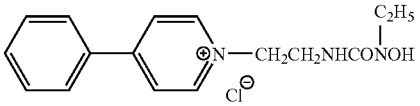
(31)
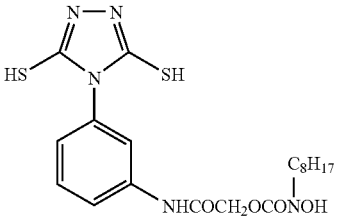
(32)
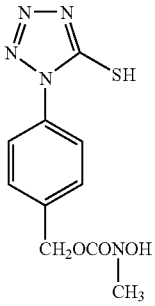
(33)
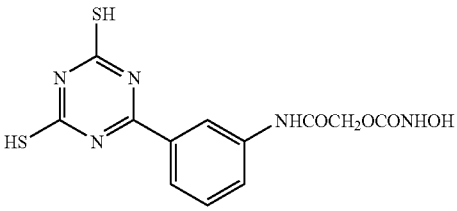

-continued
(34)
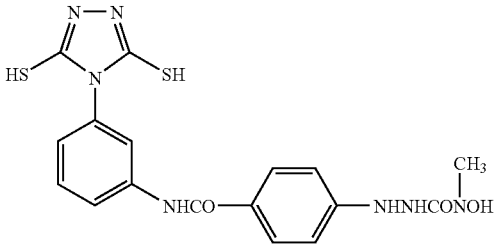
(35)
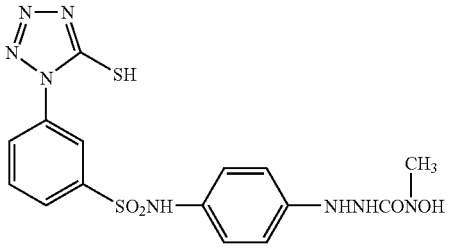
(36)
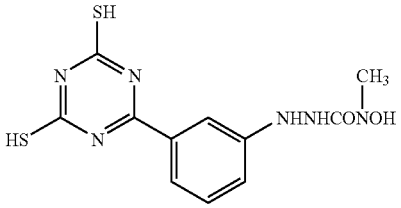
(37)
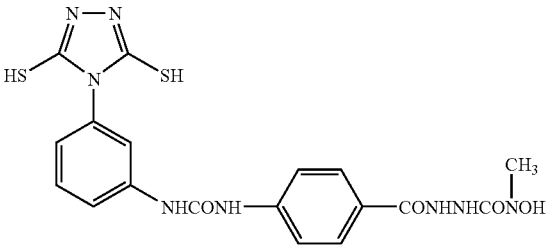
(38)
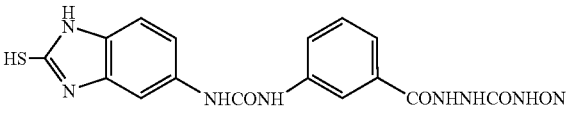
(39)
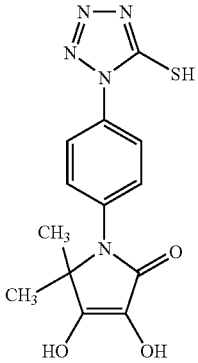
-continued
(40)
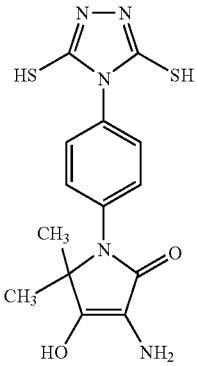
(41)
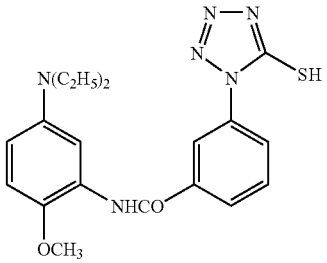
(42)
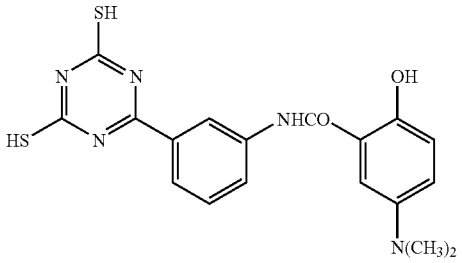
(43)
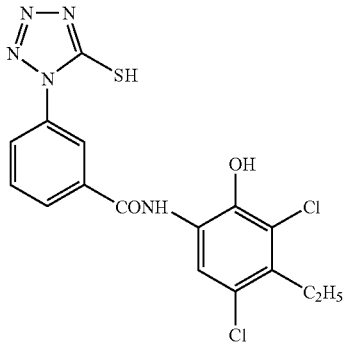
(44)
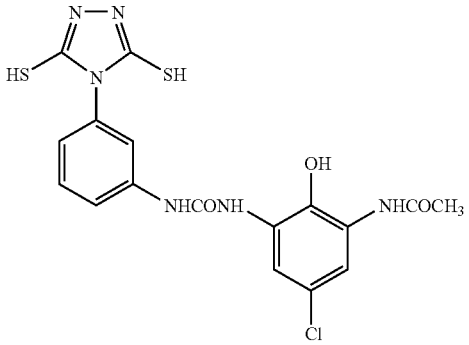

-continued
(45)
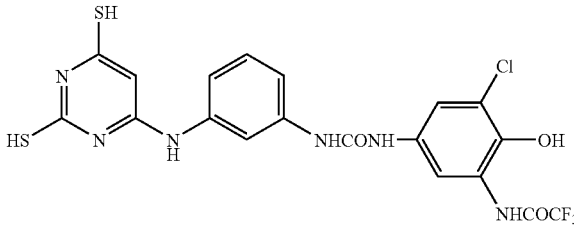
(46)
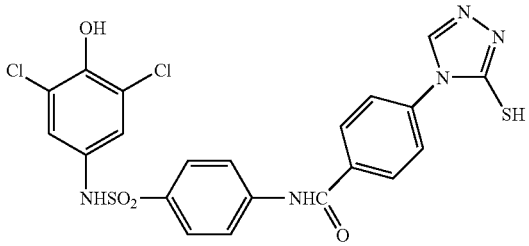
(47)
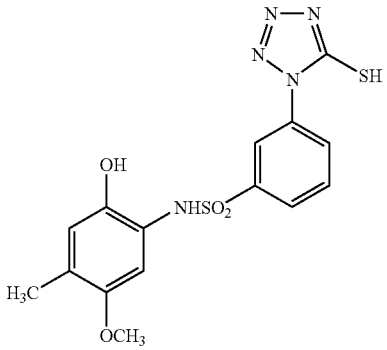
(48)
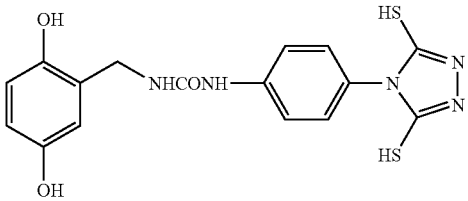
(49)
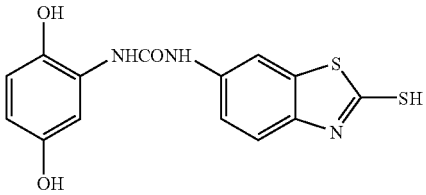
(50)
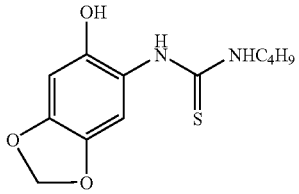
-continued
(51)
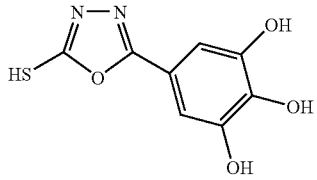
(52)
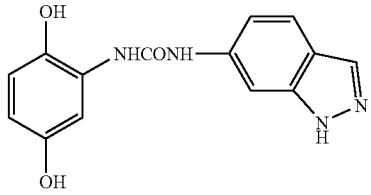
(53)
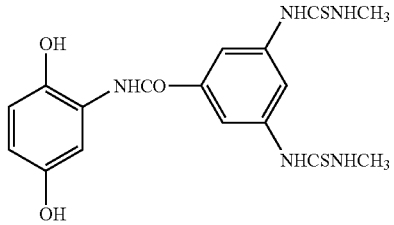
(54)
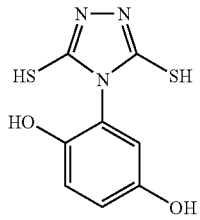
(55)
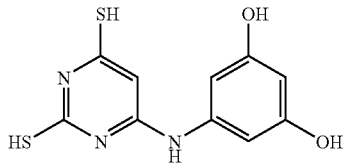
(56)
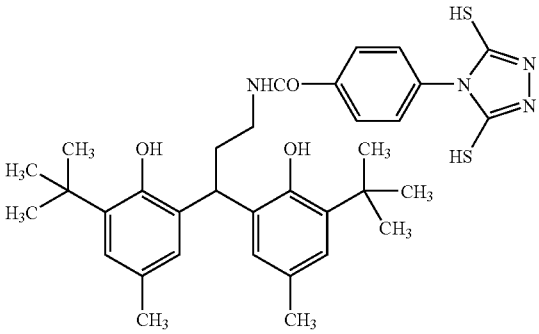
(57)
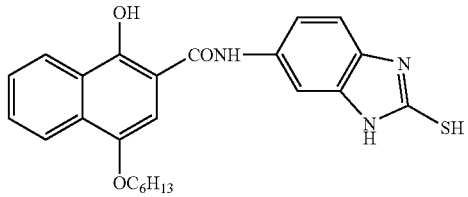

-continued
(58)
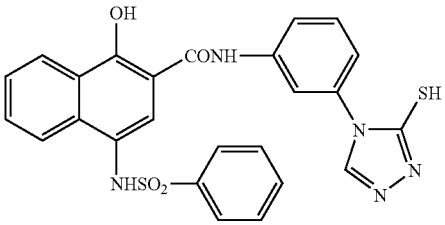
(59)
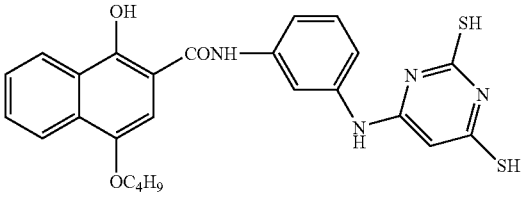
(60)
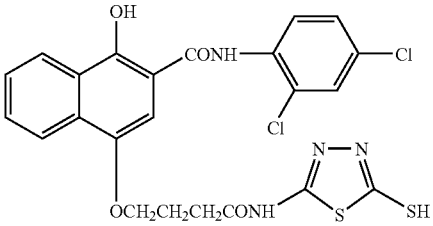
(61)
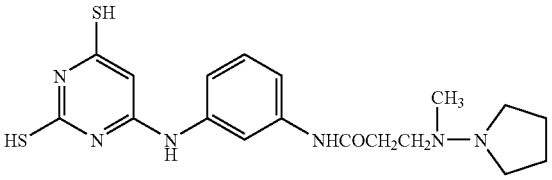
(62)
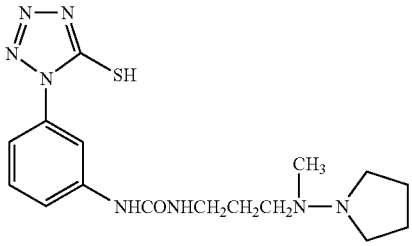
(63)
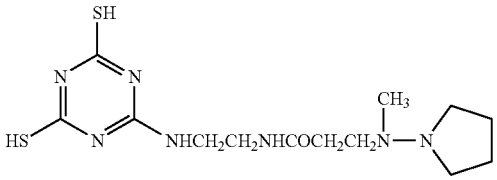
(64)
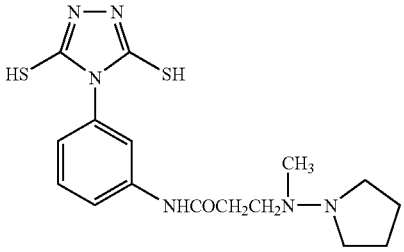
-continued
(65)
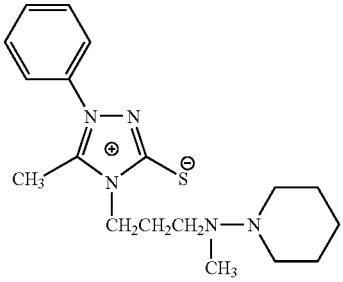
(66)
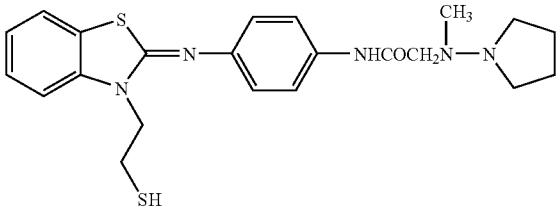
(67)
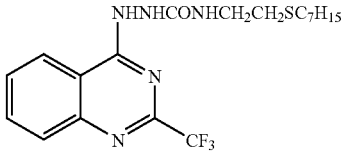
(68)
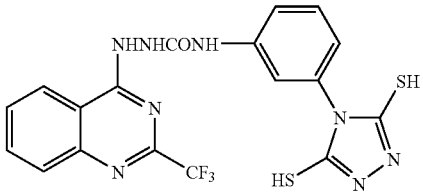
(69)
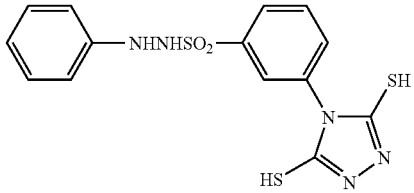
(70)
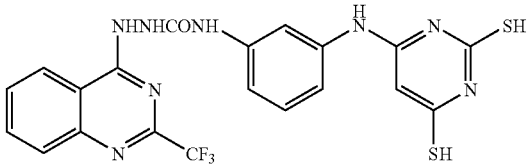
(71)
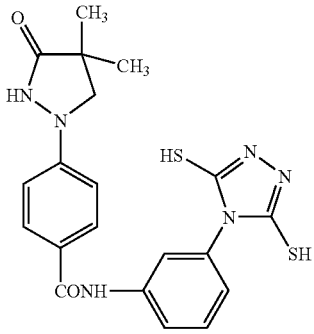

-continued
(72)
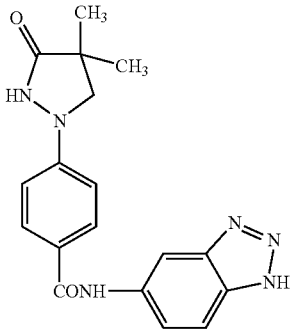
(73)
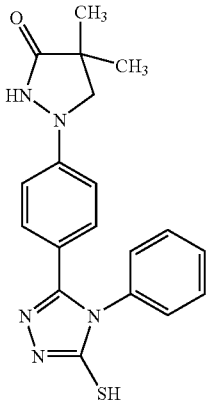
(74)
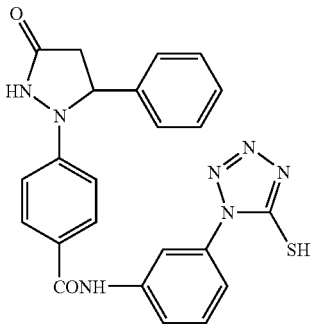
(75)
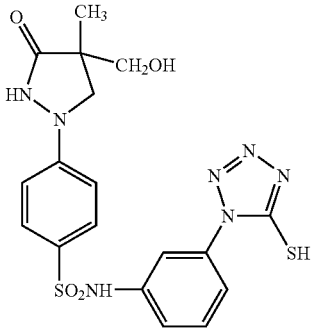
-continued
(76)
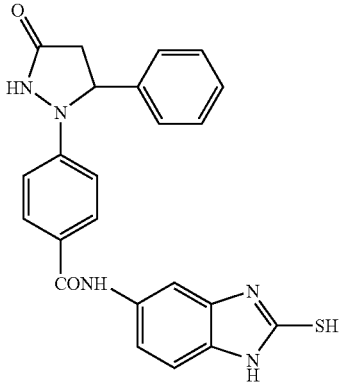
(77)
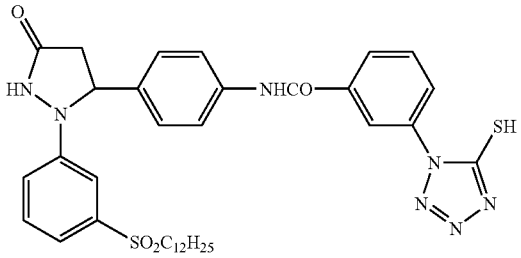
(78)
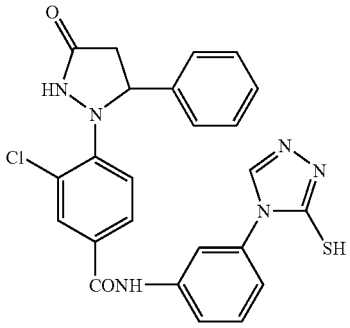
(79)
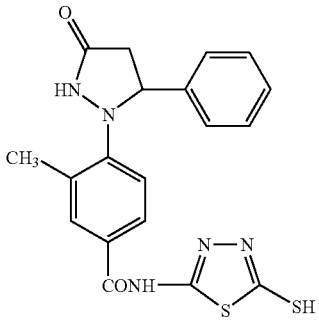
(80)
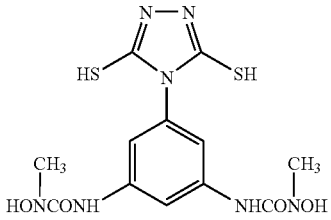

-continued (81)

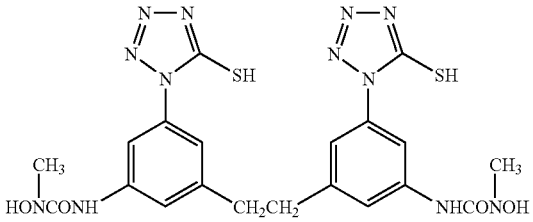

(82)

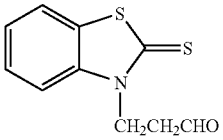

(83)

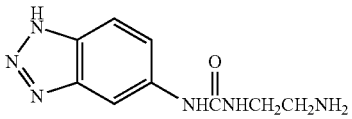

(84)

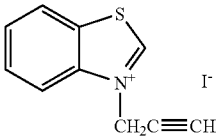

(85)

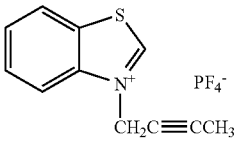

(86)

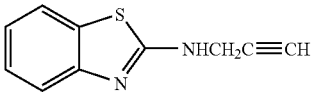

(87)

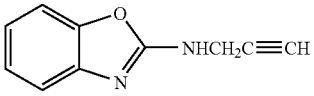

(88)

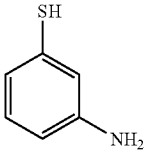

(89)

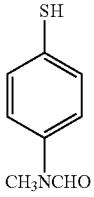

(90)

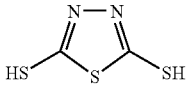

-continued (91)

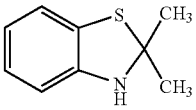

(92)

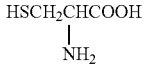

(93)

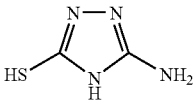

(94)

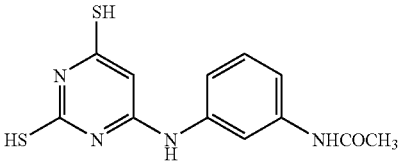

(95)

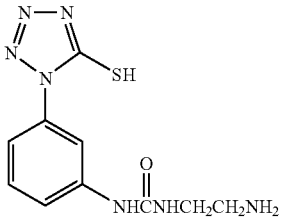

(96)

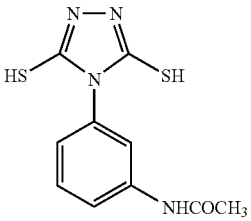

These compounds can be easily synthesized by the known method.

The compound of formula (I) in the present invention can be used independently as only one compound, but it is preferred to use two compounds or more in combination. When two or more types of compounds are used in combination, those may be added to the same layer or the different layers, whereby addition methods may be different from each other.

The compound represented by formula (I) in the present invention preferably is added to a image forming layer and more preferably is to be added at an emulsion making process. In the case, wherein these compounds are added at an emulsion making process, these compounds may be added at any step in the process. For example, the silver halide grain forming step, a step before starting of salt washing-out step, the salt washing-out step, the step before chemical ripening, the chemical ripening step, the step before prepraring a final emulsion and the like are described. Also, the addition can be performed in the plural divided steps in the process. It is preferred to be added in an image forming layer, but also to be diffused at a coating step from a protective layer or an intermediate layer adjacent to the image forming layer, wherein these compounds are added in the protective layer or the intermediate layer in combination with their addition to the image forming layer.

The preferred addition amount is largely depend on the addition method or the type of compound described above, but generally $1\times10^{-6}$ mol to 1 mol, preferably $1\times10^{-5}$ mol to $5\times10^{-1}$ mol, and more preferably $1\times10^{-4}$ mol to $1\times10^{-1}$ mol, per one mol of photosensitive silver halide in each case.

The compound represented by formula (I) in the present invention can be added by dissolving in water or water-soluble solvent such as methanol, ethanol and the like or a mixed solution thereof. At this time, pH may be arranged suitably by an acid or an alkaline and a surfactant can be coexisted. Further, these compounds may be added as an emulsified dispersion by dissolving in an organic solvent having a high boiling point and also may be added as a solid dispersion.

11) Combined use of a Plurality of Silver Halides

The photosensitive silver halide emulsion in the photosensitive material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the coating amount of silver per one $m^2$ of the photothermographic material, is preferably from 0.03 $g/m^2$ to 0.6 $g/m^2$, more preferably, 0.05 $g/m^2$ to 0.4 $g/m^2$ and, further preferably, 0.07 $g/m^2$ to 0.3 $g/m^2$. The photosensitive silver halide is used by 0.01 mol to 0.5 mol, preferably, 0.02 mol to 0.3 mol, and further preferably 0.03 mol to 0.2 mol per one mol of the organic silver salt.

13) Mixing Silver Halide and Organic Silver Salt

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more kinds of aqueous dispersions of organic silver salts and two or more kinds of aqueous dispersions of photosensitive silver salts upon mixing is used preferably for controlling the photographic properties.

14) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai kongou gijutu" by N. Harnby and M. F. Edwards, translated by Kouji Takahashi (Nikkankougyou shinbunsya, 1989).

(Binder)

Any type of polymer may be used as the binder for the layer containing organic silver salt in the photothermographic material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly (vinyl alcohol), hydroxyethyl cellulose, cellulose acetate, cellulose acetate butyrate, poly (vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly (vinyl acetal)(e.g., poly(vinyl formal) and poly(vinyl butyral)), poly(ester), poly(urethane), phenoxy resin, poly (vinylidene chloride), poly(epoxide), poly(carbonate), poly (vinyl acetate), poly(olefin), cellulose esters, and poly(amide). A binder may be used with water, an organic solvent or emulsion to form a coating solution.

In the invention, the Tg of the binder of the layer including organic silver salts is preferably from 0° C. to 80° C., more preferably, from 10° C. to 70° C., further preferably, from 15° C. to 60° C. In the specification, Tg was calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition)(Wiley-Interscience, 1989).

The polymer used for the binder maybe of two or more kinds of polymers, if necessary. And, the polymer having Tg more than 20° C. and the polymer having Tg less than 20° C. can be used in combination. In a case that two types or more of polymers differing in Tg may be blended for use, it is preferred that the weight-average Tg is in the range mentioned above.

In the invention, it is preferred that the layer containing organic silver salt is formed by first applying a coating solution containing 30% by weight or more of water in the solvent and by then drying.

In the case the layer containing organic silver salt is formed by first applying a coating solution containing 30% by weight or more of water in the solvent and by then drying, and furthermore, in the case the binder of the layer containing organic silver salt is soluble or dispersible in an aqueous solvent (water solvent), the performance can be ameliorated particularly in the case a polymer latex having an equilibrium water content of 2% by weight or lower under 25° C. and 60% RH is used. Most preferred embodiment is such prepared to yield an ion conductivity of 2.5 mS/cm or lower, and as such a preparation method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like. The term aqueous solvent is also used in the case the polymer is not thermodynamically dissolved, but is present in a so-called dispersed state.

The term "equilibrium water content under 25° C. and 60% RH" as referred herein can be expressed as follows:

Equilibrium water content under 25° C. and $$60\%\ RH = [(W1 - W0)/W0] \times 100(\%\ \text{by weight})$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in the range from 1 nm to 50,000 nm, preferably 5 nm to 1,000 nm, more preferably 10 nm to 500 nm, and further preferably 50 nm to 200 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image forming layer, and those having too large molecular weight are also not preferred because the filming properties result poor. Further, crosslinking polymer latexes are particularly preferred for use.

1) Examples of Latex

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latex above may be used alone, or may be used by blending two types or more depending on needs.

2) Preferable Latex

Particularly preferable as the polymer latex for use in the invention is that of styrene-butadiene copolymer. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Moreover, the polymer latex of the invention contains acrylic acid or methacrylic acid, preferably, in the range from 1% by weight to 6% by weight, and more preferably, from 2% by weight to 5% by weight, with respect to the total weight of the monomer unit of styrene and that of butadiene. The preferred range of the molecular weight is the same as that described above.

As the latex of styrene-butadiene copolymer preferably used in the invention, there can be mentioned P-3 to P-8 and P-15, or commercially available LACSTAR-3307B, 7132C, Nipol Lx416, and the like.

In the layer containing organic silver salt of the photosensitive material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by weight or less, preferably 20% by weight or less, with respect to the total weight of the binder incorporated in the layer containing organic silver salt.

According to the invention, the layer containing organic silver salt (image forming layer) is preferably formed by using polymer latex for the binder. According to the amount of the binder for the layer containing organic silver salt, the weight ratio for total binder to organic silver salt (total binder/organic silver salt) is preferably in the range of 1/10 to 10/1, more preferably 1/3 to 5/1, and further preferably 1/1 to 3/1.

The layer containing organic silver salt is, in general, a photosensitive layer (image forming layer) containing a photosensitive silver halide, i.e., the photosensitive silver salt; in such a case, the weight ratio for total binder to silver halide (total binder/silver halide) is in the range of from 400 to 5, more preferably, from 200 to 10.

The total amount of binder in the image forming layer of the invention is preferably in the range from 0.2 $g/m^2$ to 30 $g/m^2$, more preferably from 1 $g/m^2$ to 15 $g/m^2$, and further preferably from 2 $g/m^2$ to 10 $g/m^2$. As for the image forming layer of the invention, there may be added a crosslinking agent for crosslinking, or a surfactant and the like to improve coating properties.

3) Preferable Solvent for Coating Solution

In the invention, a solvent of a coating solution for a layer containing organic silver salt (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more and still more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975. Furthermore, the antifoggant preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (II) in JP-A No. 10-339934, and organic polyhalogen compounds described in JP-A Nos. 2001-31644 and 2001-33911 are preferred.

1) Organic Polyhalogen Compound

Organic polyhalogen compounds preferably used in the invention are specifically described below. In the invention, preferred organic polyhalogen compounds are the compounds expressed by formula (H) below:

$$Q\text{-}(Y)_n\text{—}C(Z_1)(Z_2)X \qquad \text{Formula (H)}$$

In formula (H), Q represents an alkyl group, an aryl group, or a heterocyclic group; Y represents a divalent connecting group; n represents 0 or 1; $Z_1$ and $Z_2$ represent a halogen atom; and X represents a hydrogen atom or an electron attracting group.

In formula (H), Q is preferably an aryl group, or a heterocyclic group.

In formula (H), in the case that Q is a heterocyclic group, Q is preferably a nitrogen containing heterocyclic group having 1 or 2 nitrogen atoms and particularly preferably 2-pyridyl group and 2-quinolyl group.

In formula (H), in the case that Q is an aryl group, Q preferably is a phenyl group substituted by an electron-attracting group whose Hammett substitution coefficient σp yields a positive value. For the details of Hammett substitution coefficient, reference can be made to Journal of Medicinal Chemistry, Vol. 16, No. 11 (1973), pp. 1207 to 1216, and the like. As such electron-attracting groups, examples include, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), a cyano group (σp value: 0.66), a nitro group (σp value: 0.78), an aliphatic aryl or heterocyclic sulfonyl group (for example, methanesulfonyl (σp value: 0.72)), an aliphatic aryl or heterocyclic acyl group (for example, acetyl (σp value: 0.50) and benzoyl (σp value: 0.43)), an alkinyl (e.g., C≡CH (σp value: 0.23)), an aliphatic aryl or heterocyclic oxycarbonyl group (e.g., methoxycarbonyl (σp value: 0.45) and phenoxycarbonyl (σp value: 0.44)), a carbamoyl group (σp value: 0.36), sulfamoyl group (σp value: 0.57), sulfoxido group, heterocyclic group, and phosphoryl group. Preferred range of the σp value is from 0.2 to 2.0, and more preferably, from 0.4 to 1.0. Preferred as the electron attracting groups are carbamoyl group, an alkoxycarbonyl group, an alkylsulfonyl group, and an alkylphosphoryl group, and particularly preferred among them is carbamoyl group.

X preferably is an electron-attracting group, more preferably, a halogen atom, an aliphatic aryl or heterocyclic sulfonyl group, an aliphatic aryl or heterocyclic acyl group, an aliphatic aryl or heterocyclic oxycarbonyl group, carbamoyl group, or sulfamoyl group; particularly preferred among them is a halogen atom. Among halogen atoms, preferred are chlorine atom, bromine atom, and iodine atom; more preferred are chlorine atom and bromine atom; and particularly preferred is bromine atom.

Y preferably represents —C(═O)—, —SO—, or —$SO_2$—; more preferably, —C(═O)— or —$SO_2$—; and particularly preferred is —$SO_2$—. N represents 0 or 1, and preferred is 1.

Specific examples of the compounds expressed by formula (H) of the invention are shown below.

(H-1)

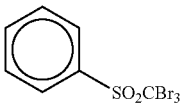

(H-2)

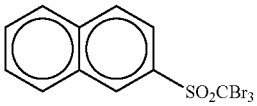

(H-3)

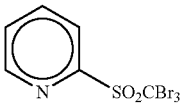

(H-4)

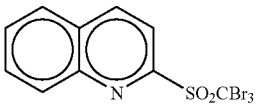

(H-5)

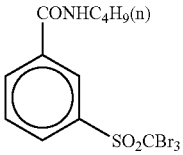

(H-6)

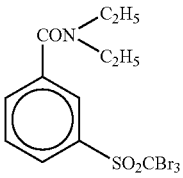

(H-7)

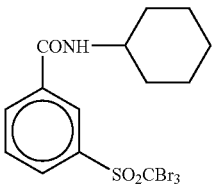

-continued (H-8)

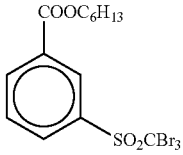

(H-9)

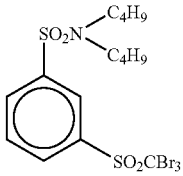

(H-10)

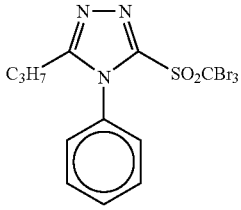

(H-11)

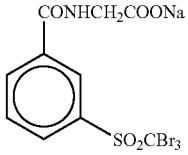

(H-12)

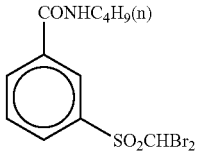

(H-13)

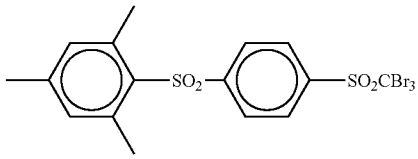

(H-14)

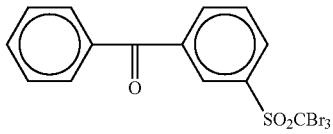

(H-15)

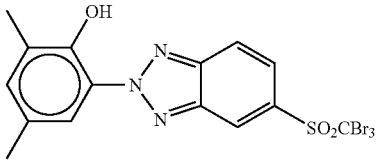

As preferred organic polyhalogen compounds of the invention other than those above, there can be mentioned compounds disclosed in JP-A Nos. 2001-31644, 2001-56526, and 2001-209145.

The compounds expressed by formula (H) of the invention are preferably used in an amount of from $10^{-4}$ mol to 1 mol, more preferably, $10^{-3}$ mol to 0.5 mol, and further preferably, $10^{-2}$ mol to 0.2 mol, per one mol of non-photosensitive silver salt incorporated in the image forming layer.

In the invention, usable methods for incorporating the antifoggant into the photosensitive material are those described above in the method for incorporating the reducing agent. Furthermore, the organic polyhalogen compound is also preferably used in the form of solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a, 7-tetrazaindene and the like, as described in JP-A No. 6-11791.

The photothermographic material of the invention may further contain an azolium salt in order to prevent fogging. As azolium salts, there can be mentioned a compound expressed by formula (XI) as described in JP-A No. 59-193447, a compound described in JP-B No. 55-12581, and a compound expressed by formula (II) in JP-A No. 60-153039. The azolium salt may be added to any part of the photosensitive material, but as the addition layer, preferred is to select a layer on the side having thereon the photosensitive layer, and more preferred is to select a layer containing organic silver salt. The azolium salt may be added at any time of the process of preparing the coating solution; in the case the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, tone adjusting agents, and the like. In the invention, the azolium salt may be added at any amount, but preferably, it is added in a range of from $1\times10^{-6}$ mol to 2 mol, and more preferably, from $1\times10^{-3}$ mol to 0.5 mol per one mol of silver.

(Other Additives)

1) Mercapto Compounds, Disulfides and Thiones

In the invention, mercapto compounds, disulfide compounds, and thione compounds may be added in order to control the development by suppressing or enhancing development, to improve spectral sensitization efficiency, and to improve storage properties before and after development. Descriptions can be found in paragraph Nos. 0067 to 0069 of JP-A No. 10-62899, a compound expressed by formula (I) of JP-A No. 10-186572 and specific examples thereof shown in paragraph Nos. 0033 to 0052, in lines 36 to 56 in page 20 of EP No. 0803764A1. Among them, mercapto-substituted heterocyclic aromatic compound, which is described in JP-A Nos. 9-297367, 9-304875, 2001-100358, 2002-303954, 2002-303951 and the like, is particularly preferred.

2) Toner

In the photothermographic material of the present invention, the addition of a toner is preferred. The description of the toner can be found in JP-A No. 10-62899 (paragraph Nos. 0054 to 0055), EP-A No. 0803764A1 (page 21, lines 23 to 48), JP-A Nos. 2000-356317 and 2000-187298. Preferred are phthalazinones (phthalazinone, phthalazinone derivatives and metal salts thereof, e.g., 4-(1-naphthyl)phthalazinone,6-chlorophthalazinone, 5,7-dimethoxyphthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate and tetrachlorophthalic anhydride); phthalazines(phthalazine, phthalazine derivatives and metal salts thereof, e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving image tone, preventing the generation of interference fringes and preventing irradiation on laser exposure, various types of dyes and pigments (for instance, C.I. Pigment Blue 60, C.I. Pigment Blue 64, and C.I. Pigment Blue 15:6) may be used in the photosensitive layer of the invention. Detailed description can be found in WO No. 98/36322, JP-A Nos. 10-268465 and 11-338098, and the like.

5) Ultra-high Contrast Promoting Agent

In order to form ultra-high contrast image suitable for use in graphic arts, it is preferred to add an ultra-high contrast promoting agent into the image forming layer. Details on the ultra-high contrast promoting agents, method of their addition and addition amount can be found in paragraph No. 0118, paragraph Nos. 0136 to 0193 of JP-A No. 11-223898, as compounds expressed by formulae (H), (1) to (3), (A), and (B) in JP-A No. 2000-284399; as an ultra-high contrast accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, 1 mmol or less per one mol of silver.

In the case of using an ultra-high contrast promoting agent in the photothermographic material of the invention, it is preferred to use an acid resulting from hydration of diphosphorus pentaoxide, or its salt in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coverage per 1 $m^2$ of the photosensitive material) may be set as desired depending on the sensitivity and fogging, but preferred is an amount of 0.1 mg/m$^2$ to 500 mg/m$^2$, and more preferably, of 0.5 mg/m$^2$ to 100 mg/m$^2$.

The reducing agent, hydrogen bonding compound, development accelerator, and the organic polyhalogen compounds according to the invention are preferably used as solid dispersions, and the method of preparing the solid dispersion is described in JP-A No. 2002-55405.

(Preparation of Coating Solution and Coating)

The temperature for preparing the coating solution for use in the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Other Constituting Components)

The image forming layer of the invention is constructed on a support by one or more layers. In the case of constituting the layer by a single layer, it comprises an organic silver salt, photosensitive silver halide, a reducing agent, and a binder, which may further comprise additional materials as desired if necessary, such as a toner, a coating aid, and other auxiliary agents. In the case of constituting the image forming layer from two or more layers, the first image forming layer (in general, a layer placed adjacent to the support) contains an organic silver salt and a photosensitive silver halide, and some of the other components must be incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the photosensitive layers as described in U.S. Pat. No. 4,460,681.

The photothermographic material according to he invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided to the side opposite to the image forming layer.

Furthermore, a layer that functions as an optical filter may be provided as (a) or (b) above. An antihalation layer may be provided as (c) or (d) to the photosensitive material.

1) Surface Protective Layer

The photothermographic material of the invention may further comprise a surface protective layer with an object to prevent adhesion of the image forming layer. The surface protective layer may be a single layer, or plural layers. Description on the surface protective layer may be found in paragraph Nos. 0119 to 0120 of JP-A No. 11-65021 and in JP-A No. 2000-171936.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.). The coating amount of polyvinyl alcohol (per 1 m of support) in the protective layer (per one layer) is preferably in the range from 0.3 g/m$^2$ to 4.0 g/m$^2$, and more preferably, from 0.3 g/m$^2$ to 2.0 g/m$^2$.

The coverage of total binder (inclusive of water-soluble polymer and latex polymer) (per 1 m$^2$ of support) in the surface protective layer (per one layer) is preferably in the range from 0.3 g/m$^2$ to 5.0 g/m$^2$, and more preferably, from 0.3 g/m$^2$ to 2.0 g/m$^2$.

2) Antihalation Layer

The photothermographic material of the present invention may comprise an antihalation layer provided to the side farther from the light source with respect to the photosensitive layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The amount of adding the thermal bleaching dye is determined depending on the usage of the dye. In general, it is used at an amount as such that the optical density (absorbance) exceeds 0.1 when measured at the desired wavelength. The optical density is preferably in the range from 0.15 to 2, and more preferably from 0.2 to 1. The addition amount of dyes to obtain optical density in the above range is generally from 0.001 g/m$^2$ to 1 g/m$^2$.

By thermal bleaching the dye in such a manner, the optical density after thermal development can be lowered to 0.1 or lower. Two types or more of thermal bleaching dyes may be used in combination in a photothermographic material. Similarly, two types or more of base precursors may be used in combination.

In the case of thermal decolorization by the combined use of a decoloring dye and a base precursor, it is advantageous from the viewpoint of thermal decolorization efficiency to further use the substance capable of lowering the melting point by at least 3° C. when mixed with the base precursor (e.g., diphenylsulfone, 4-chlorophenyl(phenyl)sulfone) as disclosed in JP-A No. 11-352626.

3) Back Layer

Back layers usable in the invention are described in paragraph Nos. 0128 to 0130 of JP-A No. 11-65021.

In the invention, coloring matters having maximum absorption in the wavelength range from 300 nm to 450 nm may be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in the range from 0.1 mg/m$^2$ to 1 g/m$^2$ preferably to the back layer which is provided to the side opposite to the photosensitive layer.

Further, in order to control the basic color tone, it is preferred to use a dye having an absorption peak in the wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming surface side, or in the back surface side.

The photothermographic material of the invention is preferably a so-called one-side photosensitive material, which comprises at least one layer of a photosensitive layer containing silver halide emulsion on one side of the support, and a back layer on the other side.

4) Matting Agent

A matting agent may be preferably added to the photothermographic material of the invention in order to improve transportability. Description on the matting agent can be found in paragraphs Nos. 0126 to 0127 of JP-A No. 11-65021. The amount of adding the matting agents is preferably in the range from 1 mg/m$^2$ to 400 mg/m$^2$, more preferably, from 5 mg/m$^2$ to 300 mg/m$^2$, with respect to the coating amount per one m$^2$ of the photosensitive material.

There is no particular restriction on the shape of the matting agent usable in the invention and it may fixed form or non-fixed form. Preferred is to use those having fixed form and globular shape. Average particle size is preferably in the range of from 0.5 μm to 10 μm, more preferably, from 1.0 μm to 8.0 μm, and most preferably, from 2.0 μm to 6.0 μm. Furthermore, the particle distribution of the matting agent is preferably set as such that the variation coefficient may become 50% or lower, more preferably, 40% or lower, and most preferably, 30% or lower. The variation coefficient, herein, is defined by (the standard deviation of particle diameter)/(mean diameter of the particle)×100. Furthermore, it is preferred to use by blending two types of matting agents having low variation coefficient and the ratio of their mean diameters is more than 3.

The matness on the image forming layer surface is not restricted as far as star-dust trouble occurs, but the matness of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matt degree of the back layer in the invention is preferably in the range of 1200 seconds or less and 10 seconds or more; more preferably, 800 seconds or less and 20 seconds or more; and further preferably, 500 seconds or less and 40 seconds or more, as expressed by Beck smoothness.

In the invention, the matting agent is incorporated preferably in the outermost surface layer on the photosensitive layer plane or a layer functioning as the outermost surface layer, or a layer near to the outer surface, and a layer that functions as the so-called protective layer.

5) Polymer Latex

In the case of the photothermographic material of the invention for graphic arts in which changing of dimension is critical, it is preferred to incorporate polymer latex in the surface protective layer and the back layer. As such polymer latexes, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Ouyou (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid copolymer, a latex of methyl methacrylate (64.0% by weight)/styrene (9.0% by weight)/butyl acrylate (20.0% by weight)/2-hydroxyethyl methacrylate(5.0% by weight)/acrylic acid copolymer, and the like. Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer preferably is contained in an amount of 10% by weight to 90% by weight, particularly preferably, of 20% by weight to 80% by weight of the total weight of binder.

6) Surface pH

The surface pH of the photothermographic material according to the invention preferably yields a pH of 7.0 or lower, more preferably, 6.6 or lower, before thermal development treatment. Although there is no particular restriction concerning the lower limit, the pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No.

4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbun, 1989), and the like.

8) Surfactant

As the surfactant, the solvent, the support, antistatic agent or the electrically conductive layer, and the method for obtaining color images applicable in the invention, there can be mentioned those disclosed in paragraph Nos. 0132, 0133, 0134, 0135, and 0136, respectively, of JP-A No. 11-65021. The lubricant is described in paragraph Nos. 0061 to 0064 of JP-A No. 11-84573.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably. For the photothermographic material in the invention, the fluorocarbon surfactants described in JP-A Nos. 2002-82411 and 2003-57780 are preferably used. Especially, the usage of the fluorocarbon surfactants described in JP-A No. 2003-57780 in an aqueous coating solution is preferred viewed from the standpoint of capacity in static control, stability of the coating side state and sliding facility.

According to the invention, the fluorocarbon surfactant can be used on either side of image forming layer side or back layer side, but is preferred to use on the both sides. Further, it is particularly preferred to use in combination with electrically conductive layer including aforementioned metal oxides. In this case the amount of the fluorocarbon surfactant on the side of the electrically conductive layer can be reduced or removed.

The amount of the fluorocarbon surfactant used is preferably in the range from 0.1 mg/m to 100 mg/m on each side of image forming layer and back layer, more preferably 0.3 $mg/m^2$ to 30 $mg/m^2$, further preferably 1 $mg/m^2$ to 10 $mg/m^2$.

9) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like; Particularly preferred for use is $SnO_2$ combined with Sb. The addition amount of different types of atoms is preferably in the range from 0.01 mol % to 30 mol %, and particularly preferably, in the range from 0.1 mol % to 10 mol %. The shape of the metal oxides can include, for example, spherical, needle-like, or plate-like shape. The needle-like particles, with the rate of (the major axis)/(the minor axis) is 2.0 or more, and more preferably, 3.0 to 50, is preferred viewed from the standpoint of the electric conductivity effect. The metal oxides is used preferably in the range from 1 $mg/m^2$ to 1000 $mg/m^2$, more preferably from 10 $mg/m^2$ to 500 $mg/m^2$, and further preferably from 20 $mg/m^2$ to 200 $mg/m^2$. The antistatic layer can be laid on either side of the image forming layer side or the back layer side, it is preferred to set between the support and the back layer. Examples of the antistatic layer in the invention include described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

10) Support

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and the like. The moisture content of the support is preferably 0.5% by weight or less when coating for image forming layer and back layer is conducted on the support.

11) Other Additives

Furthermore, antioxidant, stabilizing agent, plasticizer, UV absorbent, or a coating aid may be added to the photothermographic material. Each of the additives is added to either of the photosensitive layer or the non-photosensitive layer. Reference can be made to WO No. 98/36322, EP-A No. 803764A1, JP-A Nos. 10-186567 and 10-18568, and the like.

12) Coating Method

The photothermographic material of the invention may be coated by any method. More specifically, various types of coating operations inclusive of extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention is the method described in JP-A Nos. 2001-194748, 2002-153808, 2002-153803, and 2002-182333.

The coating solution for the layer containing organic silver salt in the invention is preferably a so-called thixotropic fluid. For the details of this technology, reference can be made to JP-A No. 11-52509. Viscosity of the coating solution for the layer containing organic silver salt in the invention at a shear velocity of $0.1S^{-1}$ is preferably from 400 mPa·s to 100,000 mPa·s, and more preferably, from 500 mPa·s to 20,000 mPa·s. At a shear velocity of $1000S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in the range from 60° C. to 100° C. at the film surface, and heating time is preferably in the range from 1 second to 60 seconds. More preferably, the temperature of the heat treatment is in the range 70° C. to 90° C. at the film surface and heating time is 2 seconds to 10 seconds. A preferred method of heat treatment for the invention is described in JP-A No. 2002-107872.

Furthermore, the production methods described in JP-A Nos. 2002-156728 and 2002-182333 are favorably used in the invention in order to stably and continuously produce the photothermographic material of the invention.

The photothermographic material is preferably of monosheet type (i.e., a type which can form image on the photothermographic material without using other sheets such as an image-receiving material).

13) Wrapping Material

In order to suppress fluctuation from occurring on the photographic property during a preservation of the photosensitive material of the invention before thermal development, or in order to improve curling or winding tendencies, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}\ day^{-1}$ or lower, and most preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}\ day^{-1}$ or lower, and most preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064 and 2000-171936.

In instances of multi-color photothermographic materials, each photosensitive layer is in general, held distinctively each other by using a functional or nonfunctional barrier layer between each photosensitive layer as described in U.S. Pat. No. 4,460,681.

Constitution of the multi-color photothermographic material may include a combination of these two layers for each color. Alternatively, all ingredients may be included into a single layer as described in U.S. Pat. No. 4,708,928.

(Image Forming Method)

1) Exposure

Although the photosensitive material of the invention may be subjected to exposure by any methods, laser beam is preferred as an exposure light source. As laser beam according to the invention, He—Ne laser of red through infrared emission, red laser diode, or $Ar^+$, He—Ne, He—Cd laser of blue through green emission, blue laser diode can be used. Preferred laser is red to infrared laser diode and the peak wavelength of laser beam is 600 nm to 900 nm, preferably 620 nm to 850 nm.

In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future.

Particularly preferably used as a laser beam in the invention is a blue laser diode, and the peak wavelength of blue laser beam is preferably 300 nm to 500 nm, more preferably 350 nm to 450 nm, and further preferably 390 nm to 430 nm.

Laser beam which oscillates in a longitudinal multiple modulation by a method such as high frequency superposition is also preferably employed.

2) Thermal Development

Although any method may be used for the development of the photothermographic material of the invention, the thermal development process is usually performed by elevating the temperature of the photothermographic material exposed imagewise. The temperature for the development is preferably 80° C. to 250° C., preferably 100° C. to 140° C., and more preferably 110° C. to 130° C. Time period for the development is preferably 1 second to 30 seconds, more preferably 3 seconds to 15 seconds, and further preferably 5 seconds to 12 seconds.

A line speed when the photothermographic material is transported is preferably higher than conventional line speed, and is 20 mm/sec or higher, and more preferably, 23 mm/sec or higher. The upper limit is determined by the plan of the apparatus, and line speed can be selected from the range where the aforementioned time period of thermal development can substantially be ensured. In the process for thermal development, either drum type heaters or plate type heaters may be used. However, plate type heater processes are more preferred. Preferable process for thermal development by a plate type heater may be a process described in JP-A NO. 11-133572, which discloses a thermal developing device in which a visible image is obtained by bringing a photothermographic material with a formed latent image into contact with a heating means at a thermal development region, wherein the heating means comprises a plate heater, and plurality of retainer rollers are oppositely provided along one surface of the plate heater, the thermal developing device is characterized in that thermal development is performed by passing the photothermographic material between the retainer rollers and the plate heater. It is preferred that the plate heater is divided into 2 to 6 portions, with the leading end having the lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

For downsizing the thermal developing apparatus as well as reduction in time period of thermal development, it is preferred that more stable control of the heater can be accomplished, and in addition, it is desired that light exposure is started from the leading end of one photosensitive material sheet followed by thermal development which is started before completing the light exposure up to the posterior end. Preferable imagers which enable a rapid treatment according to the invention are described in for example, JP-A No. 2003-285455.

3) System

Examples of a medical laser imager equipped with a light exposing part and a thermal developing part include Fuji Medical Dry Laser Imager FM-DP L and Dry PIX 7000. In connection with FM-DP L, description is found in Fuji Medical Review No. 8, pages 39 to 55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

1. Preparation of PET Support

1) Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours. Thereafter, the mixture was extruded from a T-die and rapidly cooled to form a non-tentered film having such a thickness that the thickness should become 175 μm after tentered and thermal fixation.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm to obtain a roll having the thickness of 175 μm.

2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/$m^2$ was executed, judging from the readings of current and voltage on that occasion. The frequency upon this treatment was 9.6 kHz, and the gap clearance between the electrode and dielectric roll was 1.6 mm.

3) Undercoating

<Preparation of Coating Solution for Undercoat Layer>

| Formula (1) (for undercoat layer on the image forming layer side) | |
|---|---|
| Pesresin A-520 manufactured by Takamatsu Oil & Fat Co., Ltd. (30% by weight solution) | 59 g |
| polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| distilled water | 935 mL |
| **Formula (2) (for first layer on the back surface)** | |
| Styrene-butadiene copolymer latex (solid content of 40% by weight, styrene/butadiene weight ratio = 68/32) | 158 g |
| 8% by weight aqueous solution of 2,4-dichloro-6-hydroxy-S-triazine sodium salt | 20 g |
| 1% by weight aqueous solution of sodium laurylbenzenesulfonate | 10 mL |
| distilled water | 854 mL |

-continued

| Formula (3) (for second layer on the back surface) | |
|---|---|
| $SnO_2$/SbO (9/1 weight ratio, mean particle diameter of 0.038 μm, 17% by weight dispersion) | 84 g |
| gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| distilled water | 805 mL |

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/$m^2$ (per one side), and dried at 180° C. for 5 minutes. Then, the aforementioned formula (2) of the coating solution for the undercoat was coated on the reverse face (back surface) with a wire bar so that the amount of wet coating became 5.7 mL/$m^2$, and dried at 180° C. for 5 minutes. Furthermore, the aforementioned formula (3) of the coating solution for the undercoat was coated on the reverse face (back surface) with a wire bar so that the amount of wet coating became 7.7 mL/$m^2$, and dried at 180° C. for 6 minutes. Thus, an undercoated support was produced.

2. Back Layer

1) Prepration of Coating Solution for Back Layer

<Preparation of Coating Solution for Antihalation Layer>

60 g of gelatin, 24.5 g of polyacrylamide, 2.2 g of a 1 mol/L aqueous sodium hydroxide solution, 2.4 g of monodispersed polymethyl methacrylate fine particles (mean particle size of 8 μm, standard deviation of particle diameter of 0.4), 0.08 g of benzoisothiazolinone, 0.3 g of sodium polystyrenesulfonate, 0.21 g of blue dye-1, 6.8 g of ultraviolet absorber-1, and 8.3 g of acrylic acid/ethyl acrylate copolymer latex (copolymerization rate 5/95) were mixed. Then, water was added to give the total volume of 818 mL to prepare a coating solution for the antihalation layer.

<Preparation of Coating Solution for Back Surface Protective Layer>

A vessel was kept at 40° C., and thereto were added 40 g of gelatin, liquid paraffin emulsion at 1.5 g equivalent to liquid paraffin, 35 mg of benzoisothiazolinone, 6.8 g of a 1 mol/L aqueous sodium hydroxide solution, 0.5 g of sodium t-octylphenoxyethoxyethanesufonate, 0.27 g of sodium polystyrenesulfonate, 5.4 mL of a 2% by weight solution of a fluorocarbon surfactant (F-1), 6.0 g of acrylic acid/ethyl acrylate copolymer latex (copolymer weight ratio of 5/95), and 2.0 g of N,N'-ethylenebis(vinylsufoneacetamide) were admixed. Then water was added to give the volume of 1000 mL to prepare a coating solution for the back surface protective layer.

2) Coating of Back Layer

The back surface side of the undercoated support as described above was subjected to simultaneous double coating so that the coating solution for the antihalation layer gives the coating amount of gelatin of 0.88 g/$m^2$, and so that the coating solution for the back surface protective layer gives the coating amount of gelatin of 1.2 g/$m^2$, followed by drying to produce a back layer.

3. Image Forming Layer, Intermediate Layer and Surface Protective Layer 3-1. Preparations of Coating Materials 1) Preparations of Silver Halide Emulsion (Preparation of Silver Halide Emulsion-1)

To 1420 mL of distilled water was added 4.3 mL of a 1% by weight potassium iodide solution. Further, a liquid added with 3.5 mL of a 0.5 mol/L sulfuric acid and 36.7 g of phthalated gelatin was kept at 42° C. while stirring in a stainless steel reaction pot, and thereto were added total amount of: solution A prepared through diluting 22.22 g of silver nitrate by adding distilled water to give the volume of 195.6 mL; and solution B prepared through diluting 21.8 g of potassium iodide with distilled water to give the volume of 218 mL, over 9 minutes at a constant flow rate. Thereafter, 10 mL of a 3.5% by weight aqueous solution of hydrogen peroxide was added thereto, and 10.8 mL of a 10% by weight aqueous solution of benzimidazole was further added.

Moreover, a solution C prepared through diluting 51.86 g of silver nitrate by adding distilled water to give the volume of 317.5 mL and a solution D prepared through diluting 60 g of potassium iodide with distilled water to give the volume of 600 mL were added. A controlled double jet method was executed through adding total amount of the solution C at a constant flow rate over 120 minutes, accompanied by adding the solution D while maintaining the pAg at 8.1. Hexachloroiridium (III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron (II) hexacyanide aqueous solution was added at a total amount of $3\times10^{-4}$ mol per one mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-mentioned silver halide dispersion was kept at 38° C. with stirring, and thereto was added 5 mL of a 0.34% by weight methanol solution of 1,2-benzoisothiazoline-3-one, followed by elevating the temperature to 47° C. At 20 minutes after elevating the temperature, sodium benzene thiosulfonate in a methanol solution was added at $7.6\times10^{-5}$ mol per one mol of silver. At additional 5 minutes later, a tellurium sensitizer C in a methanol solution was added at $2.9\times10^{-4}$ mol per one mol of silver and subjected to aging for 91 minutes. Thereto was added 1.3 mL of a 0.8% by weight N,N'-dihydroxy-N",N"-diethylmelamine in methanol, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver were added to produce a silver halide emulsion-1. Grains in the prepared silver halide emulsion-1 were pure silver iodide grains having a mean sphere equivalent diameter of 0.040 μm, a variation coefficient of 18%, and tetrahedron shaped grains having planes of (001), 11001 and {101}. The ratio of □phase was 30%, determined by powder X ray diffraction analysis. Grain size and the like were determined from the average of 1000 grains using an electron microscope.

(Preparation of Silver Halide Emulsion-2)

Preparation of silver halide emulsion-2 was conducted in a similar manner to the process in the preparation of the silver halide emulsion-1 except that: the temperature of the reaction solution was altered to 65° C., and 5 mL of a 5% by weight 2,2'-(ethylenedithio) diethanol in methanol was added after adding the solutions A and B, solution D was added by controlled double jet method keeping pAg at 10.5, bromoauric acid at $5.0\times10^{-4}$ mol per one mol of silver and potassium thiocyanate at $2.0\times10^{-3}$ mol per one mol of silver were added after the addition of the tellurium sensitizer in chemical sensitizing step.

Grains in thus prepared silver halide emulsion were pure silver iodide tabular grains having a mean circle equivalent diameter of 0.164 μm, a mean thickness of 0.032 μm, a mean aspect ratio of 5, a mean sphere equivalent diameter of 0.11 μm, and a variation coefficient thereof of 23%. The ratio of □phase determined by powder X ray diffraction analysis was 80%. Grain size and the like were determined from the average of 1000 grains using an electron microscope.

(Preparation of Silver Halide Emulsion-3)

Preparation of silver halide emulsion-3 was conducted in a similar manner to the process in the preparation of the silver halide emulsion-1 except that the temperature of the reaction solution was altered to 27° C., and a solution D was added by controlled double jet method keeping pAg at 10.2.

Grains in thus prepared silver halide emulsion were pure silver iodide grains having a mean sphere equivalent diameter of 0.022 μm, a variation coefficient of 17%. These were dodecahedron grains shaped having planes of (001), {1(−1)0} and {101}. Almost of the grains were □phase, determined by powder X ray diffraction analysis. Grain size and the like were determined from the average of 1000 grains using an electron microscope.

(Preparation of Mixed Emulsion A for Coating Solution)

The silver halide emulsion-1, the silver halide emulsion-2, and the silver halide emulsion-3 were dissolved at 5:2:3 as molar ratio of silver, and thereto was added benzothiazolium iodide at $7\times10^{-3}$ mol per one mol of silver with a 1% by weight aqueous solution. Further, water was added thereto to give the content of silver of 38.2 g per one kg of the emulsion for a coating solution, and 1-(3-methylureidophenyl)-5-mercaptotetrazole was added to give 0.34 g per 1 kg of the emulsion for a coating solution.

Further, as "a compound that can be one-electron-oxidized to provide a one-electron oxidation product, which releases one or more electrons", the compounds Nos. 2, 20 and 26 were added respectively in the amount of $2\times10^{-3}$ mol per one mol of silver halide.

Thereafter, as "a compound having an adsorptive group and a reducible group", the compound Nos. (19), (49), and (71) were added respectively in the amount of $8\times10^{-3}$ mol per one mol of silver halide.

(Preparation of Silver Halide Emulsion-4)

Preparation of silver halide emulsion-4 was conducted in a similar manner to the process in the preparation of the silver halide emulsion-1 except that using mixed solution of potassium iodide and potassium bromide instead of using potassium iodide solution. Grains in thus prepared silver halide emulsion-4 were silver iodobromide grains having a silver iodide content of 3.5 mol %. Grain size of the obtained grains was made to be the same as that of the silver halide emulsion-1, by controlling the temperature and pAg.

(Preparation of Silver Halide Emulsion-5)

Preparation of silver halide emulsion-5 was conducted in a similar manner to the process in the preparation of the silver halide emulsion-2 except that using mixed solution of potassium iodide and potassium bromide instead of using potassium iodide solution. Grains in thus prepared silver halide emulsion-5 were silver iodobromide grains having a silver iodide content of 3.5 mol %. Grain size of the obtained grains was made to be the same as that of the silver halide emulsion-2, by controlling the temperature and pAg.

(Preparation of Silver Halide Emulsion-6)

Preparation of silver halide emulsions was conducted in a similar manner to the process in the preparation of the silver halide emulsion-3 except that using mixed solution of potassium iodide and potassium bromide instead of using potassium iodide solution. Grains in thus prepared silver halide emulsions were silver iodobromide grains having a silver iodide content of 3.5 mol %. Grain size of the obtained grains was made to be the same as that of the silver halide emulsion-3, by controlling the temperature and pAg.

(Preparation of Mixed Emulsion B for Coating Solution)

Preparation of mixed emulsion B for coating solution was conducted in a similar manner to the process in the preparation of of mixed emulsion A for coating solution, except that changing the silver halide emulsion-1 to the silver halide emulsion-4, changing the silver halide emulsion-2 to the silver halide emulsion-5, and changing the silver halide emulsion-3 to the silver halide emulsion-6.

2) Preparation of Dispersion of Silver Salt of Fatty Acid (Preparation of Recrystallized Behenic Acid)

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. Thus resulting crystal was subjected to centrifugal filtration, and washing was performed with 100 kg of isopropyl alcohol, followed by repeating the aforementioned recrystallization procedure twice additionally. Thereafter, the crystal was dried. Thus resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

(Preparation of Dispersion of Silver Salt of Fatty Acid)

88 kg of recrystallized behenic acid, 422 L of distilled water, 49.2 L of an aqueous sodium hydroxide solution at the concentration of 5 mol/L, 120 L of t-butyl alcohol were admixed, and subjected to a reaction with stirring at 75° C. for one hour to give a solution of a sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of a sodium behenate and the total amount of the aqueous silver nitrate solution with sufficient stirring at a constant flow rate over 93 minutes and 15 seconds, and 90 minutes, respectively.

Upon this operation, during first 11 minutes following the initiation of adding the aqueous silver nitrate solution, the added material was restricted to the aqueous silver nitrate solution alone. The addition of the solution of a sodium behenate was thereafter started, and during 14 minutes and 15 seconds following the completion of adding the aqueous silver nitrate solution, the added material was restricted to the solution of a sodium behenate alone. The temperature inside of the reaction vessel was then set to be 30° C., and the temperature outside was controlled so that the liquid temperature could be kept constant.

In addition, the temperature of a pipeline for the addition system of the solution of a sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of a sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of a sodium behenate, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. An silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped fore and aft of the interaction chamber respectively, and accordingly, the temperature for the dispersion was set to be 18° C. by regulating the temperature of the cooling medium.

3) Preparations of Reducing Agent Dispersion (Preparation of Reducing Agent-1 Dispersion)

To 10 kg of a reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to thermal treatment at 60° C. for 5 hours to obtain a reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

(Preparation of Reducing Agent-2 Dispersion)

To 10 kg of a reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 80° C. for one hour to obtain a reducing agent-2 dispersion. Particles of the reducing agent included in the resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

4) Preparation of Hydrogen Bonding Compound-1 Dispersion

To 10 kg of a hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent thermal treatment at 80° C. for one hour to obtain a hydrogen bonding compound-1 dispersion. Particles of the hydrogen bonding compound included in the resulting hydrogen bonding compound-1 dispersion had a median diameter of 0.45 μm, and a maximum particle diameter of 1.3 μm or less. The resultant hydrogen bonding compound-1 dispersion was subjected to filtration with a polypropylene filter having a pore size of 3.0 μm to remove foreign substances such as dust, and stored.

5) Preparations of Dispersions of Development Accelerator and Color-Tone-Adjusting Agent (Preparation of Development Accelerator-1 Dispersion)

To 10 kg of a development accelerator-1 and 20 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the development accelerator to be 20% by weight. Accordingly, a development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

(Preparation of Dispersions of Development Accelerator-2 and Color-Tone-Adjusting Agent-1)

Also concerning solid dispersions of a development accelerator-2 and a color-tone-adjusting agent-1, dispersion was executed in a similar manner to the development accelerator-1, and thus dispersions of 20% by weight and 15% by weight were respectively obtained.

6) Preparations of Organic Polyhalogen Compound Dispersion (Preparation of Organic Polyhalogen Compound-1 Dispersion)

An organic polyhalogen compound-1 (tribromomethane sulfonylbenzene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. Accordingly, an organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

(Preparation of Organic Polyhalogen Compound-2 Dispersion)

An organic polyhalogen compound-2 (N-butyl-3-tribromomethane sulfonylbenzoamide) in an amount of 10 kg, 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

7) Preparation of Phthalazine Compound-1 Solution

Modified polyvinyl alcohol MP203 manufactured by Kuraray Co., Ltd., in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of a phthalazine compound-1 (6-isopropyl phthalazine) to prepare a 5% by weight phthalazine compound-1 solution.

8) Preparations of Aqueous Solution of Mercapto Compound (Preparation of an Aqueous Solution of Mercapto Compound-1)

A mercapto compound-1 (1-(3-sulfophenyl)-5-mercaptotetrazole sodium salt) in an amount of 7 g was dissolved in 993 g of water to give a 0.7% by weight aqueous solution.

(Preparation of an Aqueous Solution of Mercapto Compound-2)

A mercapto compound-2 (1-(3-methylureidophenyl)-5-mercaptotetrazole) in an amount of 20 g was dissolved in 980 g of water to give a 2.0% by weight aqueous solution.

9) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4G sand grinder mill: manufactured by IMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

10) Preparation of SBR Latex Solution

To a polymerization tank of a gas monomer reaction apparatus (manufactured by Taiatsu Techno Corporation, TAS-2J type), were charged 287 g of distilled water, 7.73 g of a surface active agent (Pionin A43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Tereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na^+$ ion: $NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had the mean particle diameter of 90 nm, Tg of 17° C., solid matter concentration of 44% by weight, the equilibrium moisture content at 25° C., 60% RH of 0.6% by weight, ionic conductance of 4.80 mS/cm (measurement of the ionic conductance performed using a conductivity meter CM-30S manufactured by To a Electronics Ltd. for the latex stock solution (44% by weight) at 25° C.) and pH of 8.4.

3-2. Preparations of Coating Solutions

1) Preparations of Coating Solution for Image Forming Layer-1 to -20

To the dispersion of the organic silver salt obtained as described above in an amount of 1000 g and 276 mL of water were serially added the pigment-1 dispersion, the organic polyhalogen compound dispersion (see Table 1), the phthalazine compound-1 solution, the SBR latex (Tg: 17° C.) solution, the reducing agent dispersion (see Table 1), the hydrogen bonding compound-1 dispersion, the development accelerator dispersion (see Table 1), the color-tone-adjusting agent-1 dispersion, the mercapto compound-1 aqueous solution, and the mercapto compound-2 aqueous solution. The coating solution for the image forming layer prepared by adding the mixed emulsion for coating solution (see Table 1) thereto followed by thorough mixing just prior to the coating was fed directly to a coating die, and was coated.

The amount of zirconium in the coating solution was 0.52 mg per one g of silver.

2) Preparation of Coating Solution for Intermediate Layer

To 1000 g of polyvinyl alcohol PVA-205 (manufactured by Kuraray Co., Ltd.), 272 g of the pigment-1 dispersion, and 4200 mL of a 19% by weight solution of methyl methacrylate/styrene/butyl acrylate/hydroxyethyl methacrylate/acrylic acid copolymer (weight ratio of the copolymerization of 64/9/20/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with sodium hydroxide to give the pH of 7.5. Accordingly, the coating solution for the intermediate layer was prepared, and was fed to a coating die to provide 9.1 mL/m$^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In water was dissolved 64 g of inert gelatin, and thereto were added 112 g of a 19% by weight solution of methyl methacrylate/styrene/butyl acrylate/hydroxyethyl methacrylate/acrylic acid copolymer (weight ratio of the copolymerization of 64/9/20/5/2) latex, 30 mL of a 15% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT (manufactured by American Cyanamid Co.), 0.5 g of phenoxyethyl alcohol, and 0.1 g of benzoisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 5.4 mL of a 2% by weight solution of a fluorocarbon surfactant (F-1), 5.4 mL of a 2% by weight aqueous solution of another fluorocarbon surfactant (F-2), 23 mL of a 5% by weight aqueous solution of aerosol OT (manufactured by American Cyanamid Co.), 4 g of polymethyl methacrylate fine particles (mean particle diameter of 0.7 μm) and 21 g of polymethyl methacrylate fine particles (mean particle diameter of 4.5 μm), 1.6 g of 4-methyl phthalic acid, 4.8 g of phthalic acid, 44 mL of 0.5 mol/L sulfuric acid, and 10 mg of benzoisothiazolinone. Water was added to give total amount of 650 g. Immediately before coating, 445 mL of a aqueous solution containing 4% by weight chrome alum and 0.67% by weight phthalic acid was mixed to give a coating solution for the second layer of the surface protective layers, which was fed to a coating die so that 8.3 mL/m could be provided.

Viscosity of the coating solution was 19 [mPa·s] which was measured with a B type viscometer at 40° C. (No. 1 rotor, 60 rpm).

4. Preparations of Photothermographic Material-1 to -20

Reverse surface of the back surface was subjected to simultaneous overlaying coating by a slide bead coating method in order of the image forming layer, intermediate layer, first layer of the surface protective layers and second layer of the surface protective layers starting from the undercoated face, and thus a sample of the photothermographic material was produced. In this method, the temperature of the coating solution was adjusted to 31° C. for the image forming layer and intermediate layer, to 36° C. for the first layer of the surface protective layers, and to 37° C. for the second layer of the surface protective layers. The coating amount of each compound for the image forming layer (g/m$^2$) is as follows.

| | |
|---|---|
| Silver salt of fatty acid | 5.27 |
| Pigment (C.I. Pigment Blue 60) | 0.036 |
| Organic polyhalogen compound-1 | (see Table 1) |
| Organic polyhalogen compound-2 | (see Table 1) |
| Phthalazine compound-1 | 0.18 |
| SBR latex | 9.43 |
| Reducing agent-1 | (see Table 1) |
| Reducing agent-2 | (see Table 1) |
| Hydrogen bonding compound-1 | 0.28 |
| Development accelerator-1 | (see Table 1) |
| Development accelerator-2 | (see Table 1) |
| Color-tone-adjusting agent-1 | 0.008 |
| Mercapto compound-1 | 0.002 |
| Mercapto compound-2 | 0.006 |
| Silver halide (on the basis of Ag content) | 0.046 |

Conditions for coating and drying are as follows.

The support was decharged by ionic wind, and coating was performed at the speed of 160 m/min.

The clearance between the leading end of the coating die and the support being 0.10 mm to 0.30 mm, and with the pressure in the vacuum chamber set to be lower than atmospheric pressure by 196 Pa to 882 Pa. In the subsequent cooling zone, the coating solution was cooled by wind having the dry-bulb temperature of 10° C. to 20° C. Thereafter, transportation with no contact was carried out, and the coated support was dried with an air of the dry-bulb of 23° C. to 45° C. and the wet-bulb of 15° C. to 21° C. in a helical type contactless drying apparatus. After drying, moisture conditioning was performed at 25° C. in the humidity of 40% RH to 60% RH. Then, the film surface was heated to be 70° C. to 90° C. After heating, the film surface was cooled to 25° C.

Chemical structures of the compounds used in Examples of the invention are shown below.

Compound 2 that can be one-electron-oxidized to provide a one-electron oxidation product which releases one or more electrons

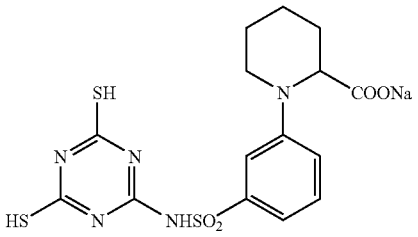

Compound 20 that can be one-electron-oxidized to provide a one-electron oxidation product which releases one or more electrons

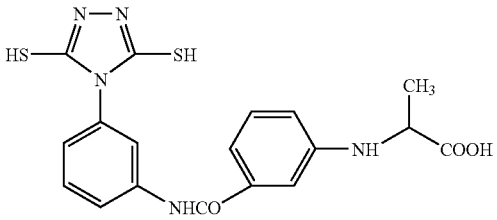

Compound 26 that can be one-electron-oxidized to provide a one-electron oxidation product which releases one or more electrons

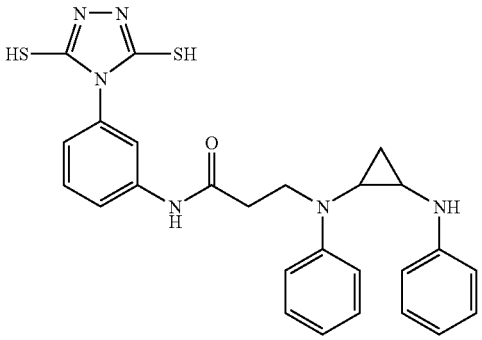

Compound (19) having adsorptive group and reducible group

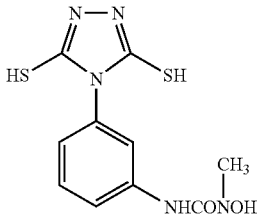

Compound (49) having adsorptive group and reducible group

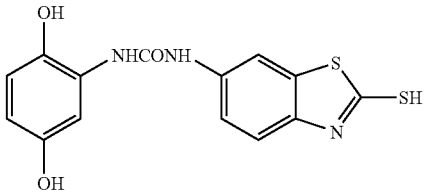

Compound (71) having adsorptive group and reducible group

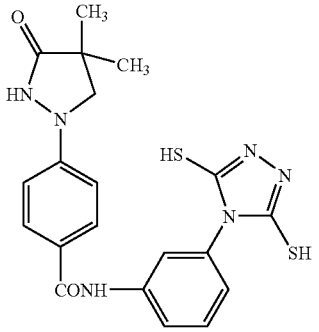

Blue dye-1

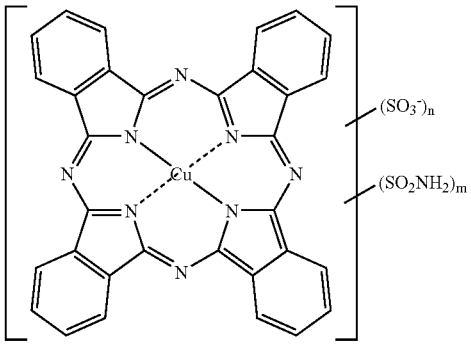

n = 1 ~ 3
m = 1 ~ 3

-continued

Ultraviolet absorber-1

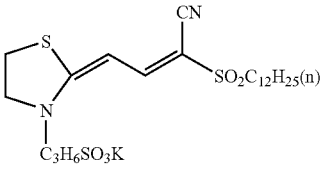

Reducing agent-1

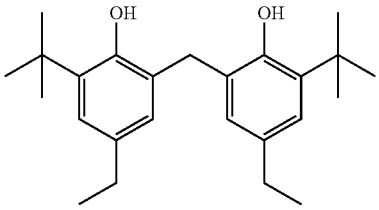

Reducing agent-2

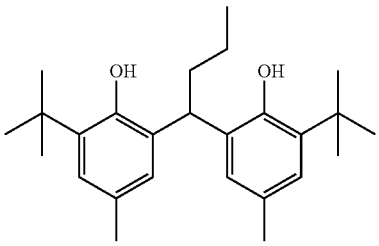

Hydrogen bonding compound-1

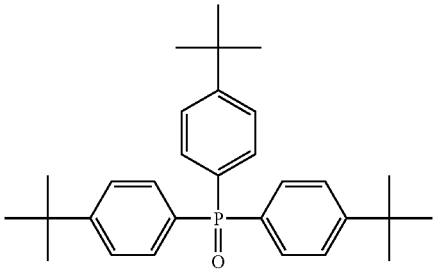

Organic polyhalogen compound-1

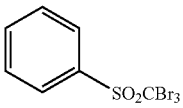

Organic polyhalogen compound-2

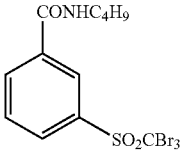

Mercapto compound-1

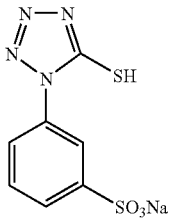

-continued

Mercapto compound-2

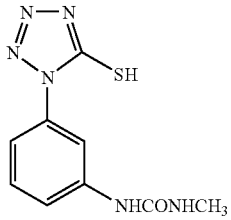

Phthalazine compound-1

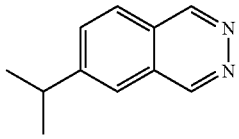

Development accelerator-1

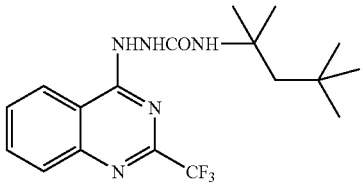

Development accelerator-2

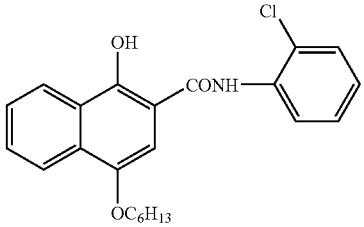

Color-tone-adjusting agent-1

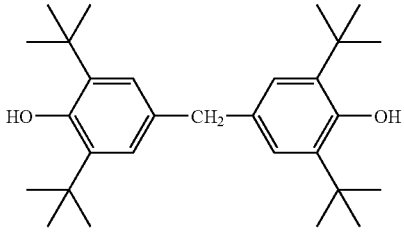

(F-1)

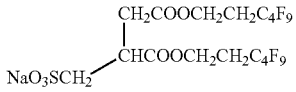

(F-2)

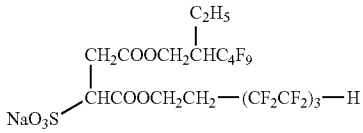

5. Evaluation of Photographic Properties

1) Preparation

The resulting sample was cut into a half-cut size (43 cm in length×35 cm in width), and was wrapped with the following packaging material under an environment of 25° C. and 50% RH, and stored for 2 weeks at an ambient temperature.

(Packaging Material)

PET 10 μm/PE 12 μm/aluminum foil 9 μm/Ny 15 μm/polyethylene 50 μm containing carbon at 3% by weight, oxygen permeability at 25° C.: 0.02 $mL \cdot atm^{-1}m^{-2}day^{-1}$, vapor permeability at 25° C.: 0.10 $g \cdot atm^{-1}m^{-2}day^{-1}$.

2) Exposure and Thermal Development

Exposure was performed on samples using a Fuji medical dry laser imager FM-DP L in which a NLHV 3000E laser diode fabricated by Nichia Corporation as a laser diode beam source was mounted in an exposure portion thereof and a beam diameter thereof was adjusted to about 100 μm. Other exposure conditions were as follows: exposure of a photothermographic material was performed for $10^{-6}$ sec with a photothermographic material surface illumination intensity at 0 $mW/mm^2$ and at various values from 1 $mW/mm^2$ to 1000 $mW/mm^2$. A light-emission wavelength of laser beam was 405 nm. Thermal development was performed in conditions that 4 panel heaters were set to 120° C.-120° C.-120° C.-120° C., and a total residence time in the zone of 120° C. was set to be 10 seconds by controlling the transport speed. Further, a total time period of thermal development was set to 10 seconds and 14 seconds, by controlling the transport speed. Evaluation on an image obtained was performed with a densitometer.

(Sensitivity)

Concerning both the samples developed for 10 seconds and the samples developed for 14 seconds, sensitivity $S_{10}$ and $S_{14}$ were determined respectively from a logarithm of a reciprocal of the exposure value necessary for giving a density 1.0+fog. And then the difference □S between them was obtained as follows;

$$\square S = S_{14} - S_{10}$$

(Evaluation of Color Tone of Developed Silver Image)

Color tones of the obtained images were evaluated by visual observation and classified into four criteria as shown below;

◎: No difference in color tone between the images developed for 10 seconds and 14 seconds is seen ○: Slightly difference in color tone is seen and of no problem in practical use Δ: Slightly difference in color tone is seen but unacceptable level in practical use X: Marked difference in color tone is seen The obtained results are given in Table 1.

TABLE 1

| Sample No. | Mixed emulsion No. | Reducing agent (g/m²) Reducing agent-1 | Reducing agent (g/m²) Reducing agent-2 | Development accelerator (g/m²) Development accelerator-1 | Development accelerator (g/m²) Development accelerator-2 | Organic polyhalogen compound (g/m²) Compound-1 | Organic polyhalogen compound (g/m²) Compound-2 | Sensitivity difference (ΔS) | Difference in color tone |
|---|---|---|---|---|---|---|---|---|---|
| 1 | B | 0.44 | 0.18 | 0.025 | 0.020 | 0.09 | 0.14 | 0.42 | X |
| 2 | B | 0.55 | 0.22 | 0.025 | 0.020 | 0.09 | 0.14 | 0.28 | Δ |
| 3 | B | 0.66 | 0.26 | 0.025 | 0.020 | 0.09 | 0.14 | 0.15 | Δ |
| 4 | B | 0.83 | 0.33 | 0.025 | 0.020 | 0.09 | 0.14 | 0.08 | X |
| 5 | B | 0.55 | 0.22 | 0.013 | 0.010 | 0.09 | 0.14 | 0.51 | X |
| 6 | B | 0.55 | 0.22 | 0.038 | 0.030 | 0.09 | 0.14 | 0.12 | Δ |
| 7 | B | 0.55 | 0.22 | 0.050 | 0.040 | 0.09 | 0.14 | 0.06 | X |
| 8 | B | 0.55 | 0.22 | 0.025 | 0.020 | 0.05 | 0.07 | 0.07 | X |
| 9 | B | 0.55 | 0.22 | 0.025 | 0.020 | 0.07 | 0.11 | 0.13 | Δ |
| 10 | B | 0.55 | 0.22 | 0.025 | 0.020 | 0.11 | 0.18 | 0.35 | X |
| 11 | A | 0.44 | 0.18 | 0.025 | 0.020 | 0.09 | 0.14 | 0.08 | ○ |
| 12 | A | 0.55 | 0.22 | 0.025 | 0.020 | 0.09 | 0.14 | 0.04 | ◎ |
| 13 | A | 0.66 | 0.26 | 0.025 | 0.020 | 0.09 | 0.14 | 0.07 | ○ |
| 14 | A | 0.83 | 0.33 | 0.025 | 0.020 | 0.09 | 0.14 | 0.13 | Δ |
| 15 | A | 0.55 | 0.22 | 0.013 | 0.010 | 0.09 | 0.14 | 0.14 | Δ |
| 16 | A | 0.55 | 0.22 | 0.038 | 0.030 | 0.09 | 0.14 | 0.04 | ◎ |
| 17 | A | 0.55 | 0.22 | 0.050 | 0.040 | 0.09 | 0.14 | 0.09 | ○ |
| 18 | A | 0.55 | 0.22 | 0.025 | 0.020 | 0.05 | 0.07 | 0.15 | X |
| 19 | A | 0.55 | 0.22 | 0.025 | 0.020 | 0.07 | 0.11 | 0.07 | ○ |
| 20 | A | 0.55 | 0.22 | 0.025 | 0.020 | 0.11 | 0.18 | 0.12 | Δ |

As seen from the results shown in Table 1, the photothermographic material Nos. 11 to 13, 16, 17 and 19 according to the present invention show excellent images with little difference in color tone or acceptable level in practical use.

The said samples were characterized by making the sensitivity difference (□S) between the samples developed for 14 seconds and 10 seconds to be 0.1 or less, by using the mixed emulsion A for coating solution. The sensitivity difference (□S) of 0.10 or less was attained only by using proper addition amount of each of the reducing agents, the development accelerators, and the organic polyhalogen compounds in combination, according to the present invention.

On the contrary, in case of the samples using the mixed emulsion B for coating solution, the difference in color tone was not improved even if the sensitivity difference (□S) resulted 0.10 or less.

The above mentioned improvement can be obtained only by the photothermographic material coated with silver halide emulsion having a high silver iodide content according to the present invention, and the resultant sensitivity difference (□S) of 0.10 or less between samples developed for 14 seconds and 10 seconds.

Example 2

The sample Nos. 1 to 20 of Example 1 were exposured and thermally developed as described below, and sensitivity difference, Dmax difference and difference in color tone of the obtained images were evaluated.

<Exposure and Thermal Development>

Exposure was performed on samples using a Fuji medical dry laser imager FM-DP L in which a NLHV 3000E laser diode fabricated by Nichia Corporation as a laser diode beam source was mounted in an exposure portion thereof and a beam diameter thereof was adjusted to about 100 μm. Other exposure conditions were as follows: exposure of a photothermographic material was performed for $10^{-6}$ sec with a photothermographic material surface illumination intensity at 0 mW/mm$^2$ and at various values from 1 mW/mm$^2$ to 1000 mW/mm$^2$. A light-emission wavelength of laser beam was 405 nm. Thermal development was performed in conditions that 4 panel heaters were set to 117° C.-117° C.-117° C.-117° C., and developed for 12 seconds by controlling the transport speed. And further, another thermal development was performed in conditions that 4 panel heaters were set to 123° C.-123° C.-123° C.-123° C., and developed similarly for 12 seconds.

(Sensitivity)

Concerning both the samples developed at 117° C. and the samples developed at 123° C., sensitivity $S_{117}$ and $S_{123}$ were determined respectively from a logarithm of a reciprocal of the exposure value necessary for giving a density 1.0+fog. And then the difference 0 S between them was obtained as follows;

$$\square S = S_{123} - S_{117}$$

(Dmax)

Concerning both the samples developed at 117° C. and the samples developed at 123° C., $Dmax_{117}$ and $Dmax_{123}$ were determined respectively from a maximum density saturated by increasing the exposure value. And then the difference □Dmax between them was obtained as follows;

$$\square Dmax = Dmax_{123} - Dmax_{117}$$

(Evaluation of Color Tone of Developed Silver Image)

Concerning both the samples developed at 117° C. and the samples developed at 123° C., color tones of developed silver images were evaluated similar to Example 1 and classified into four criteria, ◎, ○, Δ and X.

The obtained results are given in Table 2.

TABLE 2

| Sample No. | Sensitivity difference (ΔS) | Density difference (ΔDmax) | Difference in color tone |
|---|---|---|---|
| 1 | 0.35 | 0.20 | X |
| 2 | 0.25 | 0.15 | X |
| 3 | 0.12 | 0.08 | Δ |
| 4 | 0.07 | 0.05 | X |
| 5 | 0.42 | 0.25 | X |
| 6 | 0.09 | 0.07 | Δ |
| 7 | 0.05 | 0.04 | X |
| 8 | 0.08 | 0.06 | X |
| 9 | 0.10 | 0.07 | Δ |
| 10 | 0.28 | 0.16 | X |
| 11 | 0.07 | 0.04 | o |
| 12 | 0.04 | 0.03 | ◎ |
| 13 | 0.06 | 0.04 | ◎ |
| 14 | 0.14 | 0.11 | Δ |
| 15 | 0.15 | 0.11 | Δ |
| 16 | 0.04 | 0.03 | ◎ |
| 17 | 0.07 | 0.04 | o |
| 18 | 0.16 | 0.11 | X |
| 19 | 0.06 | 0.04 | ◎ |
| 20 | 0.13 | 0.11 | Δ |

As seen from the results shown in Table 2, the photothermographic materials Nos. 11 to 13, 16, 17 and 19 according to the present invention show excellent images with little difference in color tone or acceptable level in practical use, similarly to Example 1.

The said samples were characterized by making the sensitivity difference (□S) between the samples developed at 117° C. and 123° C. to be 0.10 or less and the density difference (□Dmax) to be 0.10 or less, by using the mixed emulsion A for coating solution. The sensitivity difference (□S) of 0.10 or less was attained only by using proper addition amount of each of the reducing agents, the development accelerators, and the organic polyhalogen compounds in combination, according to the present invention.

On the contrary, in case of the samples using the mixed emulsion B for coating solution, it was also possible to make the sensitivity difference(□S) to be 0.10 or less and Dmax difference to be 0.10 or less. But, in case of using the mixed emulsion B for coating solution, the difference in color tone was not improved even if the sensitivity difference(□S) and the Dmax difference (□Dmax) resulted 0.10 or less respectively.

The above mentioned improvement can be obtained only by the photothermographic material coated with silver halide emulsion having a high silver iodide content according to the present invention, and the resultant sensitivity difference (□S) of 0.10 or less and Dmax difference (□Dmax) of 0.10 or less between samples developed at 117° C. and 123° C.

Example 3

1. Preparation of Photothermographic Materials

Samples a to k were prepared as similar to Example 1 but reducing agent-1 (R-6) and reducing agent-2 (R-5) were changed to compounds as shown in Tables 3 and 4. Compounds involved in claim 7 and 10 in present invention were represented as compound A in the tables. Compounds involved in claim 8 and 11 in present invention were represented as compound B in the tables. Compounds involved in claim 9 and 12 in present invention were represented as compound C in the tables.

2. Evaluation of the Samples

Samples above prepared were imagewise exposed and thermal developed using a Fuji medical dry laser imager FM-DPL similarly to Example 1, wherein the imagewise exposure was started from a leading end of the photothermographic material followed by the thermal development which was started before completing the imagewise exposure up to a posterior end thereof.

Sensitivity difference (ΔS) and density difference (ΔDmax) in each samples were shown in Tables 3 and 4. The difference in color tone evaluated in the same manner as in Example 1 were also shown in Tables 3 and 4.

Table 3 shows the differences between the sensitivity wherein the samples have been imagewise exposed and developed at 120° C. for 10 sec and the sensitivity wherein the samples have been imagewise exposed and developed at 120° C. for 14 sec.

Table 4 shows the differences between the density wherein the samples have been imagewise exposed and developed at 117° C. for 12 sec and the density wherein the samples have been imagewise exposed and developed at 123° C. for 12 sec.

The results shown in Tables 3 and 4 demonstrate that the photothermographic material comprising a combination of two reducing agents to satisfy the sensitivity difference (ΔS) or the density difference (ΔDmax) of 0.10 or less results in an excellent property in terms of the difference in color tone, but the photothermographic material comprising only one reducing agent could not satisfy the sensitivity difference of 0.10 or less nor result in the excellent color difference.

TABLE 3

| Sample No. | Compound (A) ($g/m^2$) | Compound (B) ($g/m^2$) | Compound (C) ($g/m^2$) | Sensitivity Difference (ΔS) | Difference in Color Tone | Remarks |
|---|---|---|---|---|---|---|
| 11 | R-6(0.44) | R-5(0.18) | — | 0.08 | ○ | Invention |
| a | R-6(0.62) | — | — | 0.16 | Δ | Comparative |
| b | — | R-5(0.62) | — | 0.13 | X | Comparative |
| c | R-6(0.44) | R-4(0.18) | — | 0.05 | ◎ | Invention |
| d | — | R-4(0.62) | — | 0.14 | X | Comparative |
| e | — | R-5(0.31) | R-2(0.31) | 0.09 | ○ | Invention |
| f | — | — | R-2(0.62) | 0.18 | Δ | Comparative |
| g | R-6(0.44) | — | R-2(0.18) | 0.10 | ○ | Invention |
| h | — | R-1(0.31) | R-2(0.31) | 0.10 | ○ | Invention |
| i | — | R-4(0.44) | R-2(0.18) | 0.06 | ◎ | Invention |
| j | — | R-9(0.31) | R-2(0.31) | 0.09 | ○ | Invention |
| k | — | R-9(0.62) | — | 0.17 | Δ | Comparative |

TABLE 4

| Sample No. | Compound (A) ($g/m^2$) | Compound (B) ($g/m^2$) | Compound (C) ($g/m^2$) | Density Difference (ΔD) | Difference in Color Tone | Remarks |
|---|---|---|---|---|---|---|
| 11 | R-6(0.44) | R-5(0.18) | — | 0.04 | ○ | Invention |
| a | R-6(0.62) | — | — | 0.17 | Δ | Comparative |
| b | — | R-5(0.62) | — | 0.13 | Δ | Comparative |
| c | R-6(0.44) | R-4(0.18) | — | 0.03 | ◎ | Invention |
| d | — | R-4(0.62) | — | 0.15 | Δ | Comparative |
| e | — | R-5(0.31) | R-2(0.31) | 0.06 | ○ | Invention |
| f | — | — | R-2(0.62) | 0.21 | X | Comparative |
| g | R-6(0.44) | — | R-2(0.18) | 0.05 | ○ | Invention |
| h | — | R-1(0.31) | R-2(0.31) | 0.06 | ○ | Invention |
| i | — | R-4(0.44) | R-2(0.18) | 0.04 | ◎ | Invention |
| j | — | R-9(0.31) | R-2(0.31) | 0.07 | ○ | Invention |
| k | — | R-9(0.62) | — | 0.23 | X | Comparative |

What is claimed is:

1. A photothermographic material comprising, on at least one surface of a support, at least a photosensitive silver halide, a non-photosensitive organic silver salt, a reducing agent and a binder, wherein the photosensitive silver halide has a silver iodide content of 40 mol % or more, and the photothermographic material contains two or more kinds of the reducing agent at the mixing ratio to satisfy at least one of a) and b):

a) a difference between a sensitivity when the photothermographic material has been imagewise exposed using a laser beam source and developed at 120° C. for 10 sec and a sensitivity when the photothermographic material has been imagewise exposed using a laser beam source and developed at 120° C. for 14 sec is 0.10 or less, wherein these sensitivities are expressed as a logarithm of a reciprocal of an exposure value;

b) a difference between a maximum density when the photothermographic material has been imagewise exposed using a laser beam source and developed at 120° C. for 10 sec and a maximum density when the photothermographic material has been imagewise exposed using a laser beam source and developed at 120° C. for 14 sec is 0.10 or less.

2. A photothermographic material comprising, on at least one surface of a support, at least a photosensitive silver halide, a non-photosensitive organic silver salt, a reducing agent and a binder, wherein the photosensitive silver halide has a silver iodide content of 40 mol % or more, and the photothermographic material contains two or more kinds of the reducing agent at the mixing ratio to satisfy at least one of a) and b):

a) a difference between a sensitivity when the photothermographic material has been imagewise exposed using a laser beam source and developed at 117° C. for 12 sec and a sensitivity when the photothermographic material has been imagewise exposed using a laser beam source and developed at 123° C. for 12 sec is 0.10 or less, wherein these sensitivities are expressed as a logarithm of a reciprocal of an exposure value;

b) a difference between a maximum density when the photothermographic material has been imagewise exposed using a laser beam source and developed at 117° C. for 12 sec and a maximum density when the photothermographic material has been imagewise exposed using a laser beam source and developed at 123° C. for 12 sec is 0.10 or less.

3. The photothermographic material according to claim 1 further containing a development accelerator at an optimum coating amount thereof to satisfy at least one of the a) and b).

4. The photothermographic material according to claim 2 further containing a development accelerator at an optimum coating amount thereof to satisfy at least the one of the a) and b).

5. The photothermographic material according to claim 1, wherein the laser beam source has a wavelength of 350 nm to 450 nm.

6. The photothermographic material according to claim 2, wherein the laser beam source has a wavelength of 350 nm to 450 nm.

7. The photothermographic material according to claim 1, wherein one of the two or more kinds of the reducing agent contains a compound represented by formula (R):

Formula (R)

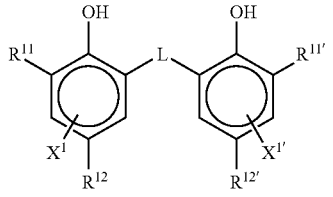

wherein L is —$CH_2$— group. $R^{11}$ and $R^{11'}$ each represent a t-butyl group. $X^1$, and $X^{1'}$ are hydrogen atom. $R^{12}$ and $R^{12'}$ each represent an ethyl group.

8. The photothermographic material according to claim 1, wherein one of the two or more kinds of the reducing agent contains a compound represented by formula (R):

Formula (R)

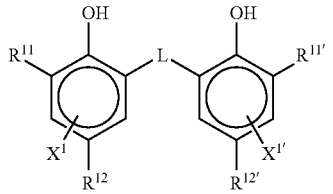

wherein L is —$CH(R^{13})$— group, wherein $R^{13}$ is a primary or secondary alkyl group having 1 to 8 carbon atoms. $R^{11}$ and $R^{11'}$ each independently represent a substituted or unsubstituted alkyl group having 1 to 20 carbon atoms. $R^{12}$ and $R^{12'}$ each represent a methyl group. $X^1$, and $X^{1'}$ are hydrogen atom.

9. The photothermographic material according to claim 8, wherein $R^{13}$ in —$CH(R^{13})$— is a secondary alkyl group, and $R^{11}$ and $R^{11'}$ each represent a methyl group.

10. The photothermographic material according to claim 2, wherein one of the two or more kinds of the reducing agent contains a compound represented by formula (R):

Formula (R)

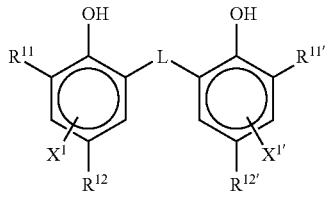

wherein L is —$CH_2$— group. $R^{11}$ and $R^{11'}$ each represent a t-butyl group. $X^1$, and $X^{1'}$ each represent a hydrogen atom. $R^{12}$ and $R^{12'}$ each represent an ethyl group.

11. The photothermographic material according to claim 2, wherein one of the two or more kinds of the reducing agent contains a compound represented by formula (R):

Formula (R)

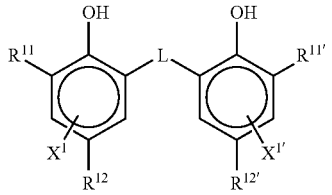

wherein L is —$CH(R^{13})$— group, wherein $R^{13}$ is a primary or secondary alkyl group having 1 to 8 carbon atom. $R^{11}$ and $R^{11'}$ each independently represent a substituted or unsubstituted alkyl group having 1 to 20 carbon atoms. $R^{12}$ and $R^{12'}$ each represent a methyl group. $X^1$ and $X^{1'}$ each represent a hydrogen atom.

12. The photothermographic material according to claim 11, wherein $R^{13}$ in —$CH(R^{13})$— is a secondary alkyl group, and $R^{11}$ and $R^{11'}$ each represent a methyl group.

13. The photothermographic material according to claim 1 further containing a polyhalogen compound at an optimum coating amount thereof to satisfy at least one of a) and b).

14. The photothermographic material according to claim 2 further containing a polyhalogen compound at an optimum coating amount thereof to satisfy at least one of a) and b).

15. A method of forming an image, wherein the photothermographic material according to claim 1 is imagewise exposed using a laser beam source and developed at a temperature selected from a range of 100° C. to 140° C. for 12 sec or less, wherein the imagewise exposure is started from a leading end of the photothermographic material followed by the thermal development which is started before completing the imagewise exposure up to a posterior end thereof.

16. The method of forming an image according to claim 15, wherein the photothermographic material is developed at a line speed of 23 mm/sec or higher.

17. A method of forming an image, wherein the photothermographic material according to claim 2 is imagewise exposed using a laser beam source and developed at a temperature selected from a range of 100° C. to 140° C. for 12 sec or less, wherein the imagewise exposure is started from a leading end of the photothermographic material followed by the thermal development which is started before completing the imagewise exposure up to a posterior end thereof.

18. The method of forming an image according to claim 17, wherein the photothermographic material is developed at a line speed of 23 mm/sec or higher.

* * * * *